US007036172B2

(12) United States Patent
Torbet et al.

(10) Patent No.: US 7,036,172 B2
(45) **Date of Patent: *May 2, 2006**

(54) BED HAVING LOW BODY PRESSURE AND ALIGNMENT

(75) Inventors: Philip Alan Torbet, San Rafael, CA (US); Roger Anton Sramek, Sausalito, CA (US); David Steven Perry, Sausalito, CA (US)

(73) Assignee: SleepAdvantage, LC, Sausalito, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/441,351

(22) Filed: May 20, 2003

(65) Prior Publication Data

US 2003/0221262 A1 Dec. 4, 2003

Related U.S. Application Data

(63) Continuation-in-part of application No. 10/160,542, filed on Jun. 1, 2002, now Pat. No. 6,807,698.

(51) Int. Cl.
*A47C 27/15* (2006.01)
*A47C 27/18* (2006.01)
*A47C 27/10* (2006.01)

(52) U.S. Cl. ..... 5/727; 5/736; 5/713

(58) Field of Classification Search ..... 5/727, 5/730, 738, 728, 713, 710, 736

See application file for complete search history.

(56) References Cited

U.S. PATENT DOCUMENTS

| | | | |
|---|---|---|---|
| 3,521,311 | A | 7/1970 | Cohen |
| 3,828,378 | A | 8/1974 | Flam |
| 3,885,258 | A | 5/1975 | Regan |
| 4,053,957 | A | 10/1977 | Regan |
| 4,110,881 | A | 9/1978 | Thompson |
| 4,662,012 | A | 5/1987 | Torbet |
| 4,706,313 | A | 11/1987 | Murphy |
| 4,771,495 | A | 9/1988 | Distler et al. |
| 4,918,773 | A | 4/1990 | Scott |
| 4,972,536 | A | 11/1990 | Scott |
| 4,982,466 | A | 1/1991 | Scott et al. |
| 4,986,738 | A | 1/1991 | Kawasaki et al. |
| 5,101,527 | A | 4/1992 | Wadsworth, III et al. |
| 5,134,735 | A | 8/1992 | Rose |
| 5,160,785 | A | 11/1992 | Davidson, Jr. |
| 5,184,802 | A | 2/1993 | Galumbeck |
| 5,230,110 | A | 7/1993 | Rose |
| 5,231,717 | A | 8/1993 | Scott et al. |
| 5,317,768 | A | 6/1994 | Klancnik |
| 5,430,901 | A | 7/1995 | Farley |
| 5,987,678 | A | 11/1999 | Ayers |
| 6,115,861 | A | 9/2000 | Reeder et al. |
| 6,202,239 | B1 | 3/2001 | Ward et al. |
| 6,223,371 | B1 | 5/2001 | Antinori et al. |
| 6,372,812 | B1 | 4/2002 | Niederost |

FOREIGN PATENT DOCUMENTS

| | | |
|---|---|---|
| WO | WO 81/02384 | 9/1981 |

*Primary Examiner*—Alexander Grosz
(74) *Attorney, Agent, or Firm*—David E. Lovejoy

(57) ABSTRACT

A mattress supporting a reclining body with low body pressure and in alignment. The mattress extends in a lateral direction from side to side and extends in a longitudinal direction from a mattress head to a mattress foot where the mattress includes a head part, a shoulder part, a waist part, a hip part and a leg part. The reclining body has a displacement profile that causes the mattress to undergo differing vertical displacements when supporting the reclining body. The mattress core has displacement parameters varying to match the displacement profile of the reclining body while supporting the reclining body with low body pressure. The core has a plurality of regions where the vertical displacement in one or more of the regions varies to match the displacement profile of the reclining body to maintain the reclining body in alignment.

37 Claims, 21 Drawing Sheets

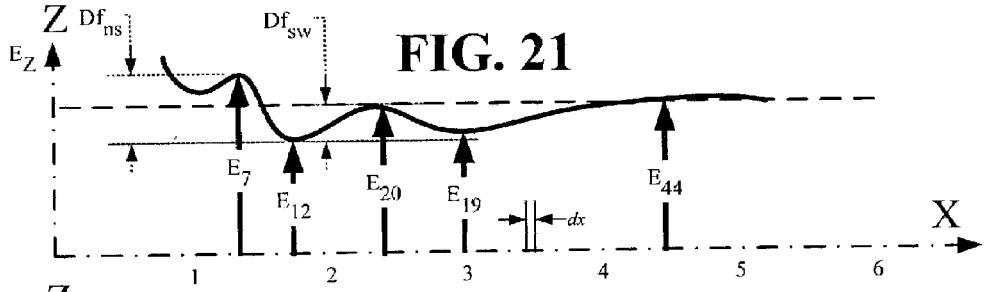
FIG. 21
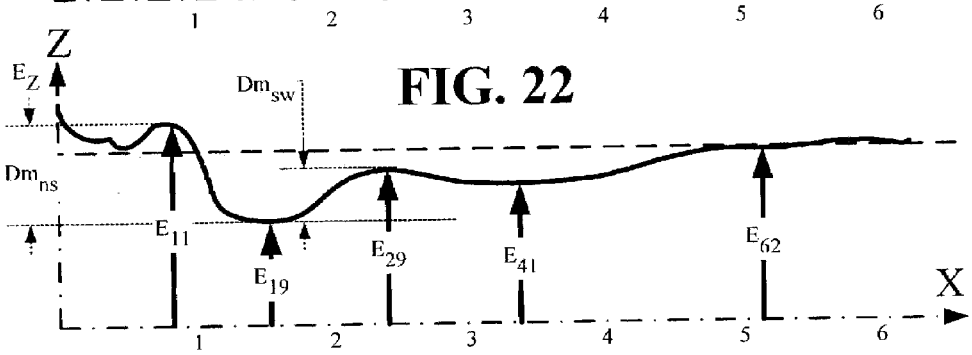
FIG. 22
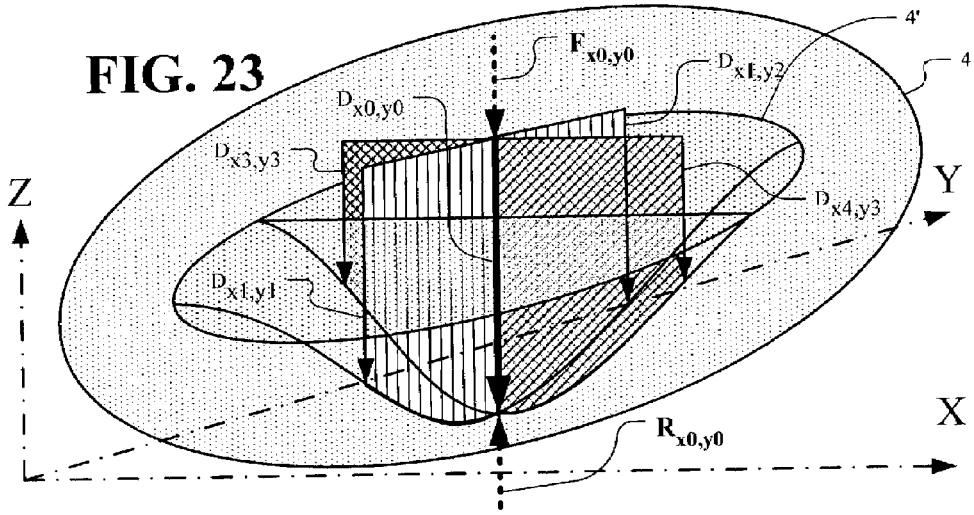
FIG. 23
FIG. 24
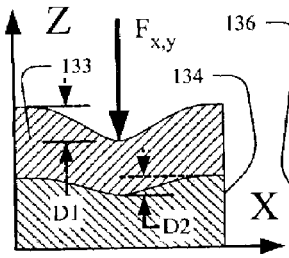
FIG. 25
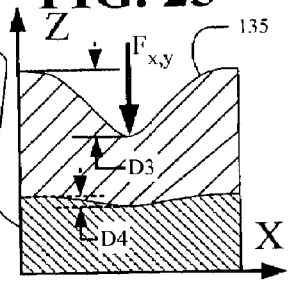
FIG. 26
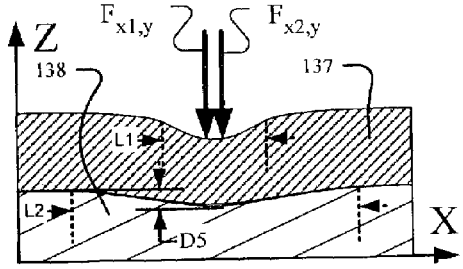

FIG. 31
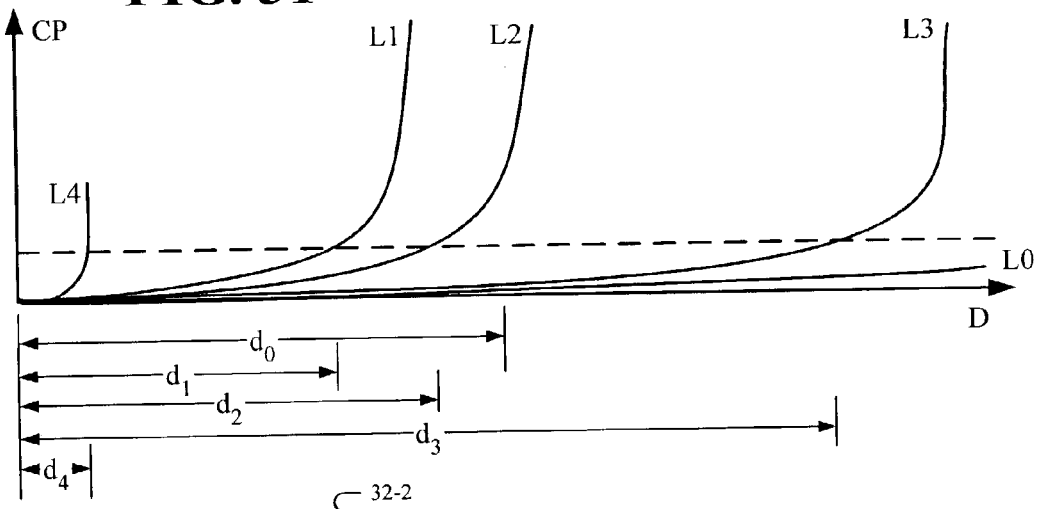
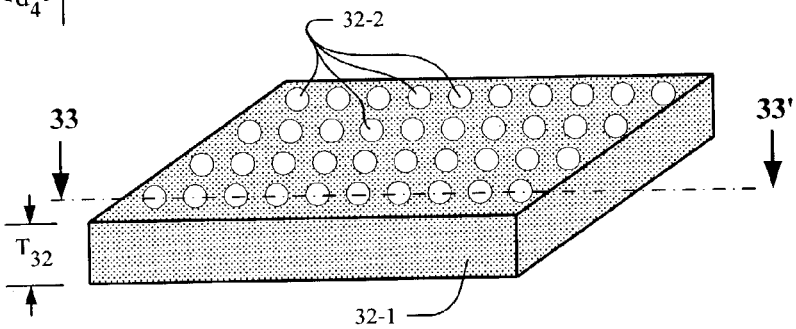
FIG. 32
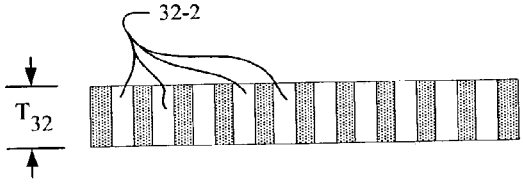
FIG. 33
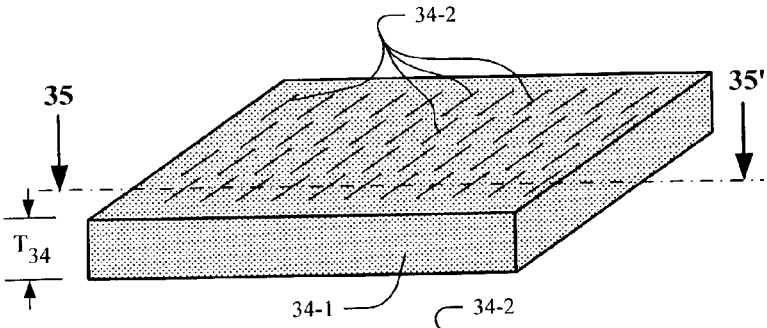
FIG. 34
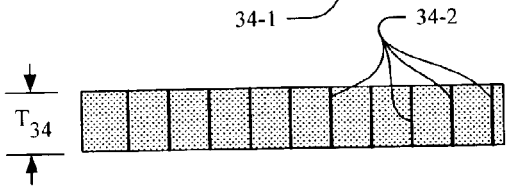
FIG. 35

BED HAVING LOW BODY PRESSURE AND ALIGNMENT

This application is a continuation-in-part of application Ser. No. 10/160,542, filed on Jun. 1, 2002, now U.S. Pat. No. 6,807,698.

BACKGROUND OF THE INVENTION

This invention relates to beds and, more particularly, to improved mattresses for beds that enhance the quality of sleep.

Normally, everyone spends a large percentage of everyday sleeping and the quality of sleep is important to a person's good health and enjoyment of life. Comfortable mattresses are important in establishing restful sleep. During sleep, a healthy person typically passes through five levels of sleep which include stages I–IV and which additionally includes a REM (Rapid Eye Movement) sleep stage. Stages I and II are the lightest sleep and stages III and IV are the deepest. The REM stage is that level in which sleepers dream and receive the mental health benefits attendant to dreaming. All levels of sleep are important, but stages III and IV are the deepest and most physically restful sleep, when, for example, human growth hormone is secreted. Normal sleep is cyclic passing through the stages from I to IV and back from IV to I and into and out of REM. This sleep cycle is repeated a number of times over a normal sleep period, but can be disrupted due, for example, to body discomfort.

Restfulness and the quality of sleep are dependent upon the comfort of sleepers. When sleepers become uncomfortable, they move to relieve the discomfort and the resulting moves are a normal part of sleep. When sleepers move, they frequently change to lighter levels of sleep (stage I or II) or awaken. The more discomfort sleepers feel, the more they will move and the more time they will spend in lighter and less restful sleep. Good sleeping is normally associated with a low number of body shifts during the sleep period. Bed-induced shifts due to discomfort caused by the bed are a significant cause of poor sleep quality. On conventional mattresses (including feather beds, inner spring mattresses, orthopedic mattresses, waterbeds and the like), most people experience about forty major postural body shifts in the course of a night's sleep. Poor sleepers experience about sixty percent more major shifts than good sleepers. While some shifts during a sleep period are beneficial, the quality of sleep can be greatly improved for many by reducing the number of bed-induced shifts.

There are two major causes of bed-induced shifting that cause poor sleep. The first major cause of shifting is the buildup of pressures on parts of the body and the second major cause of shifting is poor body alignment. Considering the first major cause of shifting, the buildup of pressures results from prolonged lying in the same position. On conventional mattresses, the pressure tends to be greatest on the body's protrusions (such as shoulders and hips) where body tissues are put in high compression against the mattress. High compression tends to restrict capillary blood flow which is recognized by the body, after a period of time, as discomfort. The amount of pressure which causes a discontinuance of capillary blood flow is called the ischemic pressure. The ischemic pressure threshold is normally considered to be approximately thirty mmHg. The discontinuance of capillary blood flow is observable as a red spot on the skin. After pressure is applied, a red spot on the skin is a precursor to tissue damage. When parts of the body (usually shoulders and hips in conventional mattresses) are subjected to pressures above the ischemic threshold, discomfort results and, hence, a person shifts to remove the discomfort and threat to tissue damage.

Considering the second major cause of shifting, poor body alignment results from lateral bending of the vertebral column of the body, particularly for a person in a side-sleeping position. Such lateral bending is typically caused by mattresses that allow sagging of the body. Conventional mattresses allow such sagging regardless of the hardness or the softness of the mattress but the sagging effect tends to be more pronounced on soft mattresses. A sagging mattress allows the waist to drop relative to the rib cage and hips and results in stress to muscles, tendons and ligaments. The stress from a sagging mattress frequently manifests as discomfort or even pain in the lumbar region of the back. Such discomfort causes the sleeper to shift in order to relieve the discomfort.

In U.S. Pat. No. 4,662,012 invented by Torbet, one of the inventors herein, an air mattress is disclosed for supporting a person in a reclining position while maintaining spinal alignment and while maintaining low supporting body surface pressure. The Torbet mattress utilized zones running laterally across the width of the mattress with differing air pressures in the zones longitudinally along the length of the mattress. The Torbet mattress has proved to be ideal for supporting sleepers while minimizing supporting body surface pressure and maintaining spinal alignment.

While the Torbet mattress has established a standard of comfort that has not been achieved by conventional mattresses, the Torbet mattress has not been distributed as widely as possible because of its high cost of manufacture. The superior benefits of the Torbet mattress have generally been available only to those, such as hospitals, sleep clinics and the wealthy, willing to pay a high price.

For the Torbet mattress and mattresses in general, persons of greater body weight tend to sink farther into and depress the mattress more than persons of lower body weight. Body protrusions (such as shoulders and hips) cause the highest depression of the mattress and need to be accommodated. The shoulder of a heavy body resting atop the mattress in a side-lying position should not bottom out, that is, the shoulder should not depress the mattress to the extent that an underlying hard supporting surface is felt.

Mattresses using foam and spring sections have been proposed to reduce the cost of the Torbet mattress. Foam or spring sections alone in mattresses, because of the vertical displacement properties of conventional foams and springs, have not satisfactorily achieved simultaneously spinal alignment and uniform low supporting body surface pressure along the interface between the mattress and the body.

An ideal mattress has a resiliency over the length of a body reclining on the mattress to support the body in spinal alignment, without allowing any part of the body to bottom out, and also has a low surface body pressure over all or most parts of the body in contact with the mattress. Since a reclining body has both varying density and varying contour in the longitudinal direction, the ideal mattress must conform to these variations. With such variations, in order to achieve spinal alignment, the supporting forces in the mattress, under load from the reclining body, must vary along the body to match the varying body density and shape. Also, when the body is in spinal alignment, for an ideal mattress, the supporting pressures in the mattress against the skin must be low. The preferred pressure against the skin of a person in bed for an ideal mattress is generally below the ischemic threshold. The preferred side-lying spinal alignment for a person in bed is generally defined as that alignment in which the spine is straight and on the same center line as the legs and head.

While the general principles of an ideal mattress have been recognized since the Torbet mattress, actual embodiments of mattresses that approach the properties of an ideal mattress at reasonable costs not have been forthcoming. Lateral zones, with varying compression in the longitudinal direction, of springs in spring mattresses are capable of achieving spinal alignment if the mattress is of sufficient depth to allow the shoulders and hips to sink into the mattress to a depth that maintains spinal alignment without bottoming out. However spring mattresses generally do not achieve spinal alignment for the primary reason that the compression forces in springs vary as a function of the vertical depression of the springs in compression. The taller the spring in the relaxed state, the greater is the vertical depression and compression of the spring before the force increases to balance the weight of the part of the body lying on the spring. Thus, a body can sink farther into a tall, weak spring before the weight of the body is balanced than it can sink into a short, firm spring. Although tall, weak compression springs are desirable for reducing body pressure, they tend to have intolerable lateral instability and other problems that result in uncomfortable mattresses.

Conventional single-layer spring mattresses with uniform springs are generally unable to provide the qualities necessary for an ideal mattress. In a two-layer structure, the spring compression rate is decreased if one compression spring in one layer is mounted atop another compression spring in another layer. U.S. Pat. No. 5,231,717 used the two-layer structure in multiple zones extending laterally, with different firmness in zones in the longitudinal direction, to provide bedding systems customized for each person in order to provide spinal alignment for each person's particular size and body density. However, such mattresses with different firmness sections in the top supporting layer (the supporting layer closest to the body) provide an irregular firmness that tends to disturb persons in bed.

While substitutes for the Torbet mattress have been attempted, conventional mattresses having zones made from springs and foam do not have the same properties as the air zones in the Torbet mattress. In a Torbet mattress, the force distribution in a zone as a result of vertical depression (caused by a body part such as a shoulder) tends to be distributed and averaged laterally over the entire zone. Because air is fluid, air pressure in a Torbet mattress tends to be averaged and equally distributed in a zone. By way of distinction, the lateral and longitudinal distribution of forces due to a body part depression (for example, from a shoulder) into foam is more local, more complex and is a function of the displacement properties of the particular foam material used. Simple foam and spring mattresses in single or multiple layers have not provided the comfort and other benefits of the Torbet mattress.

The physical properties of mattress materials include among others Density, Hardness, Tensile Strength, Indentation Load Deflection, Compression Load Deflection, Initial Softness Ratio, Resilience (Elasticity), Compression Modulus, Hysteresis and Durability/Lifetime. These physical properties are described as follows.

Hardness is the resistance against pressure.

Density is the mass per unit volume. Hardness and density are interrelated. When density increases, hardness tends to increase. Generally for lower density materials, a growing loss in hardness arises after repeated loading.

Tensile Strength is the measure of the resistance against stretching and changes in tensile strength are measured as Tensile % and changes in length after applying a tensile force are measured as Elongation %.

Indentation Load Deflection (ILD) is a hardness measurement defined in the ISO 2439 standard. ILD in the standard is defined as the force that is required to compress material a percentage of its original thickness, that is, compressed 25%, 40% and 60% from its original thickness (using in the standard a circular plate of 322 $cm^2$). These ILD's are designated $ILD_{25\%}$, $ILD_{40\%}$ and $ILD_{60\%}$ Compression Load Deflection (CLD) is a hardness measurement defined in the ISO 3386 standard. CLD is defined as the counterpressure (force per surface) in Pascal when the core material is pressed in 25% with a stamp where 1 kPA (kilopascal) equals 10 $g/cm^2$ (grams per square centimeter), Compression Set 75%.

Initial Softness Ratio (ISR) is a hardness measurement defined as the ratio of $ILD_{65\%}/ILD_{5\%}$. This measurement somewhat correlates to the initial perception of a person about the comfort of a mattress.

Resilience (Elasticity) is an elasticity measurement defined in the ASTM 3574 standard. Resilience/Elasticity is measured by the "ball-rebound" test where a steel ball is dropped from a height onto the mattress core and the rebound of the ball is measured as a % of a predetermined height.

Compression Modulus (Sag Factor) is a compression measurement defined in the ISO 2439 standard. This sag factor is defined as the ratio of $ILD_{65\%}$ to $ILD_{25\%}$. The sag factor somewhat correlates with the perception of a person as to whether the mattress supports the body with more uniform alignment.

Hysteresis is a measurement of the load deformation curve of the load surface. The hysteresis curve is determined by loading and de-loading of a mattress core. A circular plate of 355 mm diameter is used to gradually build a force up to a maximum of 1000 Newtons. The hysteresis represents the amount of energy that is absorbed by the material during loading/de-loading. The higher the absorption of energy by a mattress core, the more strength/energy is required by a person to change position on the mattress. Mattress cores which are too soft, have a low hysteresis which results in higher energy requirements for a person changing position on the mattress core. A low hysteresis value generally results in poor sleeping quality.

Durability/Lifetime is a measurement defined in one method by the EN 1957 standard. In this method, a weight of 1400 Newton is rolled 30,000 times up and down on the mattress core. Afterwards the height (Elevation), hardness, ILD and elasticity of the core are measured. This process is repeated once again and the results are compared with the original values and recorded as a as a % retention. The average incline of the hardness is determined at 210 N, 275 N and 340 N in the load deformation curve. Another measurement is defined by the ISO 3385 (DIN 5374) standard. In this method, a foam sample of 40×40 cm forced with a weight of 750 N for 80,000 times at 70 strokes per minute. Afterwards, the loss of height and the hardness are compared with the original values again as a % retention. Tear is another durability parameter measured in pounds per linear inch (pli) and indicates the energy required to pull a sample apart.

In addition to the technical parameters of ideal mattresses described above, many purchasers and merchants have come to expect beds to have other "standard properties". For example, an expectation is that mattresses will have standard sizes such as King, Queen, Double and so forth with dimensions that match existing fitted-sheet sizes, frame sizes and other bedding equipment sizes. Further, an expectation is that a mattress will be compatible with a two-part bed formed of a foundation and a mattress which together are suitable for use with standard frames, such as "Hollywood" or "Harvard" frames. Purchasers and merchants expect that a bed when made-up with sheets and blankets will appear flat and uniform. The public expects that a bed will have the support and rigidity suitable for a person to sit on the edge for tying shoes or to sit on the edge for other purposes. While these "standard properties" generally do not add to the suitability of the bed for sleeping, they are nonetheless important for widespread commercial acceptance of mattresses.

A number of additional "attributes" are also important for commercial acceptance of mattresses. A mattress design desirably meets the needs of a large percentage of the population. The greatest demand is for beds that sleep two people side by side where typically, one of the two is larger than the other. Mattress sizes desirably accommodate a large percentage of pairs of people (for example, a large man and a smaller woman) in the population. A large percentage of the population is between the measurements for a 97.5 percentile male Caucasian and a 2.5 percentile female Caucasian. While other ethnic body types may be larger or otherwise different in measurement, most of the size differences for different body types are manifested in the length of legs so that, for purposes of mattress sizing, the ethnic size differences of people tend not to be significant. Mattresses are desirably available as a single integrated package easily installed as part of a bed without need for many separate or custom parts that require tailoring or otherwise increase the complexity of bed distribution and assembly. The number of stock keeping units (SKU's) required for a mattress product line is desirably low so that distribution and sale is efficient. Typically, mattresses are marketable in a family of three consumer prices ranges, namely high, medium and low and it is commercially desirable to have a mattress line that is marketable in those different price ranges.

Developments in the parameters of and manufacturing capabilities for foam and other materials have provided new components for mattresses that can be used to better approach the technical parameters required for an ideal mattress at economical costs and which can be manufactured with expected "standard properties" and with the "attributes" for mattresses that are desired by the public.

In consideration of the above background, there is a need for improved mattresses that better approach the properties of ideal mattresses and that can be economically manufactured while satisfying the public expectations and demands for mattresses.

SUMMARY

The present invention is a mattress for supporting a reclining body with low body pressure and in alignment. The mattress, extends in a lateral direction from side to side and extends in a longitudinal direction from a mattress head to a mattress foot where the mattress includes a head part, a shoulder part, a waist part, a hip part and a leg part. The reclining body has a displacement profile that causes the mattress to undergo differing vertical displacements when supporting the reclining body. The mattress core has displacement parameters varying to match the displacement profile of the reclining body while supporting the reclining body with low body pressure. The core has a plurality of regions where the vertical displacement in one or more of the regions varies to match the displacement profile of the reclining body to maintain the reclining body in alignment.

In an embodiment, the core includes a plurality of foam members arrayed in layers where the foam members at different positions exhibit different displacement parameters to support the reclining body with low body pressure and exhibit different vertical displacements to maintain the reclining body in alignment.

In an embodiment, the core includes a foam member having structural modification where the foam member at different longitudinal positions exhibits different displacement parameters to support the reclining body with low body pressure and exhibits different vertical displacements to maintain the reclining body in alignment.

In an embodiment, the core includes an adjustable lift for adjusting vertical displacement.

In an embodiment, the core includes one or more foam members and includes a tension relief slot for avoiding tension forces in the one or more foam members as a result of displacement caused by the reclining body.

In an embodiment where the core includes one or more foam members and one or more tension relief slots the core is within a cover that includes an opening on a top side of the mattress revealing the tension relief slot.

In an embodiment, the core includes one or more foam members and a spring supporting the foam members.

The foregoing and other objects, features and advantages of the invention will be apparent from the following detailed description in conjunction with the drawings.

Figure 13:
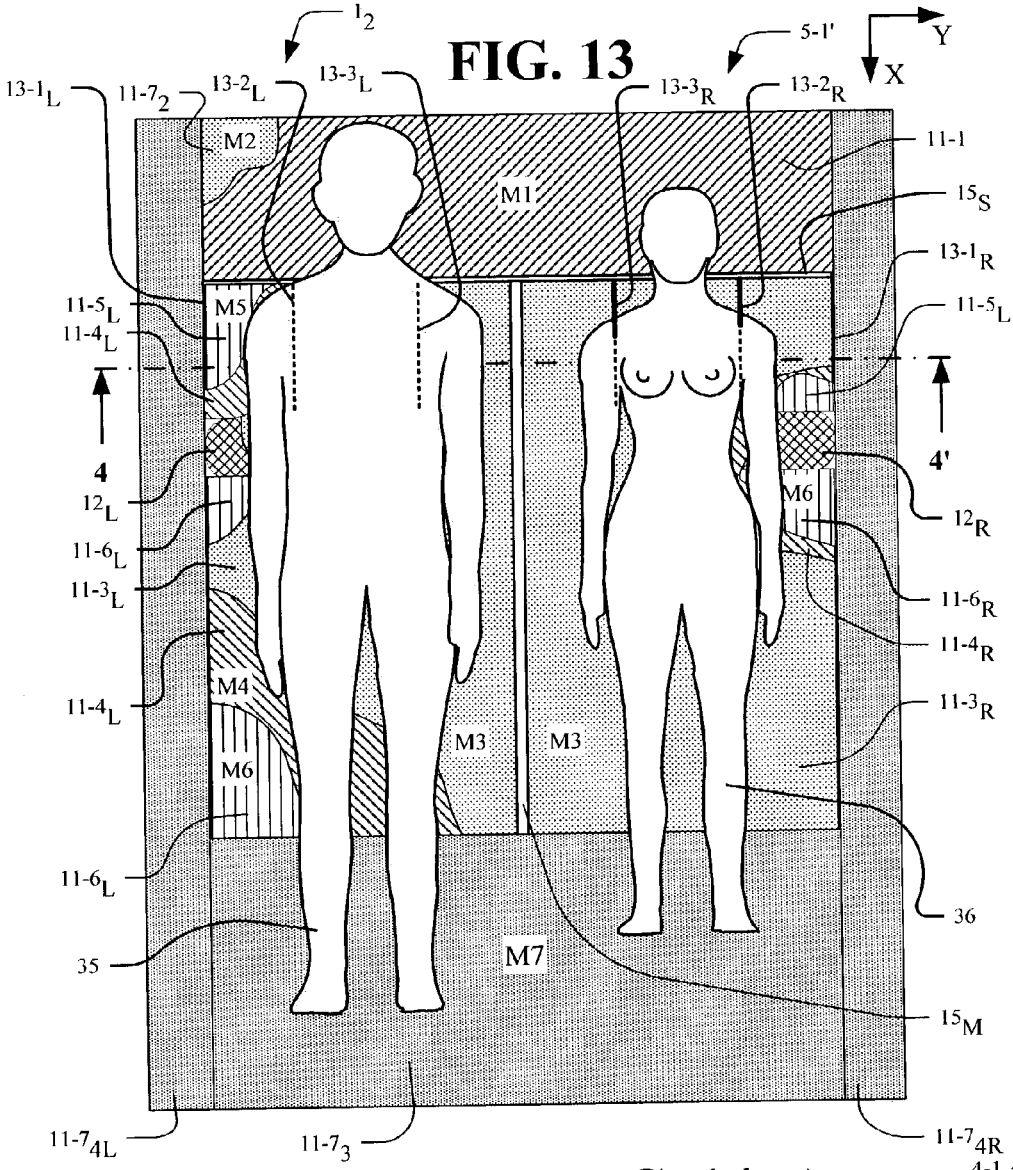
FIG. 13 depicts a top view of one embodiment of the mattress core of FIG. 2 with a Caucasian female, with 2.5 percentile body dimensions, on her back on the right and a Caucasian male, with 97.5 percentile body dimensions, on his back on the left.
Figure 14:
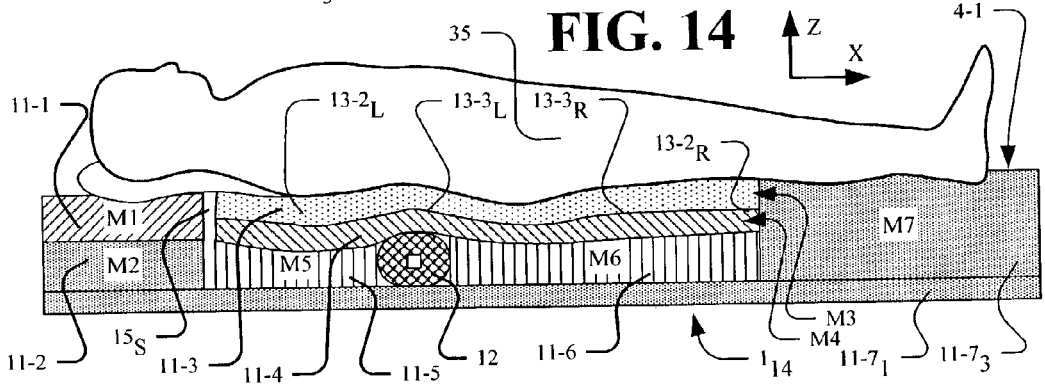

FIG. 14 depicts a side view of the mattress core of FIG. 13 tuned for a Caucasian male body, having 97.5 percentile body dimensions, reclining on his back.

Figure 2:
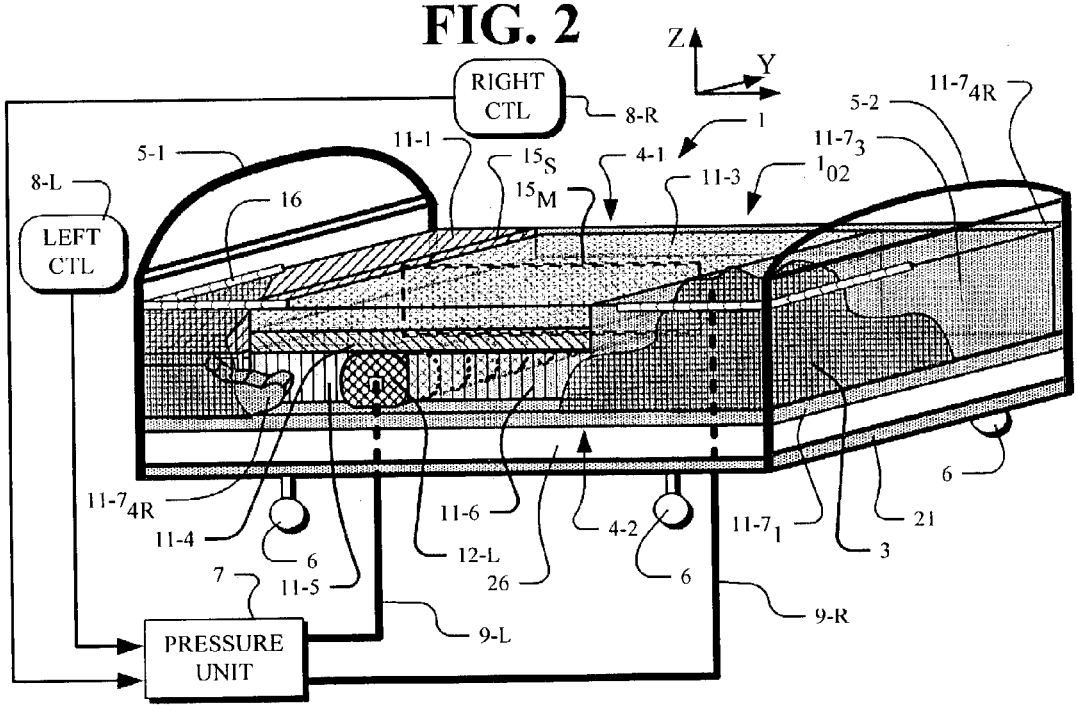
FIG. 2 depicts an isometric view of a mattress having a dynamic air-inflated adjusting member for tuning the mattress for body alignment and low contact pressure.
Figure 15:
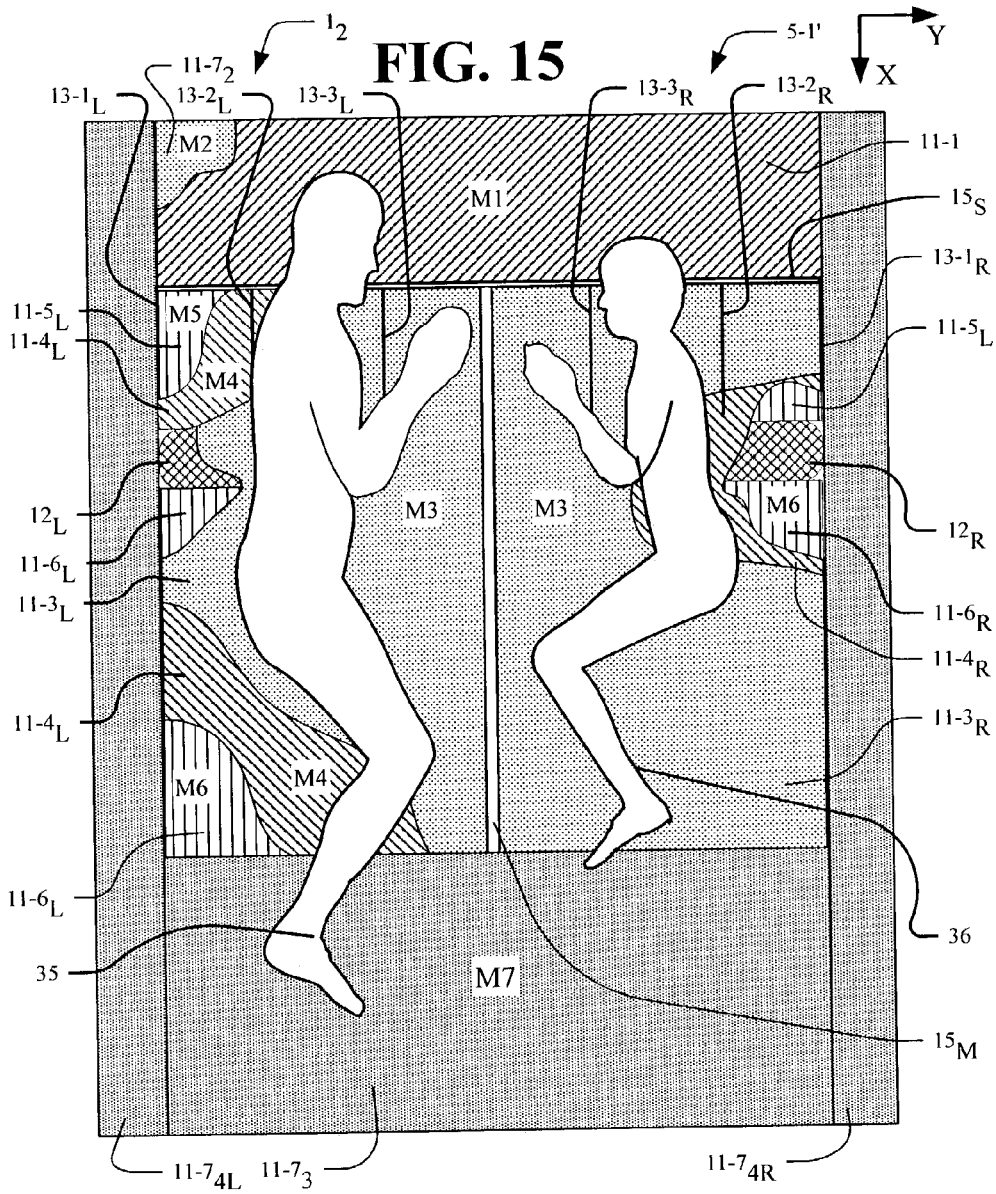

FIG. 15 depicts a top view of one embodiment of the mattress core of FIG. 2 with a Caucasian female, with 2.5 percentile body dimensions, on her side on the right and a Caucasian male, with 97.5 percentile body dimensions, on his side on the left.

Figure 16:
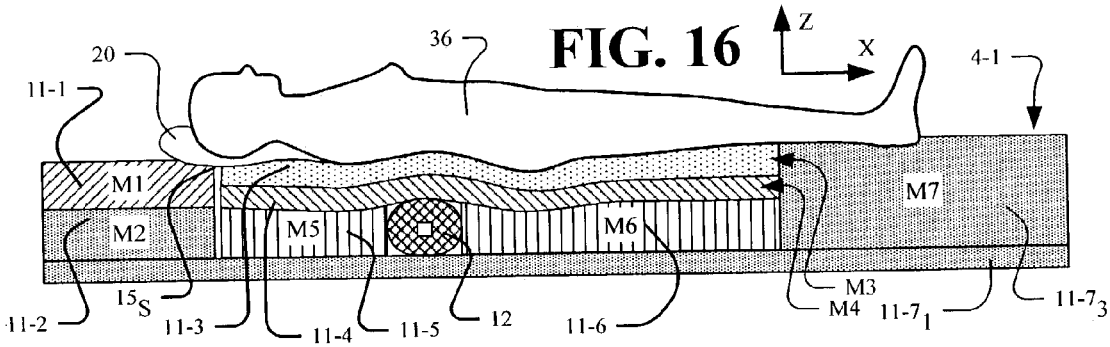

FIG. 16 depicts a side view of the mattress core of FIG. 15 tuned for a Caucasian male body 35, having 97.5 percentile body dimensions, reclining on his back.

Figure 5:
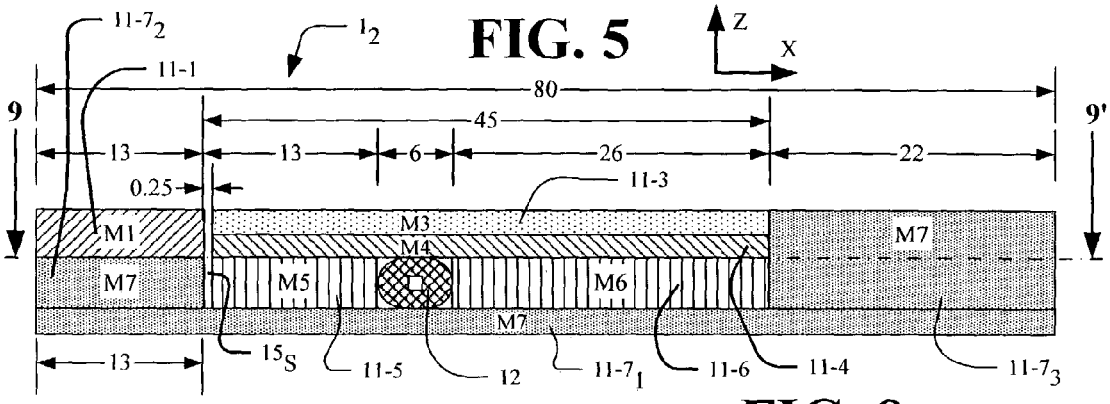
FIG. 5 depicts a side view of the mattress core of FIG. 3.
Figure 17:
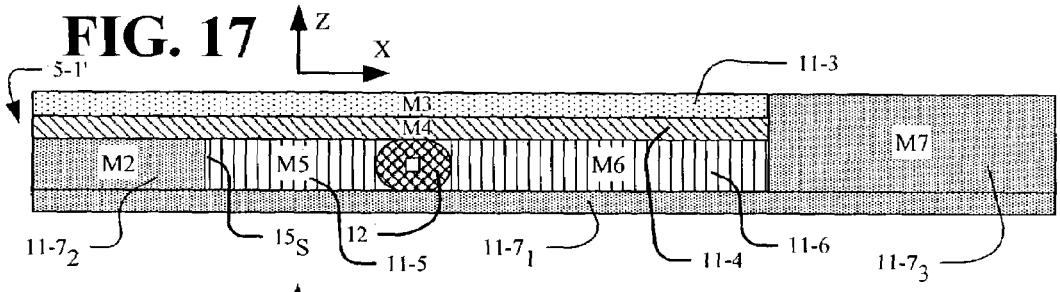

FIG. 17 depicts a side view of an alternate embodiment of the FIG. 5 mattress core.

Figure 18:
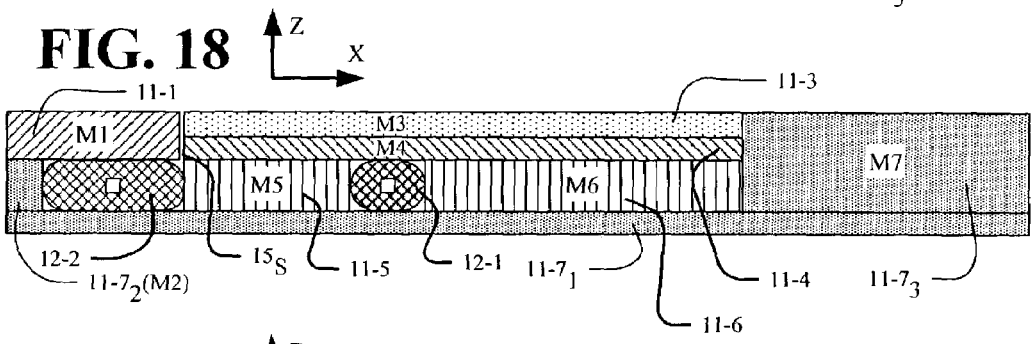

FIG. 18 depicts a side view of an alternate embodiment of the FIG. 5 mattress core.

Figure 19:
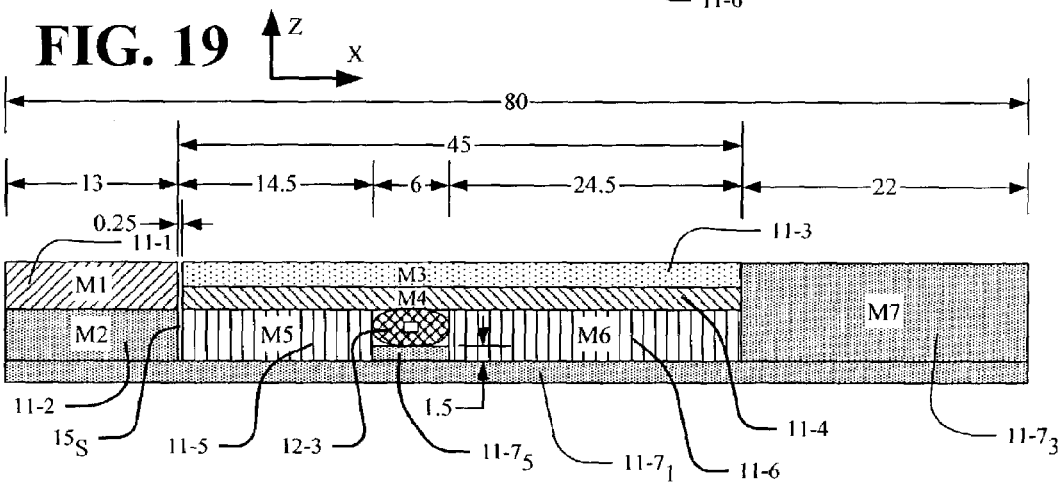

FIG. 19 depicts a side view of an alternate embodiment of the FIG. 5 mattress core.

Figure 20:
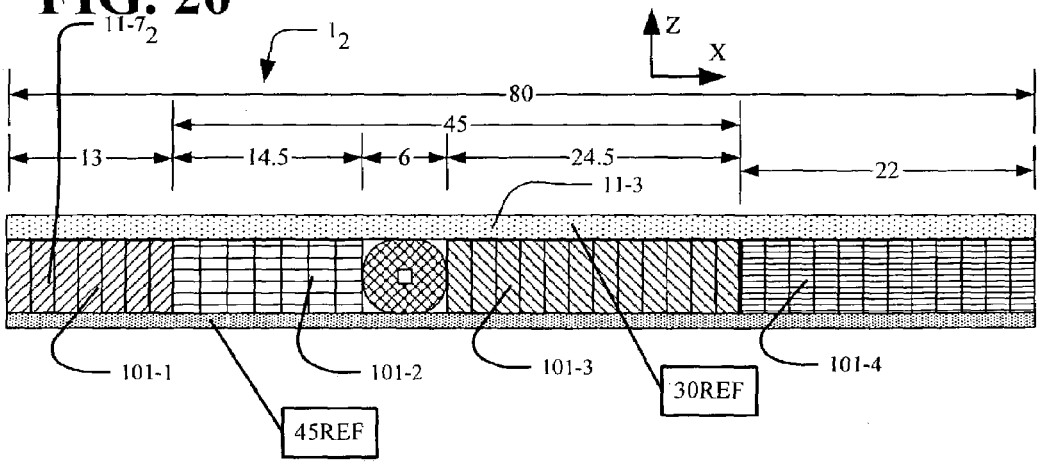

FIG. 20 depicts a side view of an alternate embodiment of the FIG. 5 mattress core.

Figure 11:
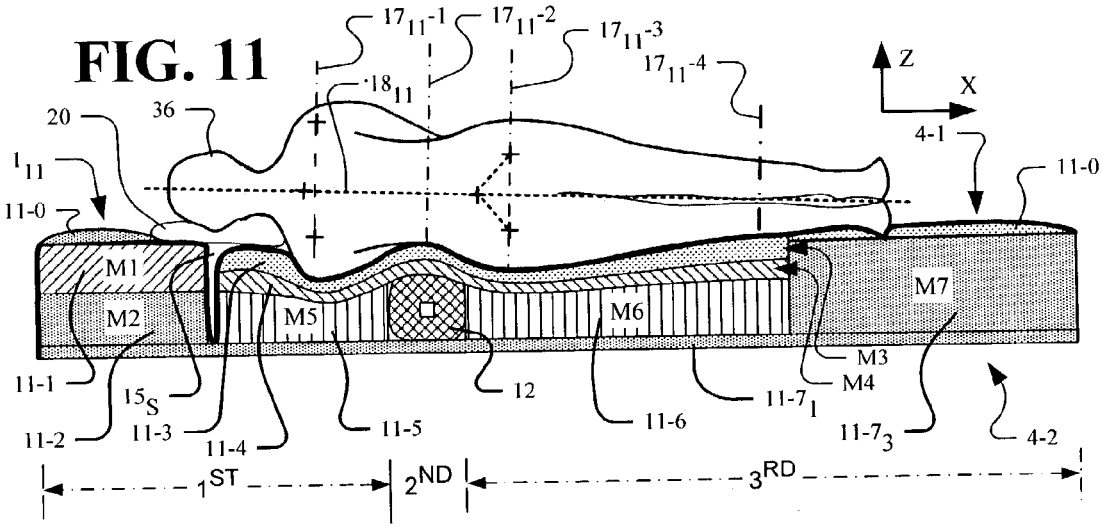
FIG. 11 depicts a side view of a mattress tuned for a Caucasian female body having 2.5 percentile body dimensions and reclining on her side.

FIG. 21 depicts a vertical displacement in the Z-axis direction along the length of a mattress in the X-axis direction of the side-lying female of FIG. 11.

Figure 12:
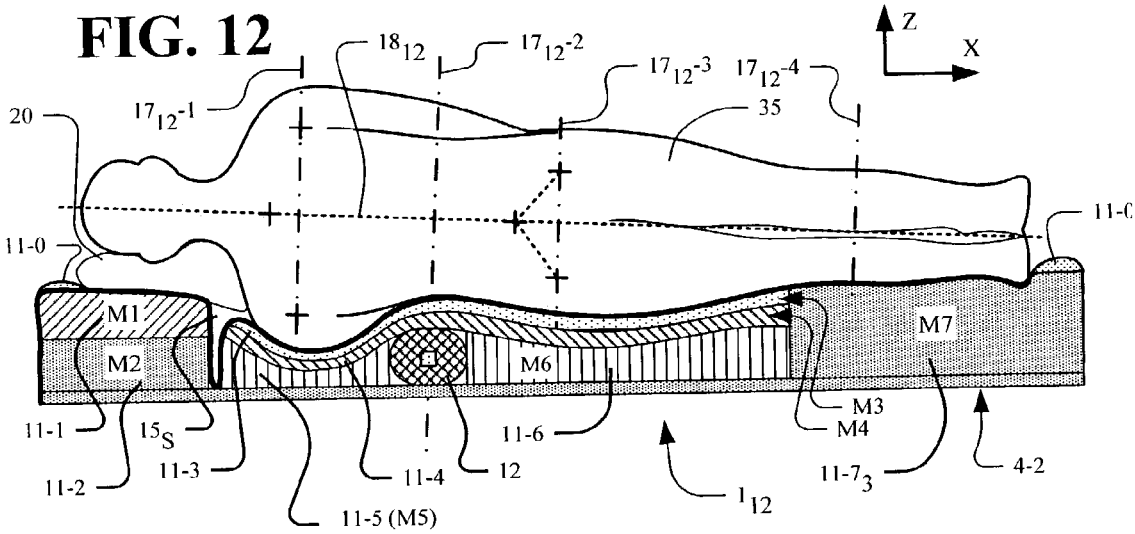
FIG. 12 depicts a side view of the mattress of FIG. 2 tuned for a Caucasian male of a 97.5 percentile body dimensions reclining on his side.

FIG. 22 depicts a vertical displacement in the Z-axis direction along the length of a mattress in the X-axis direction for the male on the mattress of FIG. 12.

FIG. 23 depicts a vertical displacement of mattress foam material in the Z-axis direction along the length in the X-axis direction and along the width in the Y-axis direction.

FIG. 24 depicts a vertical displacement of mattress foam material in the Z-axis direction along the length in the X-axis direction for two layers of foam having the same resistance to vertical displacement.

FIG. 25 depicts a vertical displacement of mattress foam material in the Z-axis direction along the length in the X-axis direction for two layers of foam where the top layer has a lower resistance to vertical displacement than the resistance to vertical displacement of the bottom layer.

FIG. 26 depicts a vertical displacement of mattress foam material in the Z-axis direction along the length in the X-axis direction for two layers of foam where the top layer has a higher resistance to vertical displacement than the resistance to vertical displacement of the bottom layer.

Figure 27:
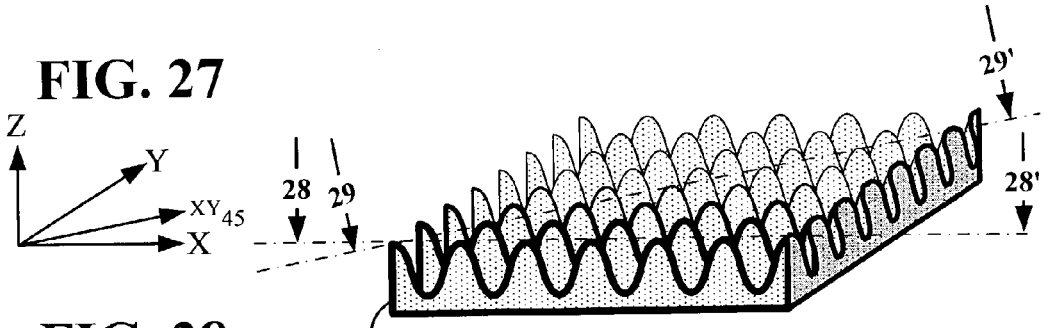

FIG. 27 depicts an isometric view of a convolute material which is used in one embodiment of a mattress core.

Figure 28:
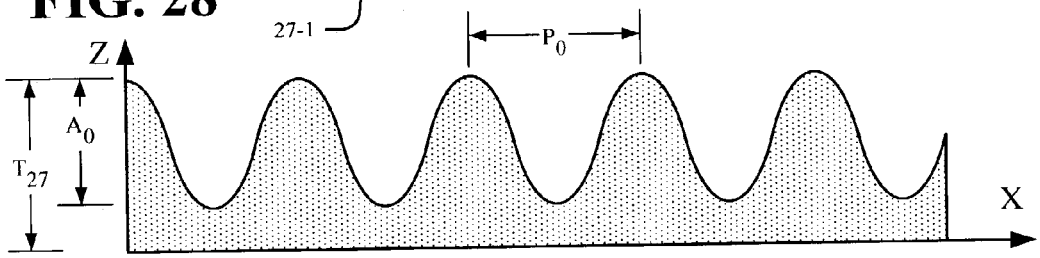

FIG. 28 depicts the sinusoidal patterns in the X-axis and Y-axis directions of the convolute material of FIG. 27.

Figure 29:
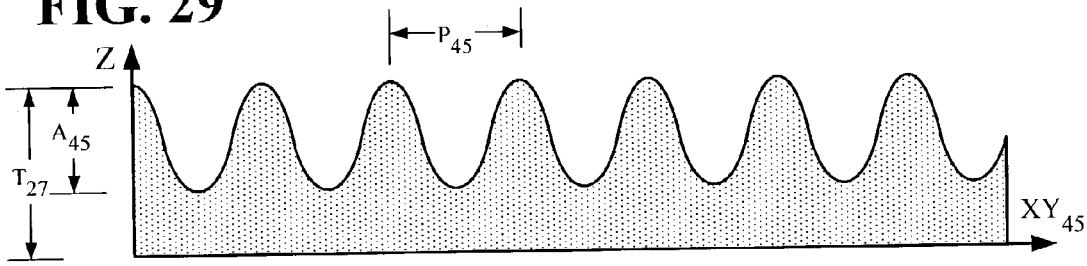

FIG. 29 depicts the sinusoidal patterns in the $X_{45}$-axis direction of the convolute material of FIG. 27.

Figure 30:
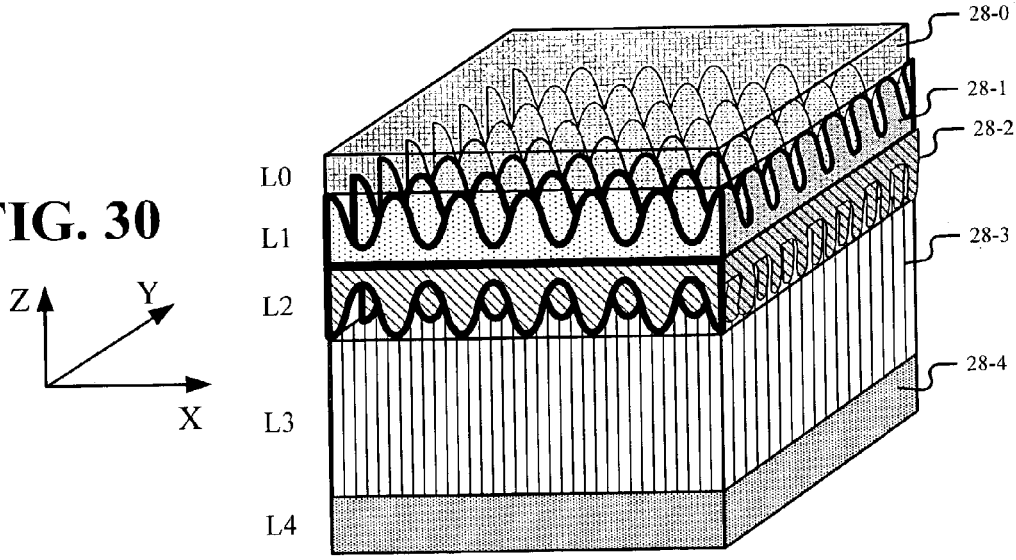

FIG. 30 depicts a stack of layers formed of foam members which have different compression parameters.

FIG. 31 depicts compression parameters as a function of displacement for the stack of layers of FIG. 29.

FIG. 32 depicts a foam layer that is structurally modified with holes.

FIG. 33 depicts a section view taken along section line 33–33' of FIG. 32 showing the holes extending through the layer.

FIG. 34 depicts a foam layer that is structurally modified with slits.

FIG. 35 depicts a section view taken along section line 35–35' of FIG. 34 showing the slits extending through the layer.

Figure 36:
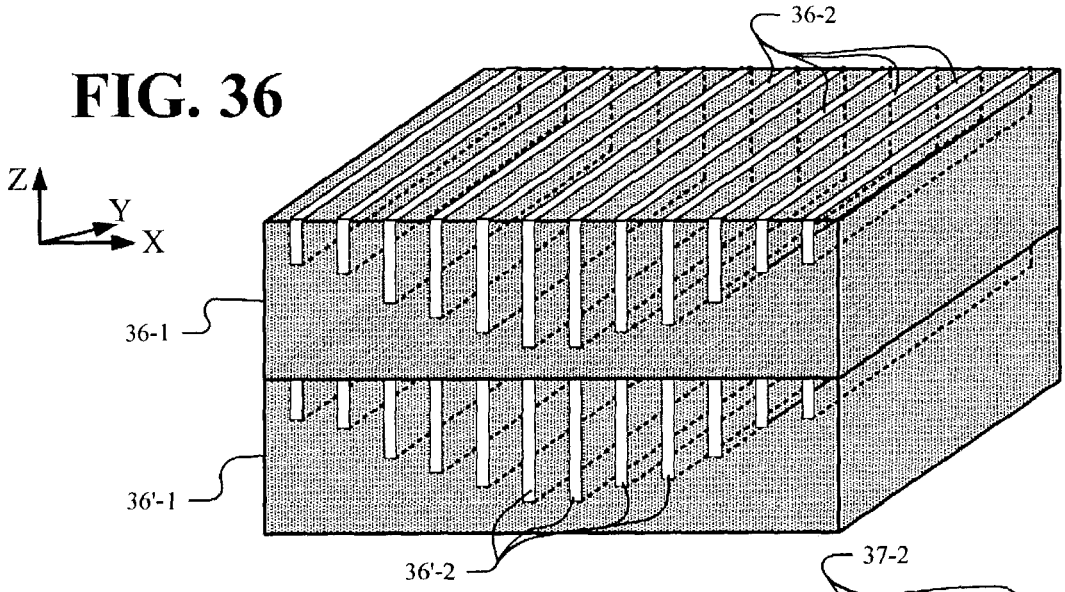

FIG. 36 depicts a two-layer stack of foam layers that are structurally modified with slots.

Figure 37:
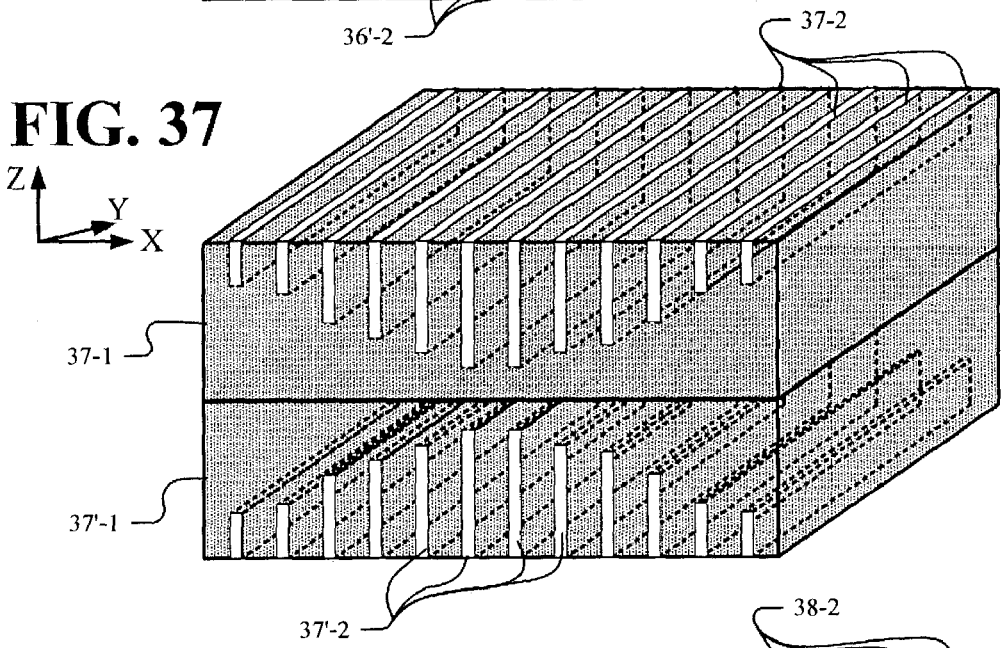

FIG. 37 depicts a two-layer stack of foam layers that are structurally modified with slots where the bottom layer is inverted relative to the top.

Figure 38:
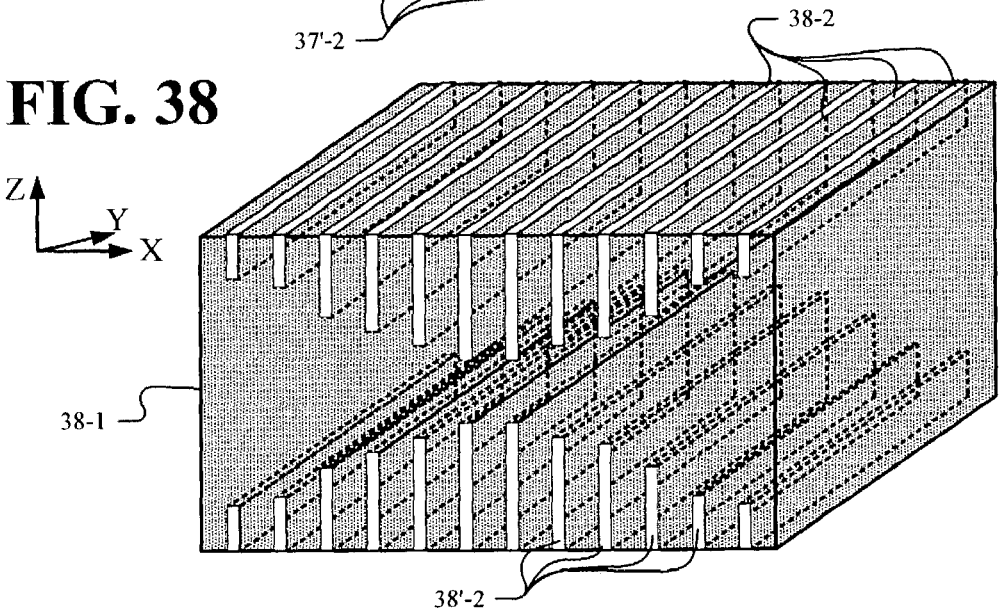

FIG. 38 depicts a single layer that is structurally modified with slots like in FIG. 37 where the bottom portion is inverted relative to the top portion.

Figure 39:
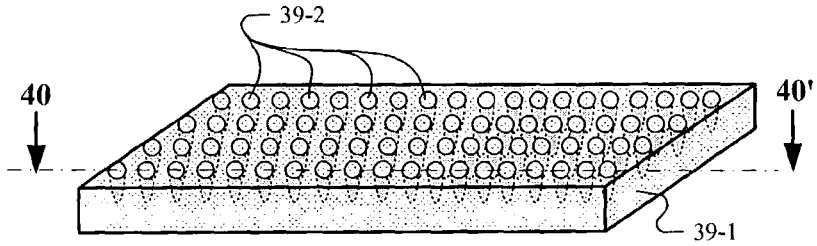

FIG. 39 depicts a foam layer structurally modified with cone-shaped holes.

Figure 40:
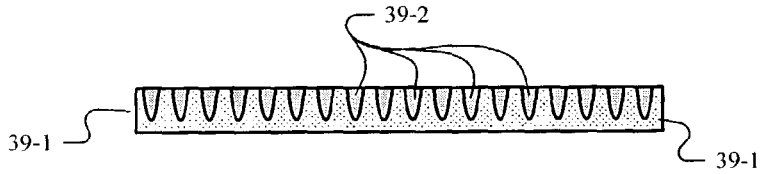

FIG. 40 depicts a section view of a row of holes taken along section line 40–40' of FIG. 39.

Figure 41:
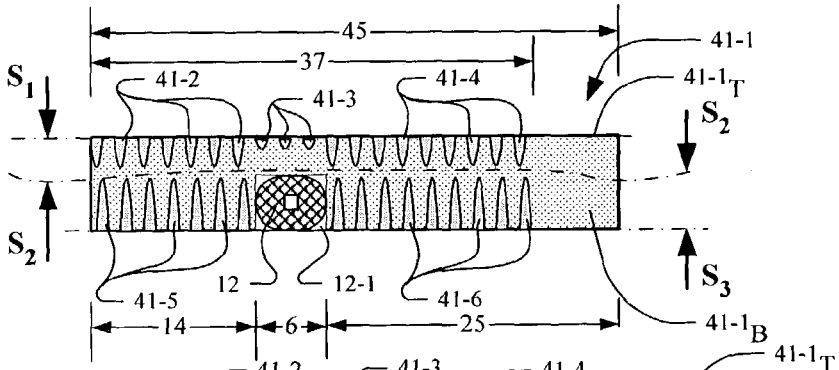

FIG. 41 depicts a front view of a foam layer that is structurally modified from the top surface with cone-shaped holes in a top portion and from the bottom surface with cone-shaped holes with a cavity for a lift between holes in a bottom portion.

Figure 42:
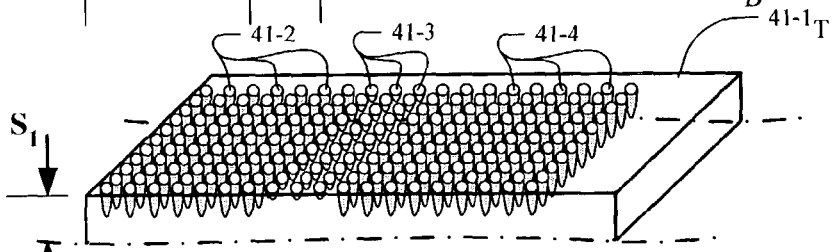

FIG. 42 depicts an isometric view of the top portion of the foam layer of FIG. 41.

Figure 43:
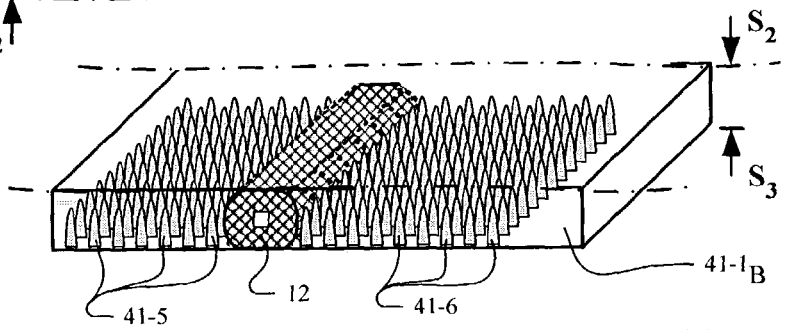

FIG. 43 depicts an isometric view of the bottom portion of the foam layer of FIG. 41.

Figure 44:
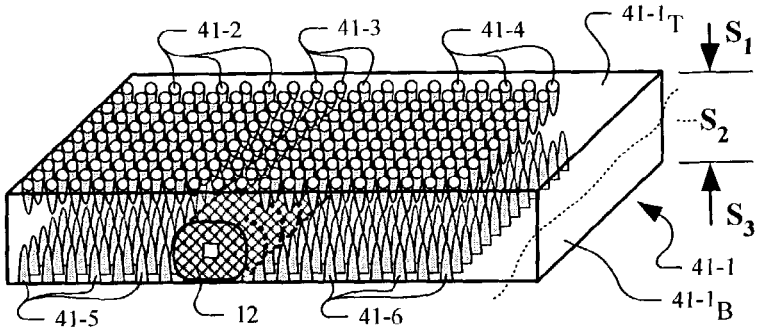

FIG. 44 depicts an isometric view of the foam layer of FIG. 41.

Figure 45:
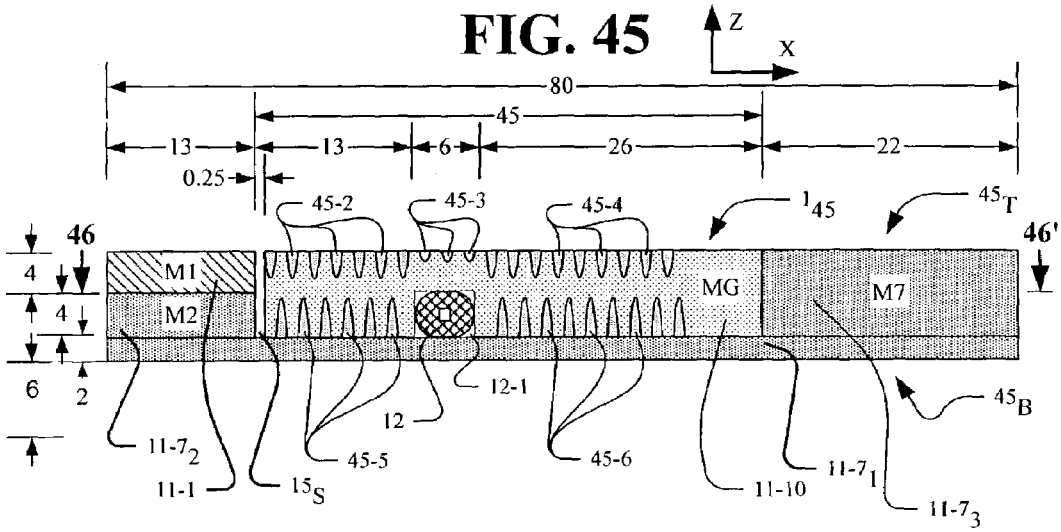

FIG. 45 depicts a side view of a mattress using the central core section of FIG. 41 for a Caucasian male of a 97.5 percentile body dimensions reclining on his side.

Figure 46:
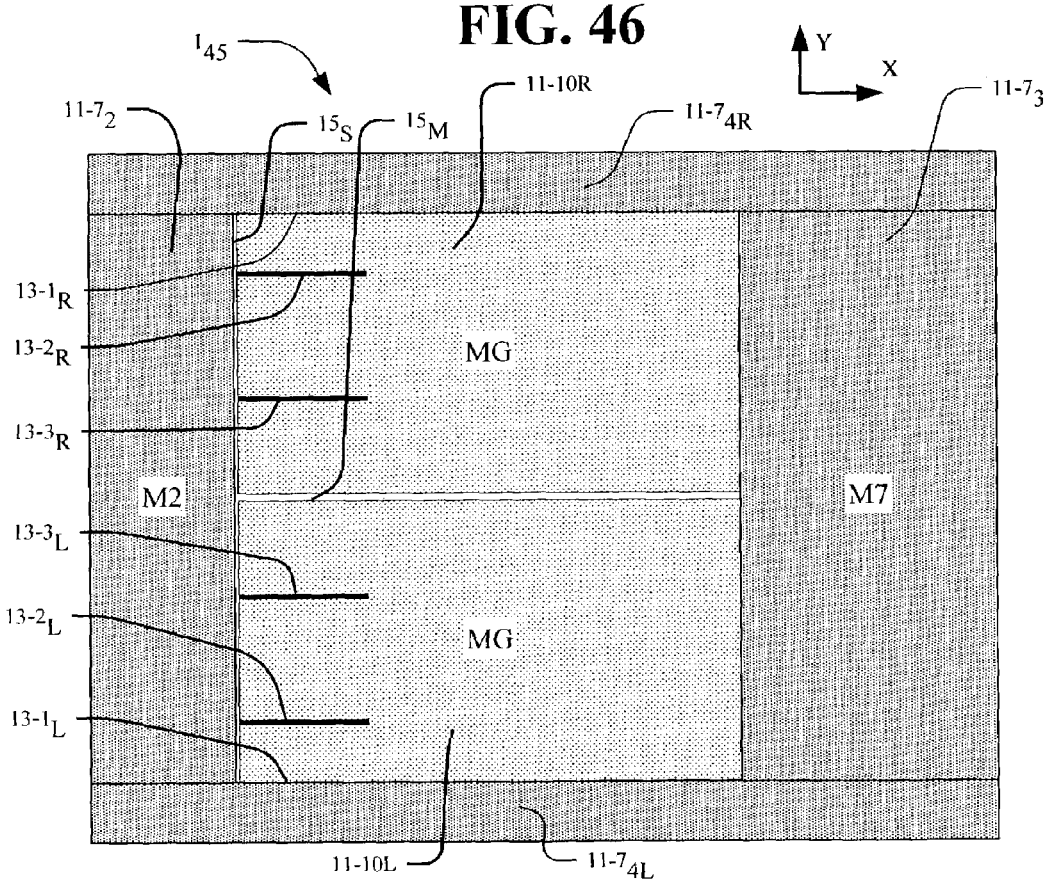

FIG. 46 depicts a top view of the mattress core of FIG. 45 taken along the section line 46–46' of FIG. 45.

Figure 47:
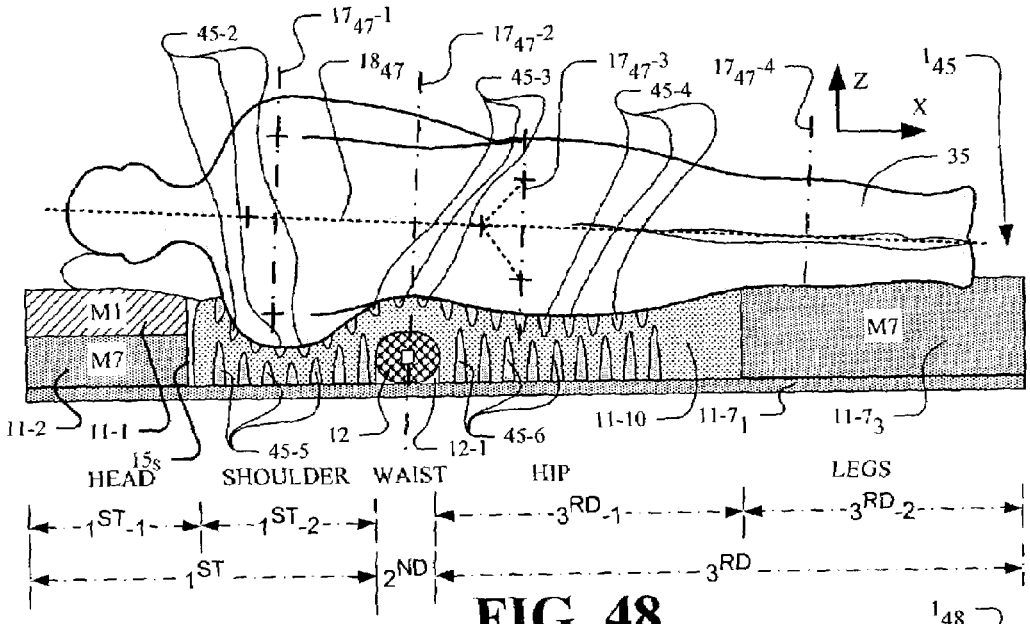

FIG. 47 depicts a side view of a mattress core of FIG. 45 and FIG. 46 with a male body 35 reclining on his side.

Figure 48:
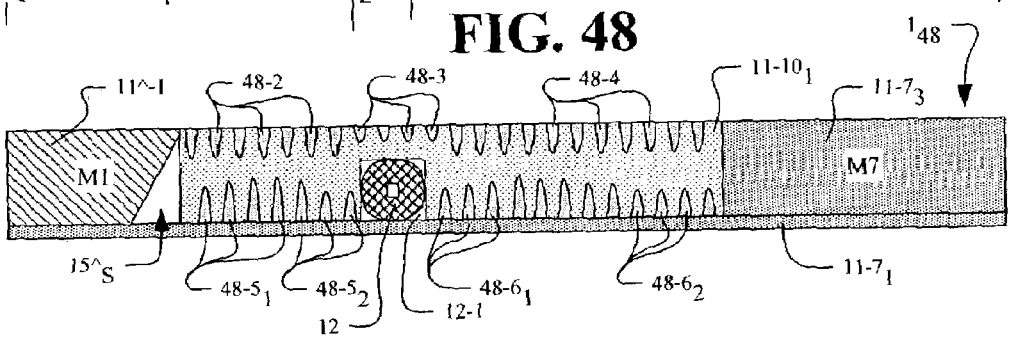

FIG. 48 depicts a front view of a mattress core that is an alternate embodiment of the mattress core of FIG. 47.

Figure 49:
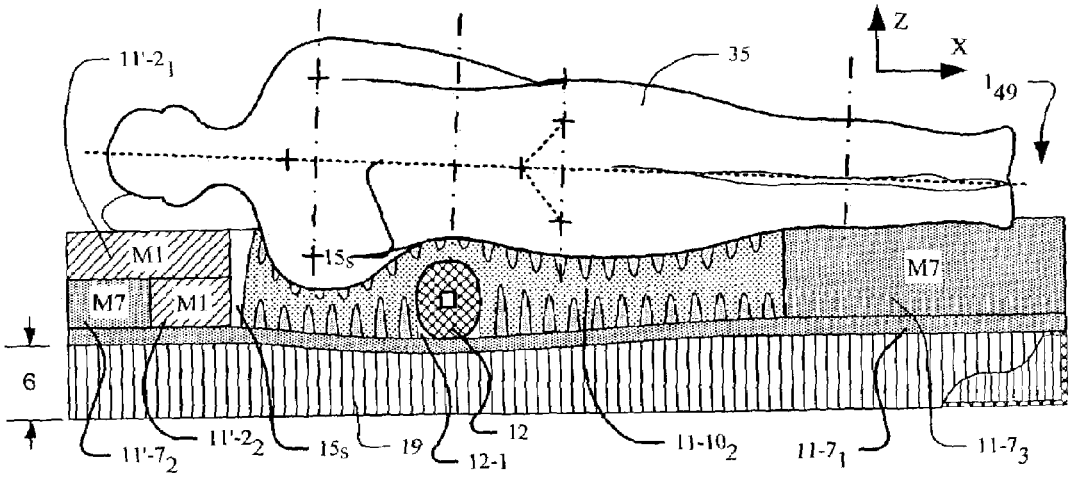

FIG. 49 depicts a side view of an alternate embodiment of the mattress core of FIG. 45, FIG. 46 and FIG. 47 with a male body 35 reclining on his side.

Figure 50:
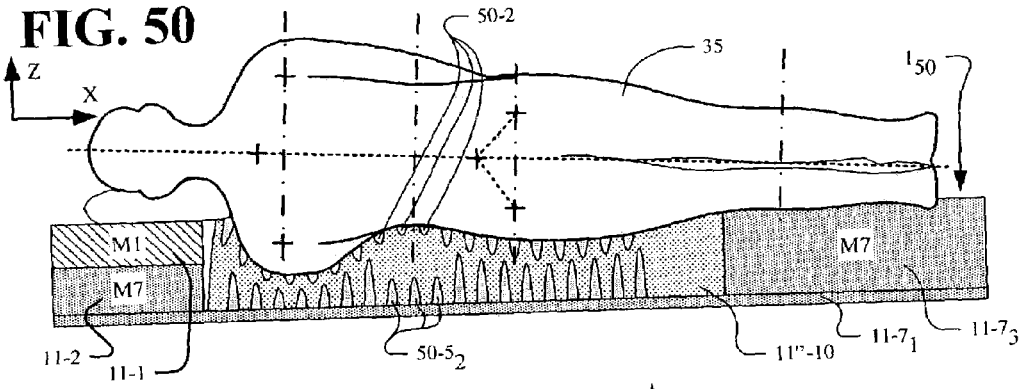

FIG. 50 depicts a side view of an alternate embodiment of the mattress core of FIG. 47 with a male body 35 reclining on his side.

Figure 51:
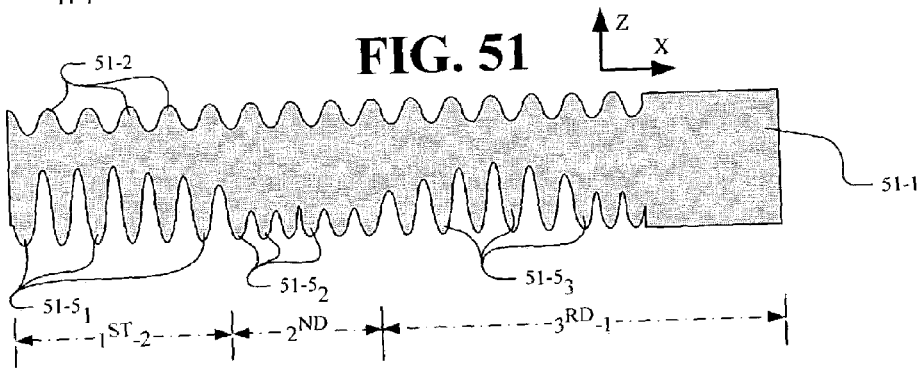

FIG. 51 depicts a side view of a mattress core member formed of a single layer of foam with top and bottom structural modification.

Figure 52:
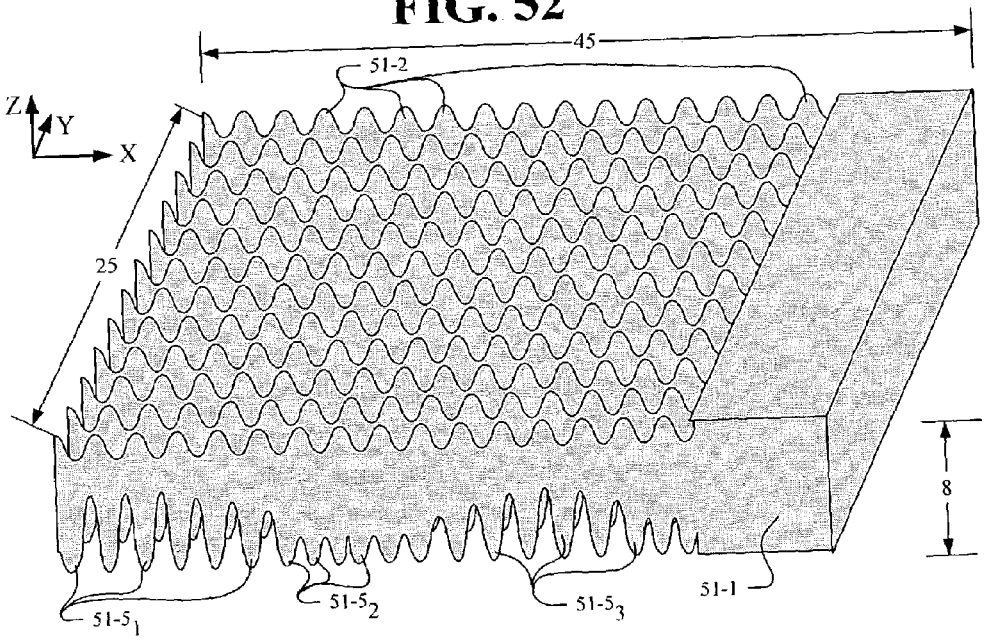

FIG. 52 depicts an isometric view of the mattress core member of FIG. 51.

Figure 53:
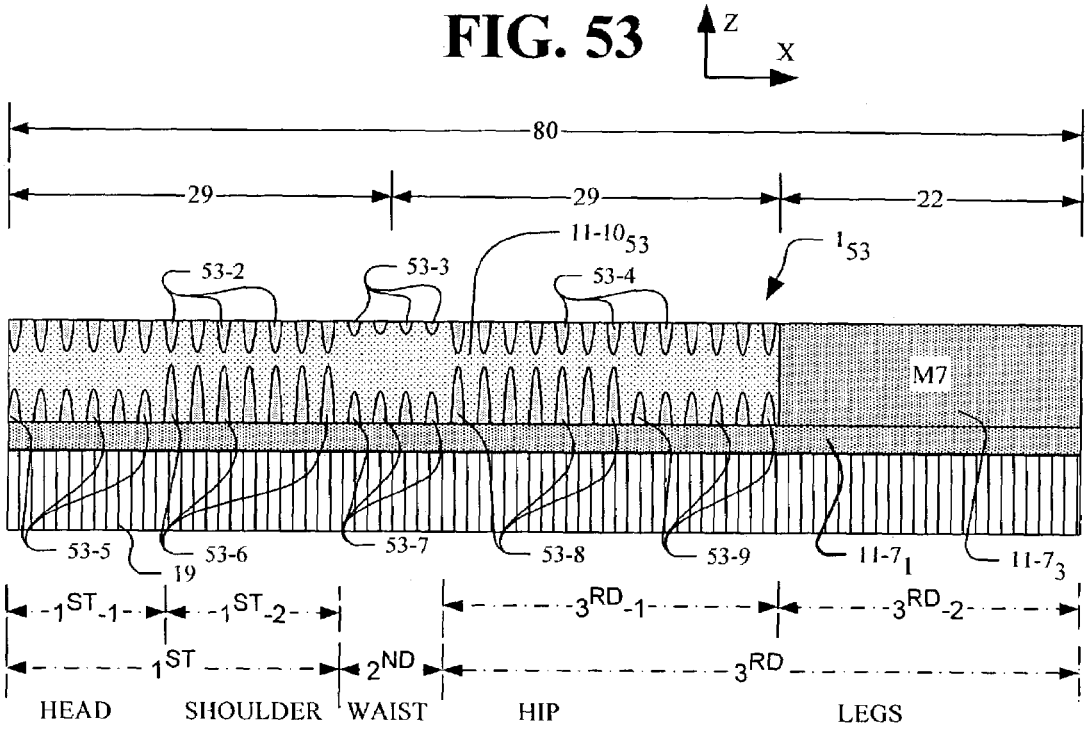

In FIG. 53, a front view of a mattress core is shown that is an alternate embodiment of the mattress core of FIG. 50.

Figure 54:
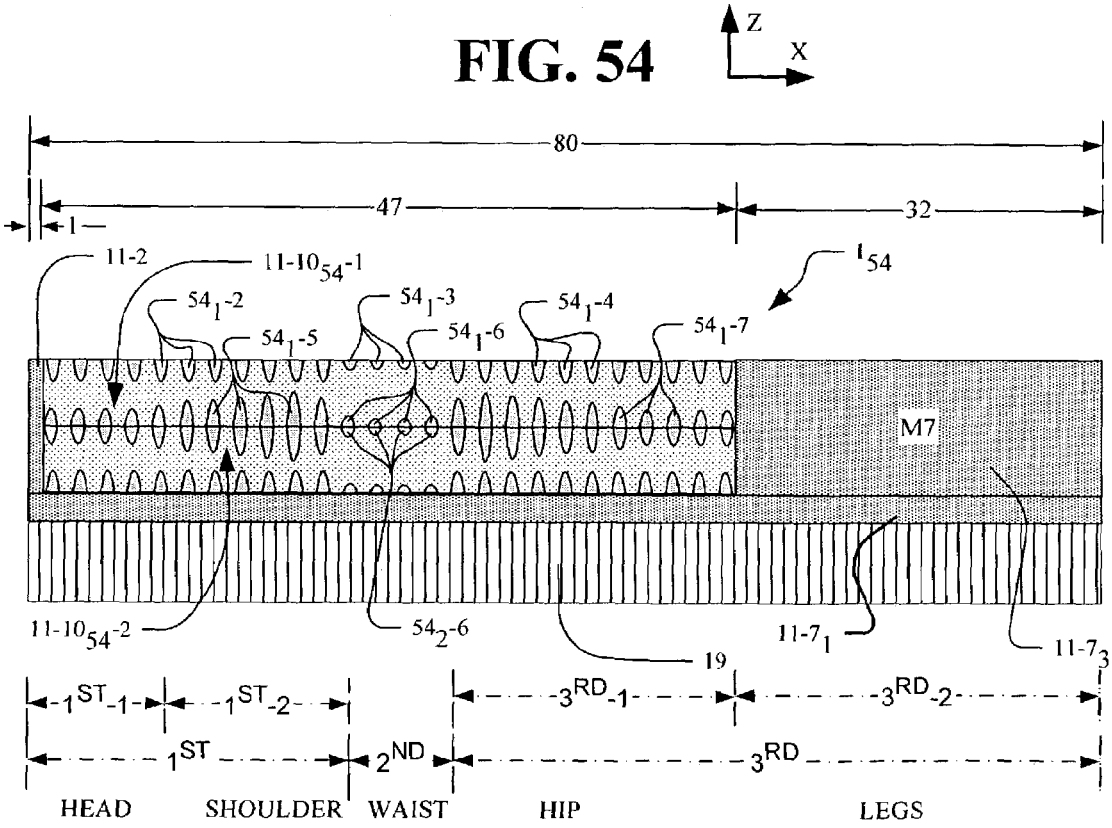

In FIG. 54, a front view of a mattress core is shown that is an alternate embodiment of the mattress core of FIG. 53.

Figure 55:
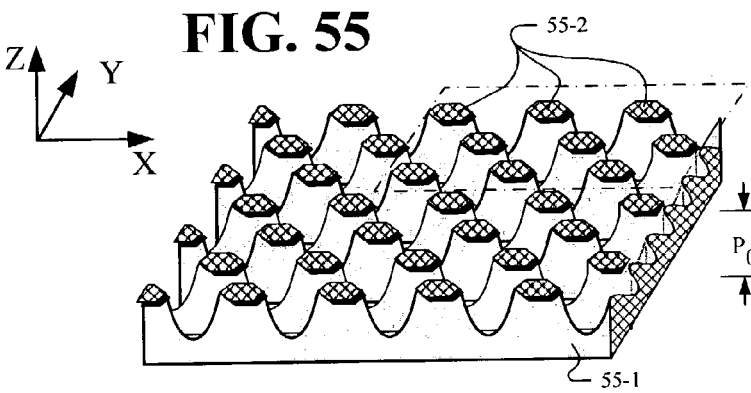

FIG. 55 depicts an isometric view of a hexagonal material which is used in embodiments of a mattress core.

Figure 56:
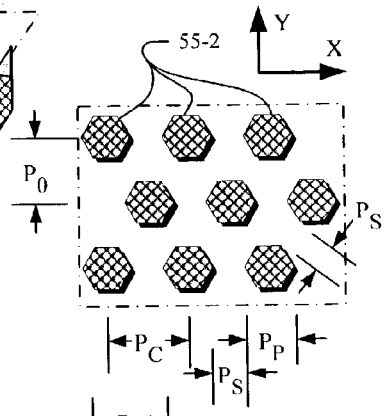

FIG. 56 depicts a top view of the hexagonal material of FIG. 55.

Figure 57:
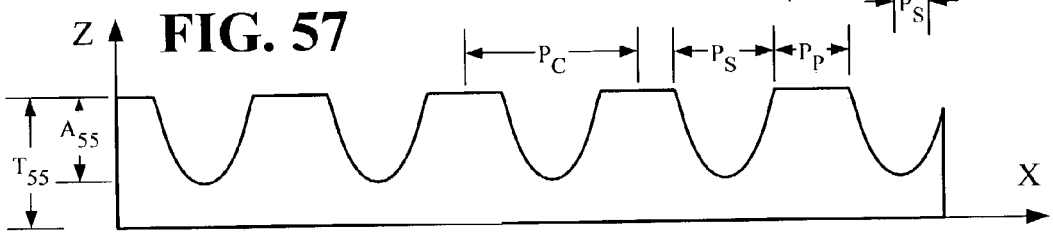

FIG. 57 depicts a sectional view through a row of peaks in the X-axis or Y-axis direction of the hexagonal material of FIG. 55.

Figure 58:
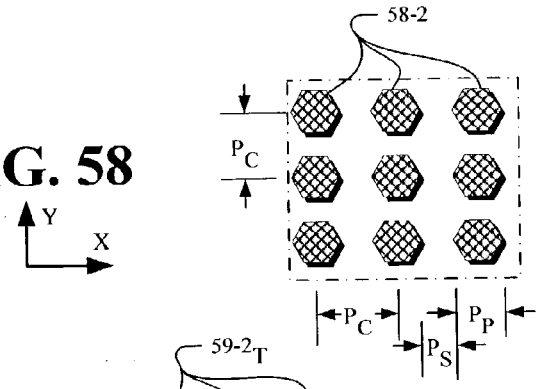

FIG. 58 depicts a top view of a section of the hexagonal material 55-1 of FIG. 55 which is an alternate layout to the pattern of FIG. 56.

Figure 59:
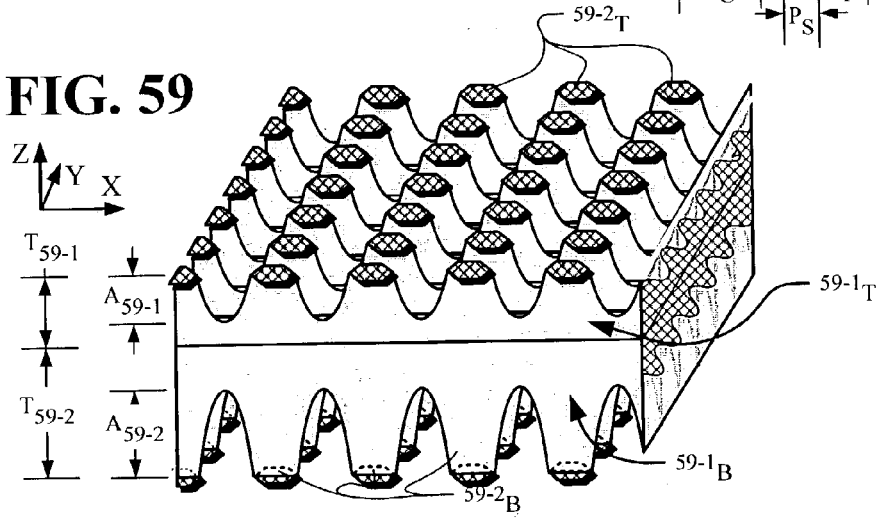

FIG. 59 depicts an isometric view of a dual layer hexagonal material similar to that of FIG. 55 but employing the aligned pattern of FIG. 58.

Figure 60:
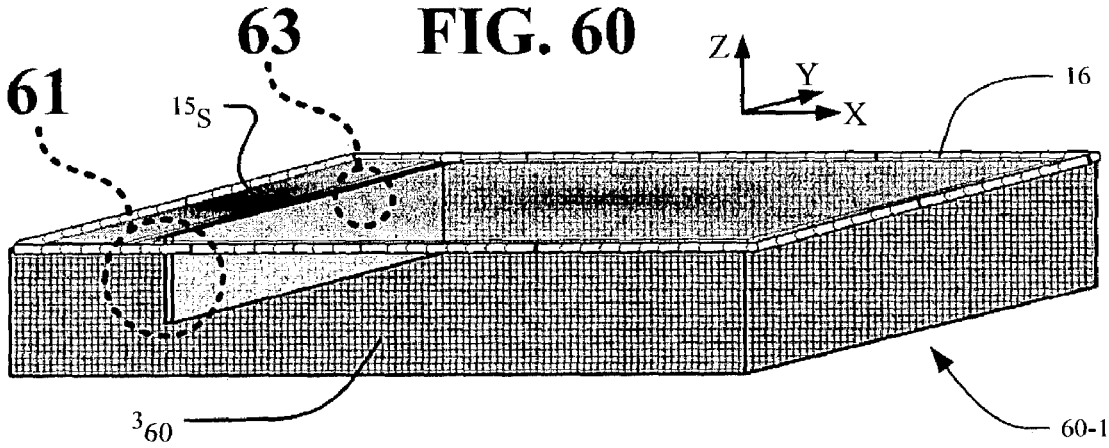

FIG. 60 depicts a mattress having a mattress cover including a lateral (Y axis) slot that extends down into the mattress core forming an opening in the cover.

Figure 61:
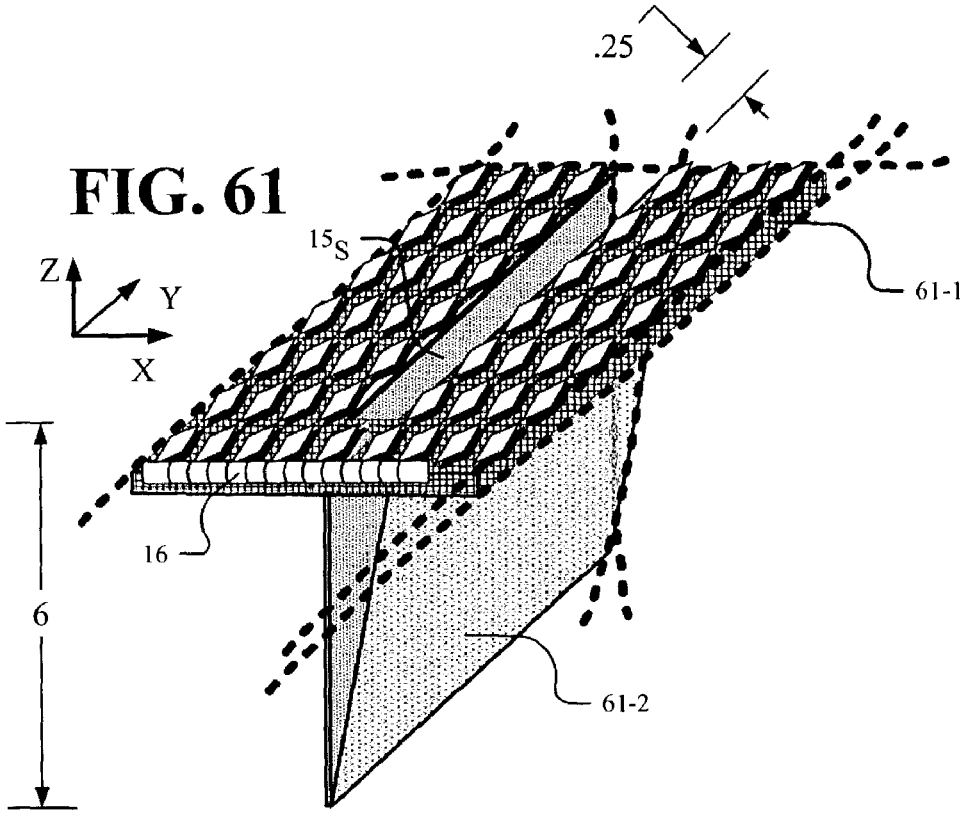

FIG. 61 depicts details of the slot structure in the region of the highlight circle of FIG. 60.

Figure 62:
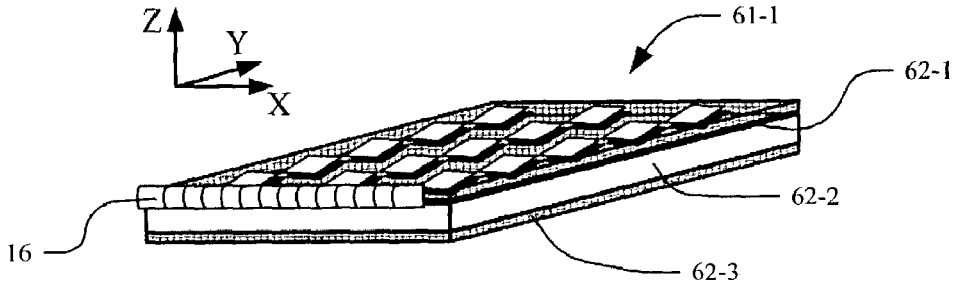

FIG. 62 depicts details of the quilted fabric of the mattress cover of FIG. 60 and FIG. 61.

Figure 63:
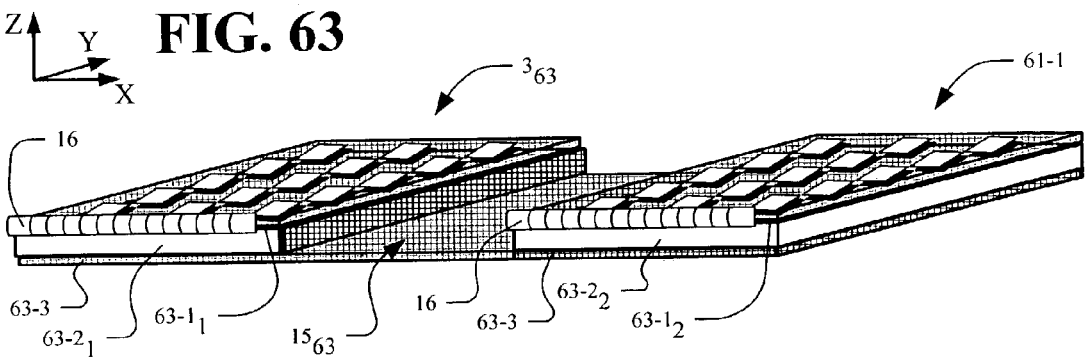

FIG. 63 depicts details of an alternative slot structure in the region of the highlight circle of FIG. 60.

Figure 64:
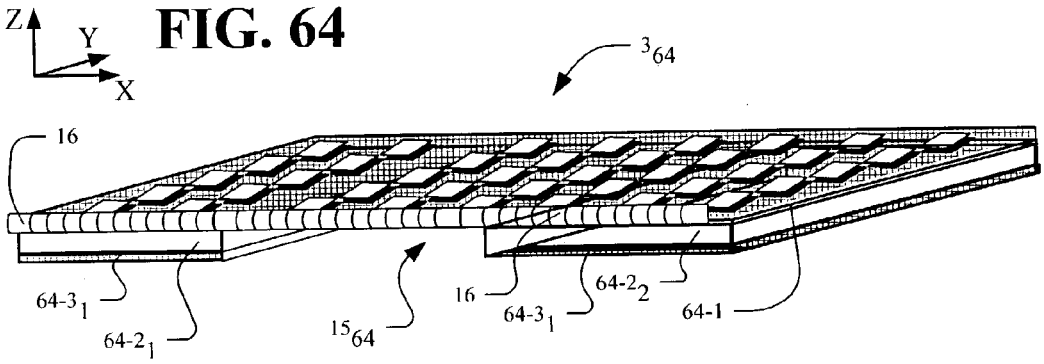

FIG. 64 depicts details of another alternative slot structure in the region of the highlight circle of FIG. 60.

Figure 65:
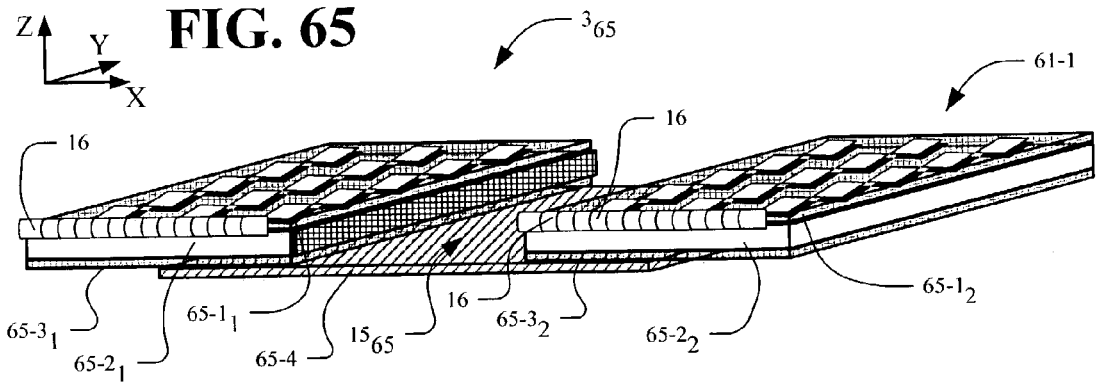

FIG. 65 depicts details of still another an alternative slot structure in the region of the highlight circle of FIG. 60.

Figure 66:
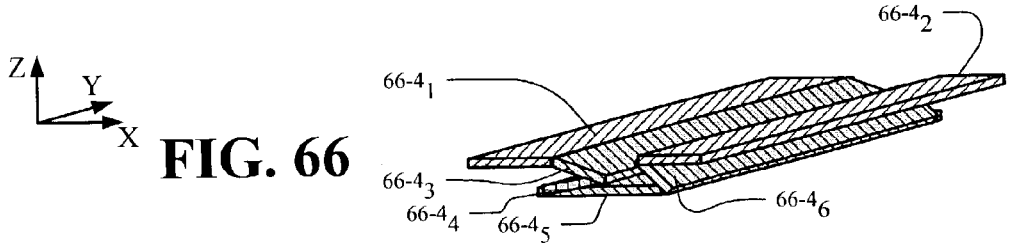

FIG. 66 depicts details of a folded fabric for use in the slot structure in the region of the highlight circle of FIG. 60.

Figure 67:
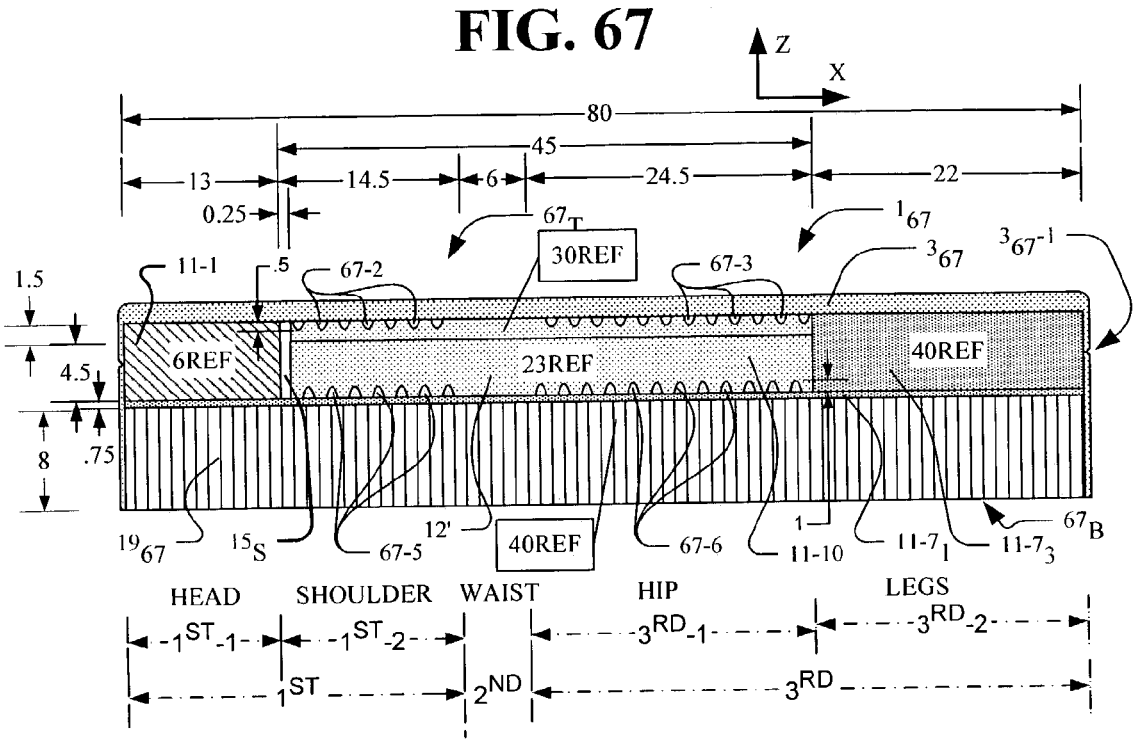

FIG. 67 depicts a side view of a mattress using a central core section including two layers of structurally modified foam.

Figure 68:
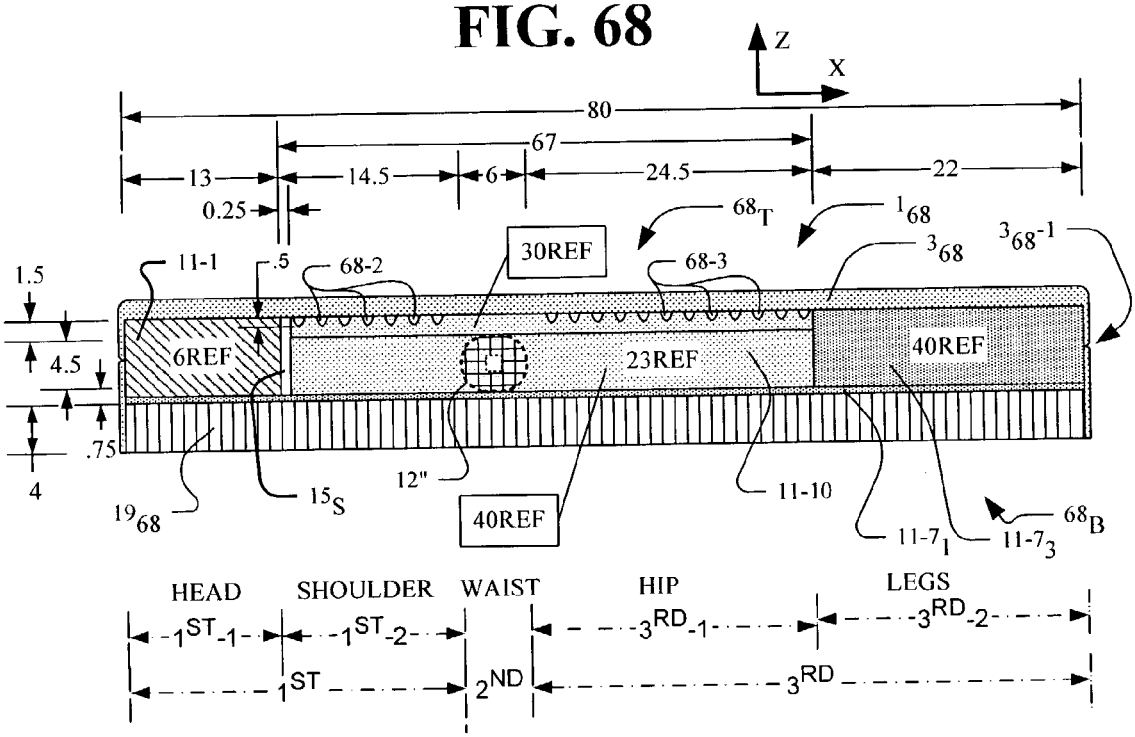

FIG. 68 depicts a side view of a mattress using a central core section including one layer of structurally modified foam over another layer of foam with lower ILD.

Figure 69:
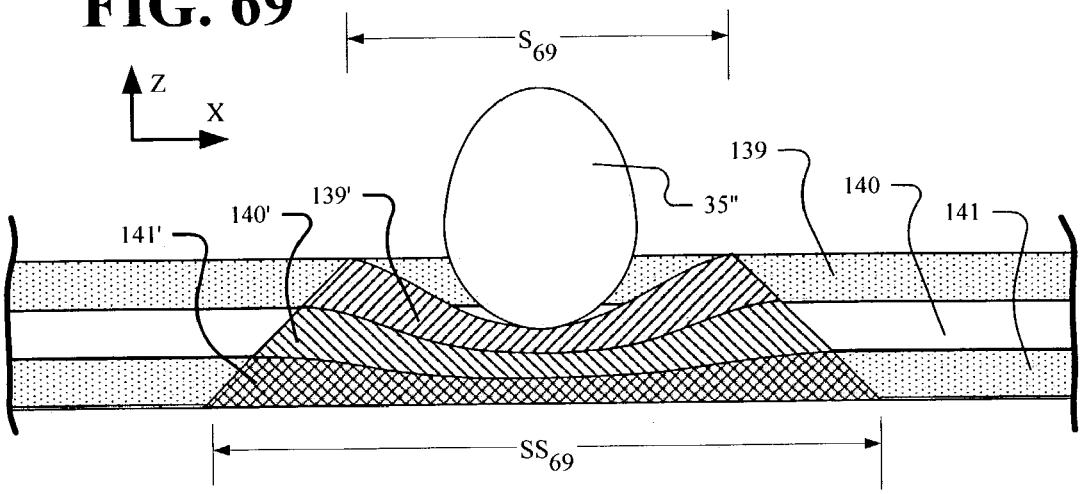

FIG. 69 depicts the dynamics of a shoulder element supported by a three-layer structure having three equal-height layers with varying ILD's in the arrangement of most firm, intermediate firm and least firm.

Figure 70:
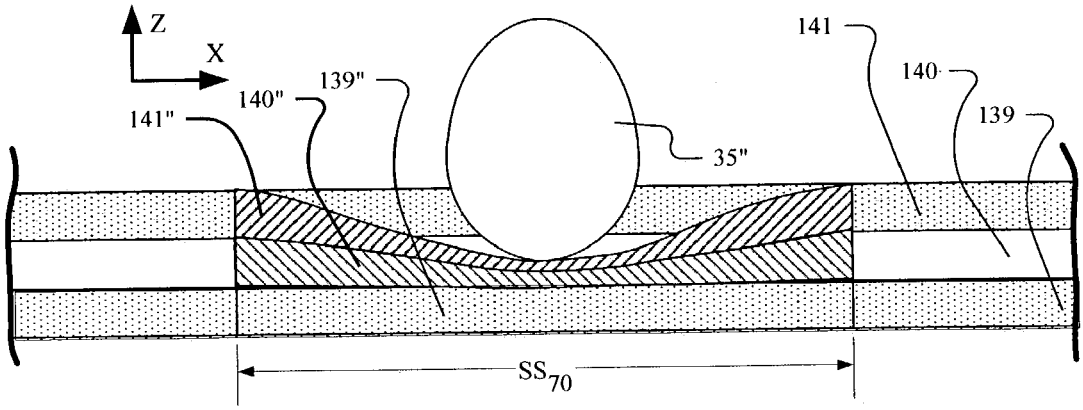

FIG. 70 depicts the dynamics of a shoulder element supported by a three-layer structure having three equal-height layers with varying ILD's in the arrangement of least firm, intermediate firm and most firm.

Figure 71:
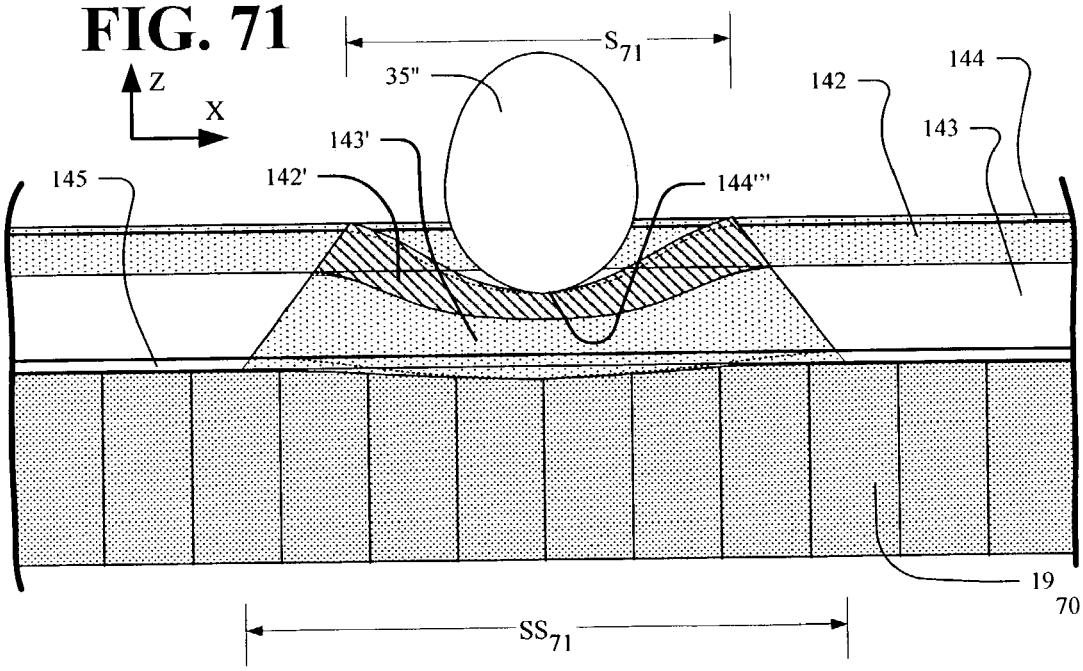

FIG. 71 depicts the dynamics of a shoulder element supported by a two-layer structure having unequal-height layers with varying ILD's in the arrangement of most firm over least firm.

DETAILED DESCRIPTION

Figure 1:
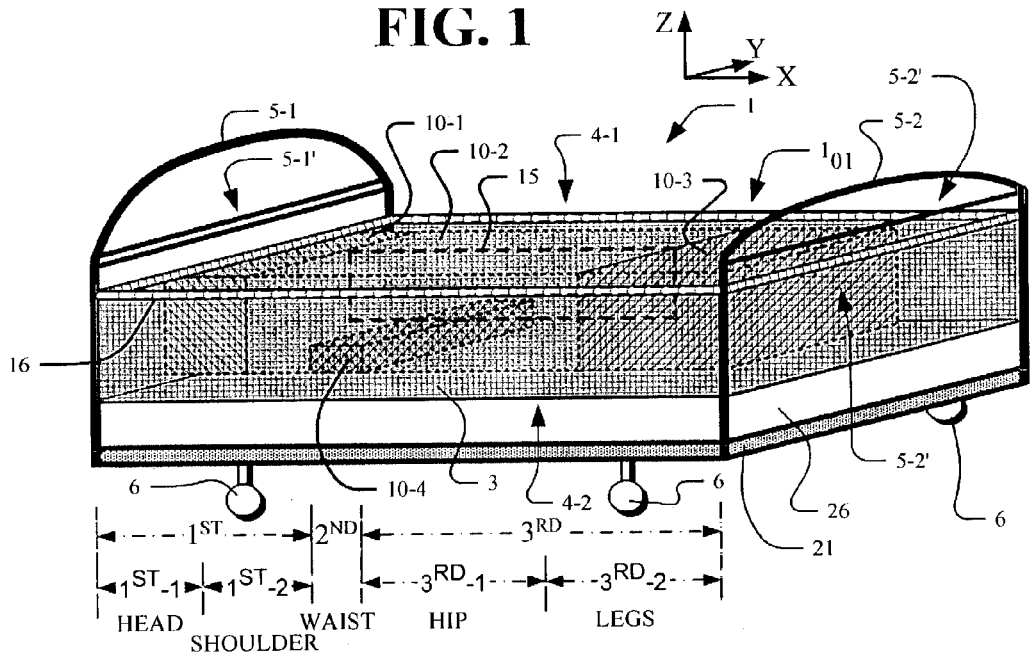
FIG. 1 depicts an isometric view of a bed having a mattress with a uniform resilient top member supported by resilient support means having variable displacement parameters.

FIG. 1 depicts an isometric view of a bed 1 having a mattress $\mathbf{1}_{01}$ which is capable of supporting a reclining body (not shown) where the reclining body is supported by low body pressure and where the reclining body is maintained in alignment. The terminology low body pressure means a pressure which is below a pressure threshold (typically the ischemic threshold) for comfortable sleep and of a level which materially reduces causes of bed-induced shifting. The terminology maintained in alignment means an alignment from head to foot of a body that avoids or reduces lateral bending of the vertebral column of the body, particularly for a person in a side-sleeping position, and that eliminates or reduces sagging of the body.

FIG. 1 depicts an isometric view of a bed 1 having a mattress $\mathbf{1}_{01}$ supported by a foundation 26 and a supporting frame 21. The foundation 26 is a box spring, firm box, board or other conventional mattress support. The supporting frame 21 may be any frame and typically is a conventional "Hollywood" or "Harvard" style of bed frame that is made from right-angled channels and is supported by legs 6 having casters. The bed 1 and mattress $\mathbf{1}_{01}$ extend in the longitudinal direction (X-axis direction) from a mattress head 5-1' at bed head 5-1 to a mattress foot 5-2' at bed foot 5-2. The bed 1 and mattress $\mathbf{1}_{01}$ also extend in the lateral direction (Y-axis direction) normal to the X-axis and in the vertical direction (Z-axis direction) normal to the plane formed by the X-axis and the Y-axis.

The mattress $\mathbf{1}_{01}$ is for supporting a reclining person (see reclining persons in FIG. 10 through FIG. 16, for example) where a person's reclining body includes a head part, a shoulder part, a waist part, a hip part and a leg part. The mattress $\mathbf{1}_{01}$ supports a reclining body positioned in the longitudinal direction with the head part toward the mattress head 5-1' and the leg part toward the mattress foot 5-2'. A body reclining on mattress $\mathbf{1}_{01}$ depresses portions of the mattress causing the mattress to compress in the vertical direction (Z-axis direction) normal to the XY plane (formed by the X-axis and the Y-axis).

The mattress $\mathbf{1}_{01}$ is formed of resilient members 10-1,10-2,10-3 and 10-4 and has a top side 4-1 and a bottom side 4-2. In the FIG. 1 embodiment, the members 10-1, 10-2, 10-3 form a top region below the top side 4-1 for supporting and distributing the weight of a reclining body. The members 10-1, 10-2, 10-3 are formed by one or more layers of foam having displacement parameters for providing a uniform supporting surface pressure to a reclining body. The term "displacement parameters" refers to any and all the properties and characteristics of materials that determine the static and dynamic tension and compression properties of a mattress. The mattress $\mathbf{1}_{01}$ includes an outer cover 3 that encloses the inner members 10-1, 10-2, 10-3 and 10-4. The cover 3 typically includes a tape edge 16 formed around the outside top of the mattress $\mathbf{1}_{01}$. Typically the top portion of the cover 2 includes a soft foam layer that is quilted with an ornamental design.

The resilient members 10-1, 10-2, 10-3 and 10-4 are formed of materials that extend in the lateral direction (Y-axis direction) and that extend in the longitudinal direction (X-axis direction) to establish displacement parameters that vary in a least the vertical (Z-axis) direction as a function of the longitudinal position (X-axis position). The resilient members 10-1, 10-2, 10-3 and 10-4 undergo different vertical compressions as a function of the longitudinal position (X-axis position) in order to follow the curvature of a reclining so as to establish alignment of the shoulder, waist and hip parts of a reclining body and so as to establish uniform low supporting surface pressure on the reclining body.

In the embodiment of FIG. 1, the resilient members 10-1, 10-2, 10-3 and 10-4 have different displacement parameters that determine the compression that occurs in the mattress $\mathbf{1}_1$ in response to a reclining body. The resilient members 10-1, 10-2, 10-3 and 10-4 function to divide the mattress $\mathbf{1}_1$ into $1^{ST}$, $2^{ND}$ and $3^{RD}$ regions. The $1^{ST}$ region is established by members 10-1 and 10-2 extending from member 10-4 toward the head of the mattress 5-1' and the $1^{ST}$ region is for location beneath the head and shoulder parts of a reclining body. The $2^{ND}$ region is established by the member 10-4 and 10-2 for location beneath the waist part of a body. The $3^{RD}$ region is established by the members 10-2 and 10-3 extending from the member 10-4 toward the foot of the mattress 5-2' and the $3^{RD}$ region is for location beneath the hip and leg parts of a reclining body. The members 10-1, 10-2, 10-3 and 10-4 have different displacement parameters that help establish the different compressions that occurs in each of the $1^{ST}$, $2^{ND}$ and $3^{RD}$ regions, respectively, in order to achieve alignment of a reclining body with low supporting body pressure.

The mattress $\mathbf{1}_{01}$ includes a cover 3 formed, on the top portion, by a stretch filling which in its uncompressed condition is typically about 1½ inches thick at the top side 4-1 of the mattress $\mathbf{1}_{01}$. The cover 3 is about 1/16 inch thick extending along the sides and along the bottom side 4-2 of the mattress $\mathbf{1}_{01}$. The cover 3 functions to cover and contain the inner members of the mattress and the cover 3 has displacement parameters that provide a soft surface without interfering with the displacement parameters of the inner members of the mattress. The inner members of the mattress function when undergoing vertical compression to comfortably support a reclining body on top of the mattress $\mathbf{1}_{01}$.

FIG. 2 depicts an isometric view of a mattress $\mathbf{1}_{02}$ that is one embodiment of the mattress $\mathbf{1}_{01}$ of FIG. 1. The mattress $\mathbf{1}_{02}$ is formed of members 11-1, 11-2, 11-3, 11-4, 11-5, 11-6 and 11-7 and an inflatable member 12. The member 12 includes a left-side lift 12-L and a right-side lift 12-R (not shown in FIG. 2, see FIG. 9). The lifts 12-L and 12-R function to tune the left-side and right-side vertical displacements, respectively, of mattress $1_{02}$ at the waists for body alignment while maintaining low contact pressure on the skin of the reclining bodies.

In FIG. 2, the mattress $1_{02}$ has a top side 4-1 and a bottom side 4-2 and is supported by a foundation 26. The members 11-1, 11-3 and 11-7$_3$ present a generally flat top region below the top side 4-1 for supporting and distributing the weight of a reclining body in cooperation with the support provided by resilient supporting members 11-2, 11-4, 11-5 and 11-6 and lifts 12-L and 12-R.

The members 11, including members 11-1, 11-2, 11-3, 11-4, 11-5, 11-6 and 11-7, extend in the lateral direction (Y-axis direction) and extend in the longitudinal direction (X-axis direction) to establish displacement parameters that vary in a least the vertical (Z-axis) direction as a function of the longitudinal position (X-axis position) of mattress $1_{02}$. The members 11 undergo different vertical compressions to follow the curvature of a reclining body. Cooperatively, the members 11 and lift 12 establish body alignment with low supporting body pressure for a reclining body. The members 11 and lift 12 are beneath the soft top portion of the cover 3. Together the members 11 and lift 12 and cover 3 provide appropriate displacement parameters for the different parts of a reclining body.

In FIG. 2, the lift 12-L is connected to a pressure unit 7 by a pressure tube 9-L and the right lift 12-R (see FIG. 9) is connected to the pressure unit 7 by a pressure tube 9-R. The pressure unit 7 is controlled by a left control device 8-L which can be actuated by a reclining body on the left side of the bed, and is controlled by a right control device 8-R, which can be actuated by a reclining body on the right side of the bed. In a preferred embodiment, the pressure unit 7 is an air unit including an air pump which is turned on and off and otherwise operated to regulate pressure by the left control device 8-L and right control device 8-R. The establishment of different pressures establishes different vertical elevations that bring a reclining body into alignment. In one embodiment, the lifts 12-L and 12-R are constructed of commercially available, airtight polyurethane inner chambers encased in and sealed to outer nylon chambers where the outer nylon chambers provide strong mechanical support.

In FIG. 2, the members 11 and lifts 12 are resilient supporting means that function to divide the mattress $1_{02}$ in the longitudinal direction into different lateral-extending regions. The $1^{ST}$ region is established by members 11-1 through 11-5 that are located beneath head and shoulder regions of a reclining body. The $2^{ND}$ region is established by lifts 12 and members 11-3 and 11-4 that are located beneath the waist part of a reclining body. The $3^{RD}$ region is established by the members 11-3, 11-4 and 11-7$_3$ that are located beneath the hip and leg parts of a reclining body.

Figure 3:
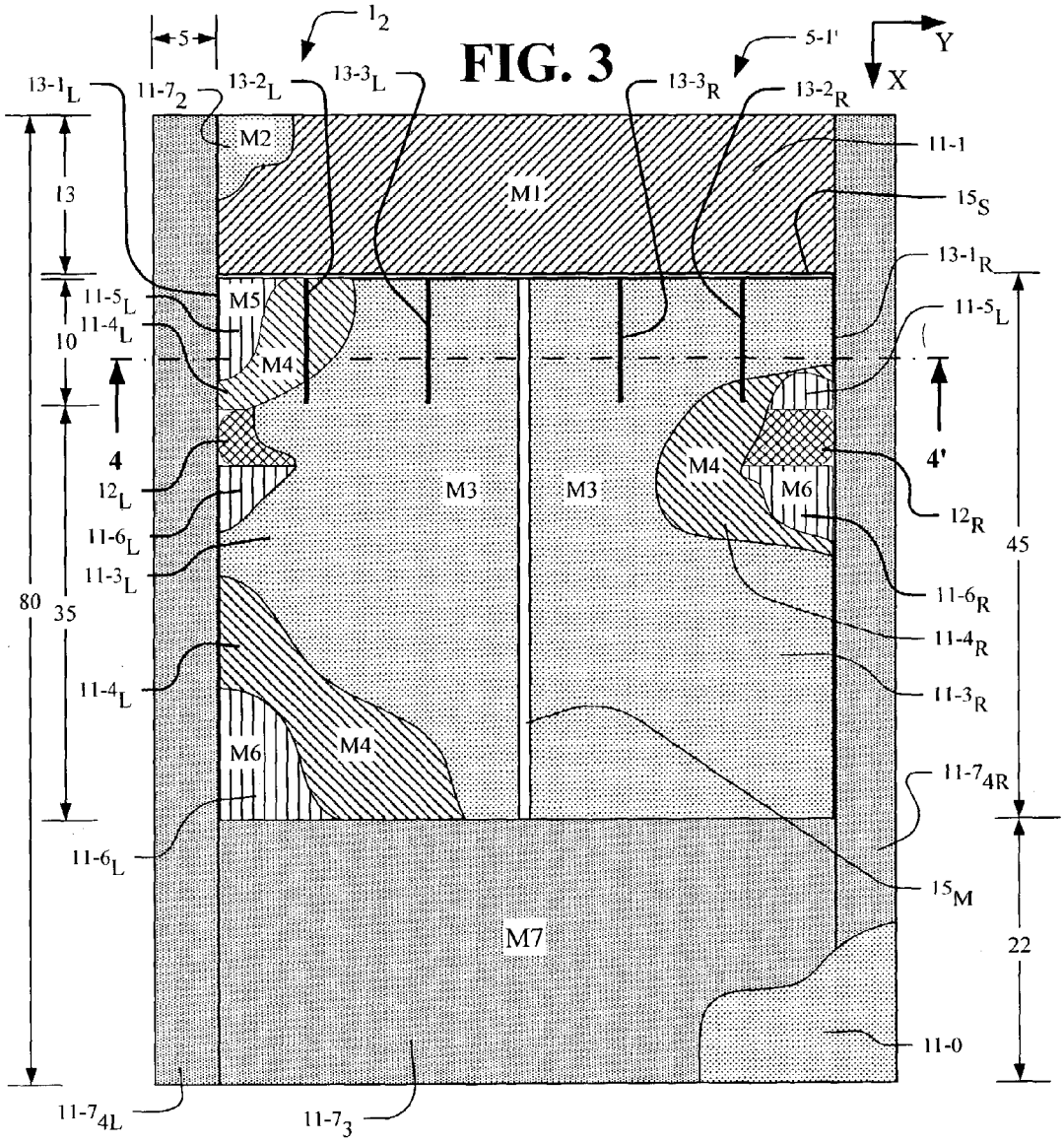
FIG. 3 depicts a top view of the mattress core of FIG. 2 with layers cut back to show underlying details.

FIG. 3 depicts a top view of the mattress core $1_2$ of FIG. 2. The mattress 12 has head member 11-1 formed of an M1 material, neck-to-leg members 11-3 formed of an M3 material, including member 11-3$_L$ on the left and member 11-3$_R$ on the right, and a lower leg and foot member 11-7$_3$ formed of an M7 material. The head member 11-1 is over a head member 11-2 formed of an M2 material. The neck-to-leg members 11-3 are over neck-to-leg members 11-4 formed of an M4 material including member 11-4$_L$ on the left and member 11-4$_R$ on the right. The neck-to-leg members 11-3 and 11-4 are over neck-to-waist members 11-5 formed of an M5 material including member 11-5$_L$ on the left and member 11-5$_R$ on the right. The neck-to-leg members 11-3 and 11-4 are over waist-to-foot members 11-6 formed of an M6 material including member 11-6$_L$ on the left and member 1-6$_R$ on the right. The cover 3 functions to cover and contain the core of the mattress including inner members 11-1, . . . , 11-7, and the cover 3 has displacement parameters that provide a soft surface without interfering with the displacement parameters of the inner members of the mattress.

The members 11-3$_L$ and 11-3$_R$ and the members 11-4$_L$ and 11-4$_R$ are separated by a longitudinal slot 15$_M$ which helps provide isolation between the left and right sides of the mattress core $1_2$. Also, a longitudinal slot 15$_S$ near the shoulder region extends between the left side member 11-7$_{4L}$ and the right side member 11-7$_{4R}$ where the members 11-7 are formed of an M7 material. The slot 15$_S$ provides a shoulder-relief feature that facilitates a large displacement difference that occurs between the neck and shoulder regions of the mattress when a reclining body is on the mattress, particularly when the body is in a side-lying position. In FIG. 3, the lateral slot 15$_S$ extends across the mattress in a straight line between the left side member 11-7$_{4L}$ and the right, side member 11-7$_{4R}$ each formed of an M7 material. In other embodiments, the slot for left member 11-3$_L$ is positioned with a different longitudinal offset (X-axis direction) from the slot for right member 11-3$_R$. Also, in still other embodiments, plural slots like slots 15$_S$ and 15$_M$ are employed for modification of the tensile and other parameters of the foam members. The depth of the slots in the Z-axis direction varies in different embodiments.

In FIG. 3, the left and right sides of the mattress core $1_2$ are symmetrical, but in other embodiments the left and right sides are asymmetrical. In one asymmetrical embodiment, for example, the size of the different members vary in the longitudinal direction (for example, member 11-3$_L$ is longer than member 11-3$_R$ in the X-axis direction) to accommodate reclining bodies of different heights. In one such example, a taller man is on the left and a shorter woman is on the right.

In FIG. 3, the resilient supporting members extend in the XY-plane (parallel to the page of the drawing) to establish different displacement parameters that determine vertical (Z-axis) mattress compression as a function of longitudinal (X-axis) position to achieve alignment of the head, shoulder, waist, hip and leg parts of a reclining body while maintaining low supporting body surface pressure.

In FIG. 3, the mattress core $1_2$ is typical of a queen size and has overall dimensions of about 80 inches in the longitudinal (X-axis) direction and 60 inches in the lateral (Y-axis) direction. The longitudinal shoulder-relief slot 15$_S$ is an opening of about 0.25 inch that is located about 13 inches from the mattress top 5-1' and extends in the vertical direction (Z-axis direction) about 8 inches. The member 11-1 is about 13 inches longitudinally and 50 inches laterally. The members 11-3$_L$ and 11-3$_R$ each include tension relieving slots 13-2$_L$ and 13-3$_L$ and tension relieving slots 13-2$_R$ and 13-3$_R$, respectively, that are each about 10 longitudinal (X-axis) inches and about 4 or more vertical (Z-axis inches). The members 11-3$_L$ and 11-3$_R$ are each about 45 inches longitudinally and 24.5 inches laterally. The members 11-3$_L$ and 11-3$_R$ each have a tension relieving slot 13-1$_L$ and 13-1$_R$, respectively, between the members 11-3$_L$ and 11-3$_R$ and the left side rail 11-7$_{4L}$ and the right side rail 11-7$_{4R}$, respectively. The member 11-7$_3$ is about 22 inches longitudinally and 50 inches laterally. The left side member 11-7$_{4L}$ and the right side member 11-7$_{4R}$ are each about 80 inches longitudinally and 5 inches laterally.

Figure 4:
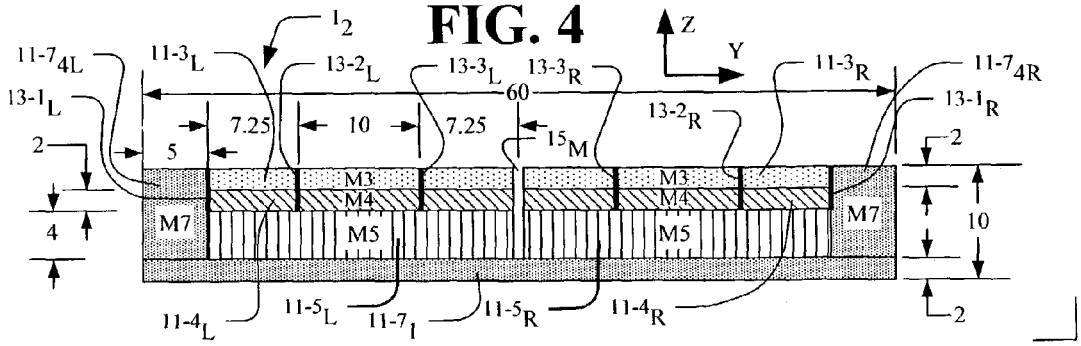
FIG. 4 depicts an end view of the mattress of FIG. 3 at the section line 4–4' of FIG. 3.

FIG. 4 depicts an end view of the mattress core $1_2$ of FIG. 3 viewed at the section line 4–4' of FIG. 3. The mattress core $1_2$ has the members 11-3 including member 11-3$_L$ on the left and member 11-3$_R$ on the right, that are about 2 inches thick in the Z-axis direction and formed of the M3 material. The mattress core $1_2$ has members 11-4 including member 11-4$_L$ on the left and member 11-4$_R$ on the right, that are about 2 inches thick in the Z-axis direction and formed of the M4 material. The mattress core $1_2$ has members 11-5 including member 11-5$_L$ on the left and member 11-5$_R$ on the right, that are about 4 inches thick in the Z-axis direction and formed of the M5 material. The mattress core $1_2$ has the left side member $11\text{-}7_{4L}$ and the right side member $11\text{-}7_{4R}$ formed of the M7 material and that are about 8 inches thick in the Z-axis direction. The mattress core $1_2$ has the left member $11\text{-}5_L$, the right member $11\text{-}5_R$, the left side member $11\text{-}7_{4L}$ and the right side member $11\text{-}7_{4R}$ positioned on a bottom layer $11\text{-}7_1$ where the bottom layer $11\text{-}7_1$ is formed of an M7 material that is about 60 inches in the Y-axis direction and 2 inches thick in the Z-axis direction.

The left members $11\text{-}3_L$, $11\text{-}4_L$, and $11\text{-}5_L$ and right members $11\text{-}3_R$, $11\text{-}4_R$, and $11\text{-}5_R$ are separated by the longitudinal slot $15_M$ which helps provide isolation between the left and right sides of the mattress core $1_2$. The left members $11\text{-}3_L$ and $11\text{-}4_L$ include the tension relieving slots $13\text{-}1_L$, $13\text{-}2_L$ and $13\text{-}3_L$ and the right members $1\text{-}3_R$ and $11\text{-}4_R$ include the tension relieving slots $13\text{-}1_R$, $13\text{-}2_R$ and $13\text{-}3_R$. The slots $13\text{-}2_L$ and $13\text{-}3_L$ are about 10 inches apart and spaced 7.25 inches from the left side member $11\text{-}7_{4L}$ and the center slot $15_M$, respectively. The slots $13\text{-}3_R$ and $13\text{-}2_R$ are about 10 inches apart and spaced 7.25 inches from the right side member $11\text{-}7_{4R}$ and the center slot $15_M$, respectively.

FIG. 5 depicts a side view of the mattress core $1_2$ of FIG. 3. The mattress core $1_2$ has head member 11-1 formed of an M1 material, neck-to-leg member 11-3 formed of an M3 material, and a lower leg and foot member $11\text{-}7_3$ formed of an M7 material. The head member 11-1 is over a head member 11-2 formed of an M2 material. The neck-to-leg members 11-3 are over neck-to-leg members 11-4 formed of an M4 material. The neck-to-leg members 11-3 and 11-4 are over neck-to-waist members 11-5 formed of an M5 material. The neck-to-leg members 11-3 and 11-4 are over waist-to-foot members 11-6 formed of an M6 material. A longitudinal slot $15_S$ is near the shoulder region. The slot $15_S$ provides a shoulder-relief feature that facilitates a large displacement difference that occurs between the neck and shoulder regions of the mattress when a reclining body is on the mattress, particularly when the body is in a side-lying position.

One embodiment of the mattress core $1_2$ of FIG. 3, FIG. 4 and FIG. 5 has the measurements and displacement parameters established using the materials and dimensions as shown in the following TABLE 1.

TABLE 1

| Member | 11-1 | 11-3 | 11-4 | 11-5 | 11-6 | $11\text{-}7_1$ | $11\text{-}7_2$ | $11\text{-}7_3$ | $11\text{-}7_4$ |
|---|---|---|---|---|---|---|---|---|---|
| Material | M1 | M3 | M4 | M5 | M6 | M7 | M7 | M7 | M7 |
| Material Type | Res | $Res_{conv}$ | $Res_{conv}$ | Res | Res | Ref | Ref | Ref | Ref |
| ILD | 06 | 32 | 32 | 15 | 15 | 40 | 40 | 40 | 40 |
| Thickness(Z) | 4 in | 2 in | 2 in | 4 in | 4 in | 2 in | 4 in | 8 in | 8 in |
| Length(X) | 13 in | 45 in | 45 in | 13 in | 26 in | 80 in | 13 in | 22 in | 80 in |
| Width(Y) | 50 in | 24.5 in | 24.5 in | 24.5 in | 24.5 in | 60 in | 50 in | 50 in | 5 in |

The materials of TABLE 1 are available under the Resilitex™ (Res) polyurethane product line and the Reflex™ (Ref) product line for mattress materials of Foamex International Inc but any polyurethane, foam or other material having similar displacement parameters can be used. In TABLE 1, the 11-4 and 11-5 members are a $Res_{conv}$ material type which is a Resilitex material of ILD 32, with a convolute surface modification (see FIG. 27 for convolute surface modification).

Another embodiment of the mattress core $1_2$ of FIG. 3, FIG. 4 and FIG. 5 has the measurements and displacement parameters established using the materials and dimensions as shown in the following TABLE 2. The TABLE 2 materials use only the Reflex™ (Ref) product line and hence is somewhat less expensive than the TABLE 1 materials that are a combination of the Resilitex™ (Res) and the Reflex™ (Ref) products.

TABLE 2

| Member | 11-1 | 11-3 | 11-4 | 11-5 | 11-6 | $11\text{-}7_1$ | $11\text{-}7_2$ | $11\text{-}7_3$ | $11\text{-}7_4$ |
|---|---|---|---|---|---|---|---|---|---|
| Material | M1 | M3 | M4 | M5 | M6 | M7 | M7 | M7 | M7 |
| Type | Ref | $Ref_{conv}$ | $Ref_{conv}$ | $Ref_{18}$ | $Ref_{18}$ | $Ref_{40}$ | $Ref_{40}$ | $Ref_{405}$ | $Ref_{40}$ |
| ILD | 6 | 30 | 30 | 18 | 18 | 40 | 40 | 40 | 40 |
| Thickness-Z | 4 in | 2 in | 2 in | 4 in | 4 in | 2 in | 4 in | 8 in | 8 in |
| Length-X | 13 in | 45 in | 45 in | 13 in | 26 in | 80 in | 13 in | 22 in | 80 in |
| Width-Y | 50 in | 24.5 in | 24.5 in | 24.5 in | 24.5 in | 60 in | 50 in | 50 in | 5 in |

Figure 6:
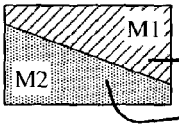
FIG. 6 depicts a side view of an alternate construction of the FIG. 5 mattress core employing a trapezoid head member.

FIG. 6 depicts a side view of a trapezoid head member 11'-1 mated to a trapezoid head member 11'-2 which together are an alternate construction that replaces the rectangular head member 11-1 and rectangular head member 11-2 of FIG. 5. In FIG. 6, the lower ILD material M2 is thicker near the slot $15_S$ than in FIG. 5 thereby providing less resistance to initial compression in the shoulder region.

Figure 7:
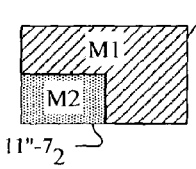
FIG. 7 depicts a side view of an alternate construction of the FIG. 5 mattress core employing an L-shaped head member.

FIG. 7 depicts a side view of a L-shaped head member 11"-1 and a rectangular head member 11"-2 as another alternate construction replacing the rectangular head member 11-1 and rectangular head member 11-2 of FIG. 5. In FIG. 7, the lower ILD material M2 is thicker near the slot $15_S$ than in FIG. 5 thereby providing less resistance to initial compression in the shoulder region.

Figure 8:
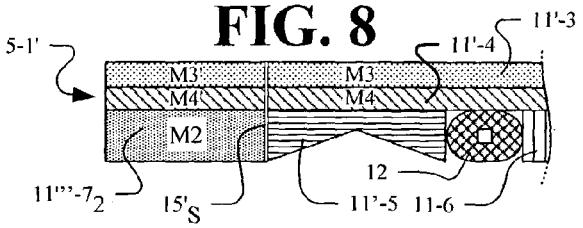
FIG. 8 depicts a side view of another alternate construction of the FIG. 5 mattress core employing a rectangular head members.

FIG. 8 depicts a side view of another alternate construction of rectangular head member 11-1 and rectangular head member 11-2 of FIG. 5. In FIG. 8, the M3 and M4 layers 11'-3 and 11'-4 extend in the X-axis direction to the top 5-1' of the mattress core and the member 11'-5 in the shoulder region has an inverted v-shaped notch in the shoulder region thereby providing less resistance to initial compression in the shoulder region. In FIG. 8, the slot $15'_S$ is present in one embodiment to separate the M3' material from the M3 material and to separate the M4' material from the M4 material. Such separation helps to eliminate tensile forces that impede the displacement of the members M3 and M4 in the shoulder region.

Figure 9:
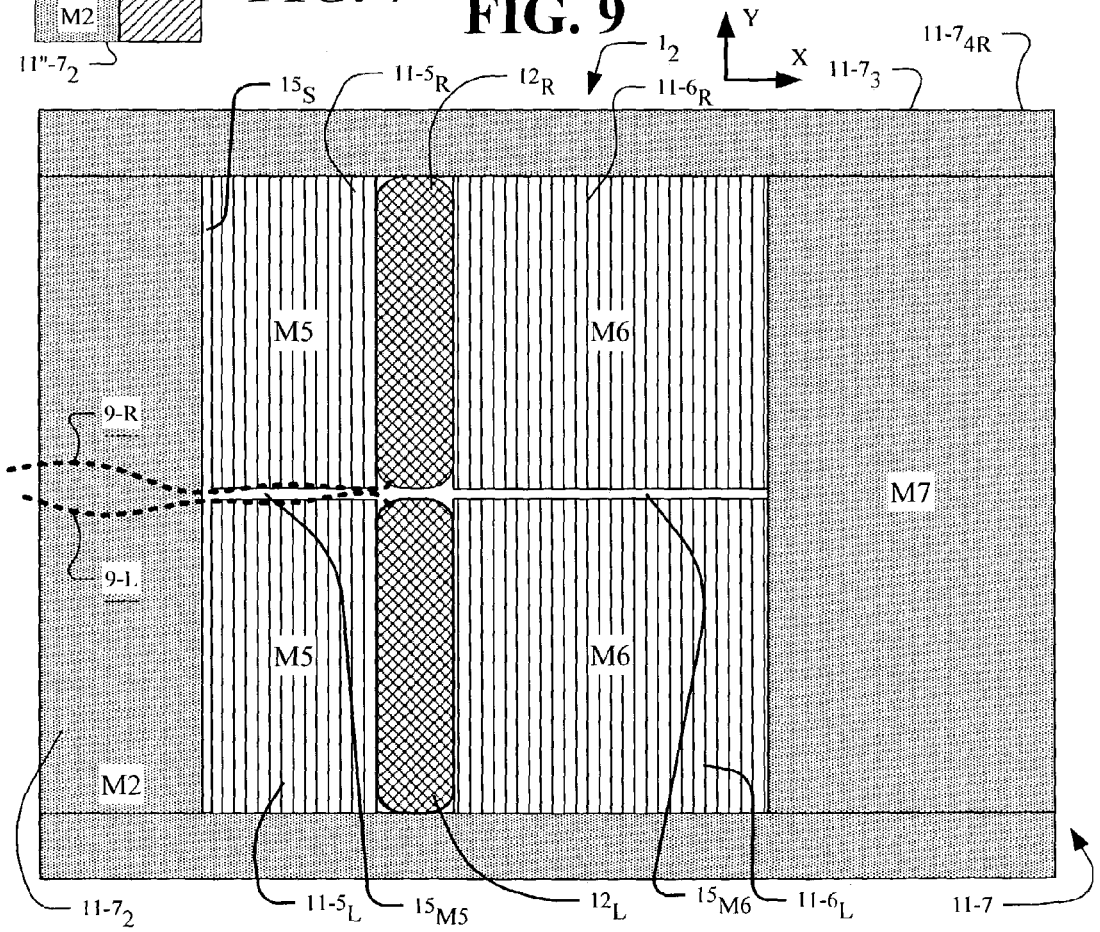
FIG. 9 depicts a top view of a portion of the mattress core of FIG. 5 taken along the section line 9–9' of FIG. 5.

FIG. 9 depicts a top view of a portion of the mattress core $\mathbf{1}_2$ of FIG. 5 taken along the section line 9–9' of FIG. 5. The mattress core $\mathbf{1}_2$ has a head member 11-7$_2$ formed of an M2 material, neck-to-waist members 11-5 formed of an M5 material including member 11-5$_L$ on the left and member 11-5$_R$ on the right, waist-to-foot members 11-6 formed of an M6 material including member 11-6$_L$ on the left and member 11-6$_R$ on the right, and a lower leg and foot member 11-7$_3$ formed of an M7 material. The members 11-5$_L$ and 11-5$_R$ and the members 11-6$_L$ and 11-6$_R$ are separated by longitudinal slots 15$_{M5}$ and 15$_{M6}$, respectively, which help provide isolation between the left and right sides of the mattress core $\mathbf{1}_2$. Also, a longitudinal slot 15$_S$ near the shoulder region extends between the left side member 11-7$_{4L}$ and the right side member 11-7$_{4R}$ formed of an M7 material. The slot 15$_S$ provides a shoulder-relief feature that facilitates a large displacement difference that occurs between the neck and shoulder regions of the mattress when a reclining body is on the mattress, particularly in the side-lying position. One embodiment of the mattress core $\mathbf{1}_2$ of FIG. 5 and FIG. 6 has the displacement parameters established using the materials as shown in the following TABLE 1.

Figure 10:
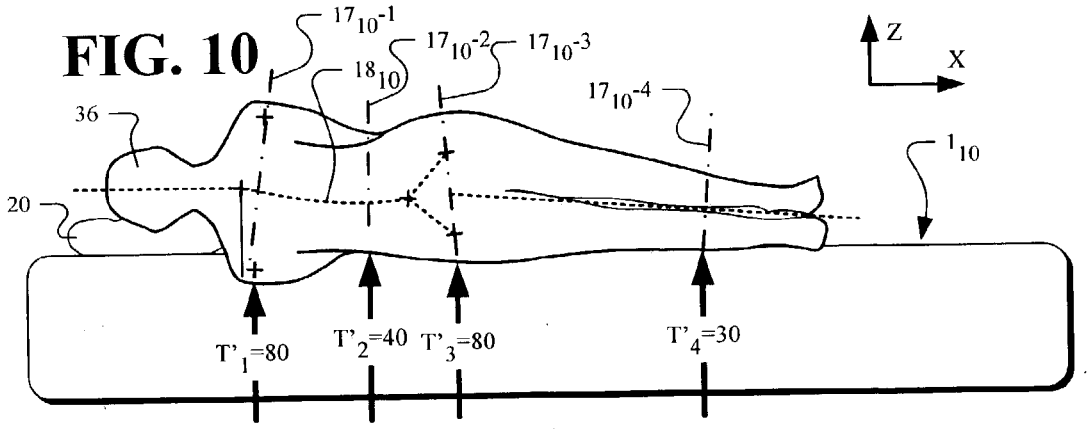
FIG. 10 depicts a side view of a mattress that has not been tuned for body alignment.

FIG. 10 depicts a side view of a mattress $\mathbf{1}_{10}$ that has not been tuned for body alignment and hence functions the same as a conventional mattress with regard to body alignment. A pillow 20 is below the head of a reclining side-lying female body 36. The shoulders have an alignment line 17$_{10}$-1, the waist has an alignment line 17$_{10}$-2, the hips have an alignment line 17$_{10}$-3, the legs have an alignment line 17$_{10}$-4 and the spine has an alignment line 18$_{10}$. In FIG. 10, the waist of the body has sagged so the spine as indicated by spine alignment line 18$_{10}$ sags and is not straight. Further, when mattress $\mathbf{1}_{10}$ is a conventional mattress, the surface pressures $T'_1$, $T'_2$, $T'_3$ and $T'_4$ at the shoulder alignment line 17$_{10}$-1, the waist alignment line 17$_{10}$-2, the hip alignment line 17$_{10}$-3 and the leg alignment line 17$_{10}$-4 are typically 80, 40, 80 and 30 mmHg, respectively. The 80 and 40 values are above the ischemic pressure threshold and hence tend to cause bed-induced shifting in a conventional mattress.

FIG. 11 depicts a side view of a mattress $\mathbf{1}_{11}$, like the mattress $\mathbf{1}_{02}$ of FIG. 2 and having a mattress core like the mattress core $\mathbf{1}_2$ of FIG. 3, tuned for a Caucasian female body 36, having 2.5 percentile body dimensions and reclining on her side. A pillow 20 is positioned under the head of body 36.

In FIG. 11, a cover 3 like that in the mattress $\mathbf{1}_{02}$ of FIG. 2 is shown. The top side 4-1 of the mattress $\mathbf{1}_{11}$ has been depressed by the body 36 so that it follows the curvature of the body. The top members 11-1, 11-3, and 11-7$_3$ are in closest contact with the body (through cover 3) and function to support and distribute the weight of the body in cooperation with resilient supporting members 11-2,11-4, 11-5, 11-6 and 11-7.

In the $1^{ST}$ region, the head section includes the foam members 11-1 and 11-2 for supporting the head part of reclining body 36. The foam members 11-1 and 11-2 undergo only a small compression and provide appropriate displacement parameters for the head part of the side-lying female body 36. The shoulder section includes the foam member 11-3, foam member 11-4 and foam member 11-5. The foam members 11-3, 11-4 and 11-5 undergo substantial compression in response to the shoulder of the reclining body 36 and together provide appropriate displacement parameters for the shoulder part of the side-lying female body 36.

In the $2^{ND}$ region, the waist section includes the foam members 11-3 and 11-4 and includes the lift 12 for supporting the waist part of reclining body 36. The lift 12 is adjusted so that the vertical elevation imparted to the mattress $\mathbf{1}_{11}$ under the waist region of the reclining body 36 helps achieve body alignment. Together the members 11-3 and 11-4 together with lift 12 provide appropriate displacement parameters for the waist part of the side-lying female body 36.

In the $3^{RD}$ region, the hip section includes the members 11-3, 11-4 and 11-6 which provide appropriate displacement parameters for the hip part of the side-lying female body 36. In the leg and foot section, the foam member and 11-7$_3$ has slight compression in response to the legs and feet of the side-lying female body 36.

In FIG. 11, the shoulders have an alignment line 17$_{11}$-1, the waist has an alignment line 17$_{11}$-2, the hips have an alignment line 17$_{11}$-3, the legs have an alignment line 17$_{11}$-4 and the spine has an alignment line 18. In FIG. 11, the waist of the body is supported to be straight so the spine alignment line 18$_{11}$ is straight. The surface pressures $T_1$, $T_2$,$T_3$ and $T_4$ at the shoulder alignment line 17$_{11}$-1, the waist alignment line 17$_{11}$-2, the hip alignment line 17$_{11}$-3 and the leg alignment line 17$_{11}$-4 are typically low and below a low pressure threshold. For a tuned bed made of properly selected foams and other materials, the low pressure threshold is below the ischemic pressure of about 30 mmHg.

The pressure as measured at any point on the interface between the body 36 and the mattress $\mathbf{1}_{11}$ is established as a combination of the supporting forces applied by the mattress members under the supporting point. For example, the supporting forces under the $T_1$ interface point at the shoulder part of body 36 combines the supporting forces of base layer 11-7$_1$, lift 12-1, foam member 11-3, foam member 11-4 and cover 3. Each of these members has a different resistance to compression and, in general, that resistance is non-linear as a function of the amount of compression. The displacement parameters for foam materials include an ILD (indentation load deflection) value that indicates the resistance to compression of the material. Generally, lifts or other members are employed in combination with resilient foam members to adjust the elevation below a foam member so that the range of elevation over which a foam member is compressed is within a satisfactory operating range. When a vertical stack of resilient foam members is employed, then each of the foam members in the stack operates over its own operating range. A satisfactory operating range for foam in a mattress is generally at about 50 percent compression. As compression exceeds about 50 percent, the ILD value increases significantly until the foam member acts more as a taught membrane than as resilient foam. A foam member stretched to approach the membrane threshold imparts high pressure to a reclining body and is to be avoided.

FIG. 12 depicts a side view of a mattress $\mathbf{1}_{12}$, like the mattress $\mathbf{1}_{02}$ of FIG. 2, and having a mattress core like the mattress core $\mathbf{1}_2$ of FIG. 3, tuned for a female body 36, having 2.5 percentile body dimensions and reclining on her side.

In FIG. 12, a cover 3 like that in the mattress $\mathbf{1}_{02}$ of FIG. 2 is shown. The top side 4-1 of the mattress $\mathbf{1}_{12}$ has been depressed by the body 35 so that it follows the curvature of the body. The top members 11-1, 11-3, and 11-7$_3$ are in closest contact with the body (through cover 3) and function to support and distribute the weight of the body in cooperation with resilient supporting members 11-2,11-4, 11-5, 11-6 and 11-7.

In the $1^{ST}$ region, the head section includes the foam members 11-1 and 11-2 for supporting the head part of reclining body 35. The foam members 11-1 and 11-2 undergo only a small compression and provide appropriate displacement parameters for the head part of the side-lying male body 35. The shoulder section includes the foam member 11-3, foam member 11-4 and foam member 11-5. The foam members 11-3, 11-4 and 11-5 undergo substantial compression in response to the shoulder of the reclining body 35 and together provide appropriate displacement parameters for the shoulder part of the side-lying male body 35.

In the $2^{ND}$ region, the waist section includes the foam members 11-3 and 11-4 and includes the lift 12 for supporting the waist part of reclining body 35. The lift 12 is adjusted so that the vertical elevation imparted to the mattress $\mathbf{1}_{12}$ under the waist region of the reclining body 35 helps achieve body alignment. Together the members 11-3 and 11-4 together with lift 12 provide appropriate displacement parameters for the waist part of the side-lying male body 35.

In the $3^{RD}$ region, the hip section includes the members 11-3, 11-4 and 11-6 which provide appropriate displacement parameters for the hip part of the side-lying male body 35. In the leg and foot section, the foam member and $\mathbf{11\text{-}7}_3$ has slight compression in response to the legs and feet of the side-lying male body 35.

In FIG. 12, the shoulders have an alignment line $\mathbf{17}_{12}$-1 the waist has an alignment line $\mathbf{17}_{12}$-2, the hips have an alignment line $\mathbf{17}_{12}$-3, the legs have an alignment line $\mathbf{17}_{12}$-4 and the spine has an alignment line $\mathbf{18}_{12}$. In FIG. 12, the waist of the body is supported to be straight so the spine alignment line $\mathbf{18}_{12}$ is straight. The surface pressures $T_1$, $T_2$, $T_3$ and $T_4$ at the shoulder alignment line $\mathbf{17}_{12}$-1, the waist alignment line $\mathbf{17}_{12}$-2, the hip alignment line $\mathbf{17}_{12}$-3 and the leg alignment line $\mathbf{17}_{12}$-4 are typically low and below a low pressure threshold. For a tuned bed made of properly selected foams and other materials, the low pressure threshold is below the ischemic pressure of about 30 mmHg.

FIG. 13 depicts a top view of one embodiment of the mattress $\mathbf{1}_{02}$ of FIG. 2 with a Caucasian female, with 2.5 percentile body dimensions, on her back on the right and a Caucasian male, with 97.5 percentile body dimensions, on his back on the left. In FIG. 13, the upper layers of foam for the mattress $\mathbf{1}_{02}$ of FIG. 2 have been stripped back to show the lower layers and no cover, like cover 3 in FIG. 2, is shown.

The mattress core $\mathbf{1}_{13}$ has head member 11-1 formed of an M1 material, neck-to-leg members 11-3 formed of an M3 material, including member $\mathbf{11\text{-}3}_L$ on the left and member $\mathbf{11\text{-}3}_R$ on the right, and a lower leg and foot member $\mathbf{11\text{-}7}_3$ formed of an M7 material. The head member 11-1 is over a head member 11-2 formed of an M2 material. The neck-to-leg members 11-3 are over neck-to-leg members 11-4 formed of an M4 material including member $\mathbf{11\text{-}4}_L$ on the left and member $\mathbf{11\text{-}4}_R$ on the right. The neck-to-leg members 11-3 and 11-4 are over neck-to-waist members 11-5 formed of an M5 material including member $\mathbf{11\text{-}5}_L$ on the left and member $\mathbf{11\text{-}5}_R$ on the right. The neck-to-leg members 11-3 and 11-4 are over waist-to-foot members 11-6 formed of an M6 material including member $\mathbf{11\text{-}6}_L$ on the left and member $\mathbf{11\text{-}6}_R$ on the right. The members $\mathbf{11\text{-}3}_L$ and $\mathbf{11\text{-}3}_R$ and the members $\mathbf{11\text{-}4}_L$ and $\mathbf{11\text{-}4}_R$ are separated by a longitudinal slot $\mathbf{15}_M$ which helps provide isolation between the left and right sides of the mattress core $\mathbf{1}_2$. Also, a longitudinal slot $\mathbf{15}_S$ near the shoulder region extends between the left side member $\mathbf{11\text{-}7}_{4L}$ and the right side member $\mathbf{11\text{-}7}_{4R}$ where the members 11-7 are formed of an M7 material. The slot $\mathbf{15}_S$ provides a shoulder-relief feature that facilitates a large displacement difference that occurs between the neck and shoulder regions of the mattress when a reclining body is on the mattress. In FIG. 3, the lateral slot $\mathbf{15}_S$ extends across the mattress in a straight line between the left side member $\mathbf{11\text{-}7}_{4L}$ and the right side member $\mathbf{11\text{-}7}_{4R}$ each formed of an M7 material. In other embodiments, the slot for left member 11-3, is positioned with a different longitudinal offset (X-axis direction) from the slot for right member $\mathbf{11\text{-}3}_R$. Also, in still other embodiments, plural slots like slots $\mathbf{15}_S$ and $\mathbf{15}_M$ are employed for modification of the tensile and other parameters of the foam members. The depth of the slots in the Z-axis direction varies in different embodiments.

FIG. 14 depicts a side view of the mattress core $\mathbf{1}_2$ of FIG. 13 tuned for a Caucasian male body 35, having 97.5 percentile body dimensions, reclining on his back. In FIG. 14, the top side 4-1 is depressed by the body 35 so that it follows the curvature of the body. In FIG. 14, a cover 3 like that in FIG. 12 is not shown. The top members 11-1, 11-3, and $\mathbf{11\text{-}7}_3$ are in closest contact with the body (through cover 3 not shown) and function to support and distribute the weight of the body in cooperation with resilient supporting members 11-2,11-4, 11-5, 11-6 and $\mathbf{11\text{-}7}_1$.

FIG. 15 depicts a top view of one embodiment of the mattress $\mathbf{1}_{02}$ of FIG. 2 with a Caucasian female, with 2.5 percentile body dimensions, on her side on the right and a Caucasian male, with 97.5 percentile body dimensions, on his side on the left. In FIG. 15, the upper layers of foam for the mattress $\mathbf{1}_{02}$ of FIG. 2 have been stripped back to show the lower layers and no cover, like cover 3 in FIG. 2, is shown.

The mattress core 1,3 has head member 11-1 formed of an M1 material, neck-to-leg members 11-3 formed of an M3 material, including member $\mathbf{11\text{-}3}_L$ on the left and member $\mathbf{11\text{-}3}_R$ on the right, and a lower leg and foot member $\mathbf{11\text{-}7}_3$ formed of an M7 material. The head member 11-1 is over a head member 11-2 formed of an M2 material. The neck-to-leg members 11-3 are over neck-to-leg members 11-4 formed of an M4 material including member $\mathbf{11\text{-}4}_L$ on the left and member $\mathbf{11\text{-}4}_R$ on the right. The neck-to-leg members 11-3 and 11-4 are over neck-to-waist members 11-5 formed of an M5 material including member $\mathbf{11\text{-}5}_L$ on the left and member $\mathbf{11\text{-}5}_R$ on the right. The neck-to-leg members 11-3 and 11-4 are over waist-to-foot members 11-6 formed of an M6 material including member $\mathbf{11\text{-}6}_L$ on the left and member $\mathbf{11\text{-}6}_R$ on the right. The members $\mathbf{11\text{-}3}_L$ and $\mathbf{11\text{-}3}_R$ and the members $\mathbf{11\text{-}4}_L$ and $\mathbf{11\text{-}4}_R$ are separated by a longitudinal slot $\mathbf{15}_M$ which helps provide isolation between the left and right sides of the mattress core $\mathbf{1}_2$. Also, a longitudinal slot $\mathbf{15}_S$ near the shoulder region extends between the left side member $\mathbf{11\text{-}7}_{4L}$ and the right side member $\mathbf{11\text{-}7}_{4R}$ where the members 11-7 are formed of an M7 material. The slot $\mathbf{15}_S$ provides a shoulder-relief feature that facilitates a large displacement difference that occurs between the neck and shoulder regions of the mattress when a reclining body is on the mattress, particularly when the body is in a side-lying position. In FIG. 15, the lateral slot $\mathbf{15}_S$ extends across the mattress in a straight line between the left side member $\mathbf{11\text{-}7}_{4L}$ and the right side member $\mathbf{11\text{-}7}_{4R}$ each formed of an M7 material. In other embodiments, the slot for left member $\mathbf{11\text{-}3}_L$ is positioned with a different longitudinal offset (X-axis direction) from the slot for right member $\mathbf{11\text{-}3}_R$. Also, in still other embodiments, plural slots like slots $\mathbf{15}_S$ and $\mathbf{15}_M$ are employed for modification of the tensile and other parameters of the foam members. The depth of the slots in the Z-axis direction varies in different embodiments.

FIG. 16 depicts a side view of the mattress core $\mathbf{1}_2$ of FIG. 15 tuned for a Caucasian male body 35, having 97.5 percentile body dimensions, reclining on his back. In FIG. 16, the top side 4-1 is depressed by the body 35 so that it follows the curvature of the body. In FIG. 16, a cover 3 like that in FIG. 12 is not shown. The top members 11-1, 11-3, and 11-7$_3$ are in closest contact with the body (through cover 3 not shown) and function to support and distribute the weight of the body in cooperation with resilient supporting members 11-2,11-4, 11-5, 11-6 and 11-7$_1$.

FIG. 17 depicts a side view of the mattress core 1$_2$ of FIG. 3 that is an alternate embodiment of the FIG. 5 mattress core. The mattress core 1$_2$ of FIG. 17 has head member 11-1 of FIG. 5 formed without the M1 material. The neck-to-leg member 11-3 formed of an M3 material extends all the way to the mattress head 5-1' and to a lower leg and foot member 11-7$_3$ formed of an M7 material. The member 11-3 is over a member 11-4 formed of an M4 material that also extends all the way to the mattress head 5-1' and to the lower leg and foot member 11-7$_3$. The members 11-3 and 11-4 are over head member 11-2 formed of an M2 material, over a neck-to-waist member 11-5 formed of an M5 material, over a lift 12 and over a waist-to-foot member 11-6 formed of an M6 material. A longitudinal slot 15$_S$ is near the shoulder region. The slot 15$_S$ provides a shoulder-relief feature that facilitates a large displacement difference that occurs between the neck and shoulder regions of the mattress when a reclining body is on the mattress, particularly when the body is in a side-lying position.

FIG. 18 depicts a side view of the mattress core 1$_2$ of FIG. 3 that is an alternate embodiment of the FIG. 5 mattress core. The mattress core 1$_2$ of FIG. 18 has head member 11-1 formed of the M1 material, neck-to-leg member 11-3 formed of an M3 material, and a lower leg and foot member 11-7$_3$ formed of an M7 material. The head member 11-1 is over a head member 11-7$_2$ formed of an M7 material and a lift 12-2. The neck-to-leg member 11-3 is over a neck-to-leg member 11-4 formed of an M4 material. The neck-to-leg members 11-3 and 11-4 are over a neck-to-waist member 11-5 formed of an M5 material, over a lift 12-1 and over a waist-to-foot member 11-6 formed of an M6 material. A longitudinal slot 15$_S$ is near the shoulder region. The lift 12-2 under the head region provides for alignment of the head and neck of a reclining body.

FIG. 19 depicts a side view of the mattress core 1$_2$ of FIG. 3 that is an alternate embodiment of the FIG. 5 mattress core. The mattress core 1$_2$ of FIG. 19 has head member 11-1 formed of the M1 material, neck-to-leg member 11-3 formed of an M3 material, and a lower leg and foot member 11-7$_3$ formed of an M7 material. The head member 11-1 is over a head member 11-2 formed of an M2 material and a lift 12-3. The lift 12-3 is over a riser 11-7$_5$ formed of an M7 material of approximately 1.5 inches thick for increasing the lifting range (Z-axis) of the lift 12-3 by 1.5 inches. The neck-to-leg member 11-3 is over a neck-to-leg member 11-4 formed of an M4 material. The neck-to-leg members 11-3 and 11-4 are over a neck-to-waist member 11-5 formed of an M5 material, over the lift 12-3 and over a waist-to-foot member 11-6 formed of an M6 material. A longitudinal slot 15$_S$ is near the shoulder region. The lift 12-3 under the waist region provides for alignment of the waist of a reclining body.

FIG. 20 depicts a side view of the mattress core that is an alternate embodiment of the FIG. 5 mattress core. The mattress core of FIG. 20 has head member 11'-3 formed of a M3 material. The neck-to-leg member 11-3 formed of an M3 material extends from the head member 11'-3 to the mattress foot 5-2'. The member 11'-3 is over a member 11'-4 formed of an M4 material. The member 11-3 is over a member 11-4 formed of an M4 material that extends to the a mattress end member 11-7$_3$ formed of an M7 material. The members 11'-3 and 11'-4 are over head member 11-2 formed of an M2 material. The members 11-3 and 11-4 are over, over a neck-to-waist member 11-8 formed of a spring member, over a lift 12 and over a waist-to-foot member 11-9 formed of a spring member. A longitudinal slot 15$_S$ is near the shoulder region. The slot 15$_S$ provides a shoulder-relief feature. The spring members 11-8 and 11-9 are inner-spring in construction and are designed to have displacement parameters similar to those of the M5 and M6 materials. The members 11-2, 11-8, 11-9, 11-7$_3$ and the spring members 11-8 and 11-9 are supported by a base 11-7$_7$ formed of a foam or spring member.

FIG. 21 depicts the displacement profile of the side-lying female of FIG. 11 measured as the vertical displacement, $E_Z$, in the Z-axis direction along the length in the X-axis direction. The vertical displacements are shown for the neck as $E_7$, for the shoulder as $E_{12}$, for the waist as $E_{20}$, for the hips as $E_{19}$ and for the legs as $E_{44}$. The numbers along the X axis represent approximately the distance (in feet) from the head where the vertical displacements are measured. The sharpest change in vertical displacement (gradient) over a distance along the X-axis is between the neck vertical displacement $E_7$ and shoulder vertical displacement $E_{12}$. In general, the vertical displacement pattern, $E_Z$, is a function of the X-axis position, x, that is, $E_Z$=f(x) where f(x) is the curve in FIG. 21 representing the displacement profile for one particular body 36 in FIG. 11. The displacement profile is determined by the natural curvature of the body 36.

FIG. 22 depicts the displacement profile measured as a vertical displacement in the Z-axis direction along the length in the X-axis direction of the side-lying male of FIG. 12. The vertical displacements are shown for the neck as $E_{11}$, for the shoulder as $E_{19}$, for the waist as $E_{29}$, for the hips as $E_{41}$ and for the legs as $E_{62}$. The numbers represent the number of inches from the head where the vertical displacements are measured. The sharpest change in vertical displacement (gradient) over a distance along the X-axis is between the neck vertical displacement $E_{11}$ and shoulder vertical displacement $E_{19}$. In general, the vertical displacement, $E_Z$, is a function of the X-axis position, x, that is, $E_Z$=f(x) where f(x) is the curve in FIG. 22 for one particular body 35 in FIG. 12.

When the top of the heads for the female in FIG. 11 and the male in FIG. 12 are in alignment, FIG. 21 and FIG. 22 show that the vertical waist measurement is a high value for the female ($E_{20}$) while at about the same X-axis distance, the vertical shoulder measurement for the male is low ($E_{19}$). Also, the maximum vertical displacement for the female ($D_f$) is less than half the maximum vertical displacement for the male ($D_m$). These differences between the small-body displacements represented by the female body of FIG. 11 and the large-body displacements represented by the male body of FIG. 12 can be accounted for in the mattress structure in order to achieve mattresses that provide body alignment and low body supporting pressure for different size bodies.

While FIG. 21 and FIG. 22 depict displacement profiles measured in the ZX plane for vertical displacements, $E_Z$, in the Z-axis direction along the length in the X-axis direction, it is apparent from FIG. 13 and FIG. 15 that similar displacement profiles exist in the ZY plane. In the ZY plane, displacement profiles are measured for vertical displacements, $E_Z$, in the Z-axis direction along the width in the Y-axis direction. In general for the ZY plane, the vertical displacement, $E_Z$, is a function of the Y-axis position, y, that is, $E_Z$=f(y) where f(y) is a curve like the curves in FIG. 21 and FIG. 22 except extending in the Y-axis direction with similar values as is apparent from FIG. 13 and FIG. 15.

Since the displacement profile, $E_Z$, is expressed as a function of X-axis position, $E_Z$=f(x) and as a function of Y-axis position, $E_Z$=f(y), the displacement profile, $E_{Z(x,y)}$, can also be expressed as a function of both X-axis position and Y-axis position, $E_{Z(x,y)}$=f(x,y), where $E_{Z(x,y)}$=f(x,y) is an expression combining $E_Z$=f(x) and $E_Z$=f(Y) and if drawn would show a three-dimensional plot.

While displacement profiles measured in the ZX plane and the ZY plane are evident for the side-lying bodies of FIG. 21 and FIG. 22, similarly, displacement profiles for the back-lying bodies of FIG. 13, FIG. 14 and FIG. 16 And displacement profiles for any other body position on a mattress. However, for a reclining body, the side-lying body generally exhibits the largest gradient, between the head and shoulder, and is therefore this region is the most difficult to design in order to concurrently provide body alignment and low body supporting pressure.

The difficulty in achieving low body pressure arises in foams and other spring-acting materials because the pressure exerted changes as a function of displacement. For a uniform spring material such as a uniform layer of foam, the pressure exerted locally on each segment dx varies as a function of the vertical (Z axis) displacement. As is obvious from FIG. 21 and FIG. 22, the vertical displacement varies considerable in the X axis direction and hence, the pressure on the body will vary substantially as a function of X axis position if a foam or other mattress material has uniform displacement parameters in the X axis direction. Similarly, the pressure on the body will vary substantially as a function of X axis position if a foam or other mattress material has uniform displacement parameters in the Y axis direction. The present invention by way of distinction, varies the displacement parameters of the mattress materials to match the displacement profile of the reclining body. For example, the shoulder and hip regions of a mattress undergoes the largest vertical displacements and hence, a uniform foam will exert the highest pressure at the shoulder and hips. Similarly, the neck, head, waist and leg regions may have the smallest vertical displacements and hence, a uniform foam will exert the least pressures at the head, neck and legs. To compensate for these differences, the present invention varies the displacement parameters of the mattress materials to match the displacement profiles of the reclining bodies. The varying of the displacement parameters is achieved in many different ways as described in the present specification. For example, vertical slots (Z axis direction) are extended in the X axis and/or Y axis direction to prevent tension increase at high vertical compression. Since the shoulder region has the largest gradient in the displacement profile, the slots (see slots 13 and 15 in FIG. 3, for example) are particularly useful in the shoulder region for varying the displacement parameters. Similarly, foams with varying ILDS's are employed in the different regions to match the displacement parameters to the body profile. The change in displacement parameters in the mattress core between the head region and the shoulder region accommodates the high gradient in the body profile to maintain low body pressure and body alignment.

Concurrently with matching the displacement profiles to the body profile, one or more of the regions varies the vertical displacement to match the displacement profile of the reclining body. For example, the waist region for a relining body is particularly important in maintaining body alignment. Even if the displacement parameters are varied to achieve a supporting body pressure that is uniformly below a desired threshold, if the waist is at the same time allowed to sag, poor body alignment can result. In many embodiments, a dynamic lift is used to vary the vertical displacement in the waist region to match the vertical displacement to the body profile to maintain alignment. In other embodiments, a static design is employed to vary the vertical displacement in the waist and/or other regions to match the vertical displacement to the body profile. For example, see FIG. 67 hereinafter where the waist region of foam members is not structurally modified resulting in a larger vertical displacement in the waist region to match the vertical displacement to the body profile to maintain body alignment.

FIG. 23 depicts a three-dimensional plot of vertical displacements caused by a local force, $F_{x0,y0}$, depressing local area 4 of the mattress of FIG. 1. Each small local area of a reclining body exhibits a force which varies in magnitude according to the weight of the reclining body as distributed by the body profile, as shown by way of example in FIG. 21 and FIG. 22. Typically the mattress material of area 4 FIG. 23 is a foam such as polyurethane. Polyurethane and other foams are commercially available for a wide variety of applications including mattresses. The displacement parameters of foams are complex. Foams have varying density, varying ILD (indentation load deflection) sometimes called IFD (indentation force deflection) and many other parameters as identified above. Foams in general exhibit excellent shape retention and high resistance to wear. Foams are available in different pore sizes ranging from 3 pores per linear inch (coarse and abrasive) to 110 pores per linear inch (soft and downy). An example of some displacement parameters for two commercially available foams are given in the following TABLE 3.

TABLE 3

| PARAMETER | FOAM 1 | FOAM2 |
|---|---|---|
| Density (pcf) | 3 | 3 |
| ILD 25% | 15 | 32 |
| ILD 65% | 34 | 70 |
| SAG | 2.3 | 2.2 |
| Elevation Retention % | 99 | 99 |
| ILD Retention % | 95.3 | 94.7 |
| Tensile % | 10.8 | 16.9 |
| Elongation % | 163 | 156 |
| Tear (pli) | 1 | 1.2 |
| Ball Rebound | 72 | 70 |
| Compression Set 75% | <5 | <5 |
| Compression Set 90% | <5 | <5 |

In FIG. 23, an external depression force $F_{x0,y0}$ is applied vertically (Z-axis direction) normal to surface of the foam lying parallel to the XY-plane (formed by the X-axis and the Y-axis). The depression force $F_{x0,y0}$ is applied to a foam at some location [x0,y0] and causes a compression of the foam that is measured as a vertical displacement $D_{x0,y0}$ at location [x0,y0]. The magnitude of the displacement $D_{x0,y0}$ in response to the external depression force $F_{x0,y0}$ is determined by the displacement parameters of the foam. When the external depression force $F_{x0,y0}$ is applied to the foam, the displacement increases until the mattress resistance force $R_{x0,y0}$ exerted by the foam as a result of compression equals the external depression force $F_{x0,y0}$. A condition of equilibrium results when the external depression force $F_{x0,y0}$ equals the foam resistance force $R_{x0,y0}$. The displacement $D_{x0,y0}$ is the displacement that results at that condition of equilibrium.

In a foam material, foam at adjacent locations near the applied force location [x0,y0] are also compressed because of the lateral tensile transfer characteristic of foams. Referring to FIG. 23, locations [x1,y1]; [x1,y2]; [x3,y3] and [x4,y4] are represented by circle 4' where circle 4' is at some radius from location [x0,y0]. The displacements at those locations are D[x1,y1]; D[x1,y2]; D[x3,y3] and D[x4,y4], respectively, and those displacements at 4' are less than displacement D[x0,y0] at location [x0,y0]. At still additional locations represented by circle 4 in FIG. 23, where circle 4 is at some greater radius from location [x0,y0] than circle 4', the displacements resulting from the external depression force $F_{x0,y0}$ are negligible.

In FIG. 23, the external depression force $F_{x0,y0}$ is representative of many similar forces imparted to a mattress by a reclining body. In order to determine the actual depressions resulting from a reclining body, the depression forces must be integrated over all the parts of the body in contact with the mattress. Such an integration is mathematically difficult since as can be noted from TABLE 3 above, the forces due to compression of mattress materials are not linear. For example, the ILD for a foam material is different at 25% compression than it is at 65% compression.

FIG. 24 depicts a vertical displacement of foam material in response to an external depression force $F_{x,y}$ applied in the Z-axis direction. The displacement is observed along the X-axis for a first foam member 133 positioned over a second foam member 134 where the two foam members are the same thickness and have the same resistance to vertical displacement (that is, the same ILD value). In FIG. 24, an external depression force $F_{x,y}$ is applied vertically to the surface of the foam member 133 and causes a compression of the foam member 133 resulting in a vertical displacement $D_1$. The magnitude of the displacement $D_1$ is determined by the displacement parameters of the foam member 133. The depression force $F_{x,y}$ is transferred through the foam member 133 to foam member 134. The depression force $F_{x,y}$ causes a compression of the foam member 134 resulting in a vertical displacement $D_2$ in of the foam member 134. The magnitude of the displacement $D_2$ is about the same as the magnitude of vertical displacement $D_1$. FIG. 24 demonstrates that when two foam members having the same displacement parameters are stacked, the compression results are about the same as for a single foam member of twice the thickness.

FIG. 25 depicts a vertical displacement of foam material in response to an external depression force $F_{x,y}$ applied in the Z-axis direction. The displacement is observed along the X-axis for a first foam member 135 positioned over a second foam member 136. The first foam member 135 is thicker than and has a lower resistance to vertical displacement (that is, lower ILD value) than the second foam member 136. In FIG. 25, an external depression force $F_{x,y}$ is applied vertically to the surface of the foam member 135 and causes a compression of the foam member 135 resulting in a vertical displacement $D_3$. The magnitude of the displacement $D_3$ is determined by the displacement parameters of the foam member 135. The depression force $F_{x,y}$ is transferred through the foam member 135 to foam member 136. The depression force $F_{x,y}$ causes a compression of the foam member 136 resulting in a vertical displacement $D_4$ in of the foam member 136. The magnitude of the displacement $D_3$ is much greater than the magnitude of the displacement $D_4$. FIG. 25 demonstrates the characteristic that when two foam members of different ILD value, thickness and other displacement parameters are stacked vertically to respond to an external force such as a reclined body, the results are a complex interaction of the different materials. Note that most of the vertical displacement occurred in a local area of the thicker, lower ILD value foam member 135.

FIG. 26 the vertical displacement of foam material in response to an external depression force $F_{x,y}$ applied in the Z-axis direction to a first foam member 137. The first foam member 137 is positioned over a second foam member 138 where the foam member 137 is about the same thickness as the foam member 138 and the foam member 137 has a higher ILD value than the foam member 138. In FIG. 26, two external depression forces $F_{x1,y}$ and $F_{x2,y}$ representing a body part such as a shoulder are applied vertically to the foam member 137. The external depression forces $F_{x1,y}$ and $F_{x2,y}$ cause a compression of the foam member 137 by a vertical displacement that tends to be local in a width $L_1$ and tends to wrap around the depression forces $F_{x1,y}$ and $F_{x2,y}$. The magnitude of the displacement width $L_1$ is determined by the ILD value and other displacement parameters of the foam member 137. The depression forces $F_{x1,y}$ and $F_{x2,y}$ are transferred through the foam member 137 to foam member 138. The depression forces $F_{x1,y}$ and $F_{x2,y}$ cause a compression of the foam member 138 with a small vertical displacement that tends to be distributed over a displacement width L2 that is large relative to L1. FIG. 26 demonstrates the characteristic that when two foam members of different ILD value and other displacement parameters are stacked vertically to respond to an external force such as a reclined body part, the resulting compression is a complex interaction of the different materials. Note that in FIG. 26 most of the vertical compression occurred in a local area of the top higher ILD value foam member 137. The compression, D5, of the lower ILD value foam member 138 in FIG. 26 is greater than the compression of the higher ILD value member 136 in FIG. 25.

FIG. 23 through FIG. 26 indicate that the interaction of multiple layers of foams or foam regions with different compression parameters are complex so that great care must be exercised in selecting foams in order to achieve a mattress capable of both maintaining a reclining body in alignment and by supporting a reclining body with low body pressure. Foams with different compression parameters can be achieved in many ways including selecting foams having native parameters as manufactured or by structurally modifying foams from their native structure after manufacture to arrive at the desired compression parameters.

FIG. 27 depicts an isometric view of a convolute material 27-1 which is used in one embodiment of a mattress core, for example, as the M3 material for layer 11-3 in FIG. 2 through FIG. 20 where shown, for example. The convolute material 27-1 is formed, in one manufacturing example, by first forming a native foam layer of uniform thickness with native compression parameters as manufactured. Thereafter, the uniform foam layer is compressed and passed through opposing rollers or belts that have "knives" or other cutting edges that cut the foam layer in a pattern. The technology is known commercially as "Surface Modification Technology" or "SMT". In general, the commercially available SMT technology has been limited to surface modifications which have modified the displacement parameters of a top layer of a mattress, or a mattress top that is placed on top of a mattress. Surface modifications alone, however, have not adequately provided for mattresses with both low surface pressure and body alignment.

In general, the convolute pattern of FIG. 27 is characterized by sinusoidal patterns in the X-axis and Y-axis directions and by a sinusoidal pattern on the 45 degree diagonal, $X_{45}$-axis, between the orthogonal X-axis and Y-axis.

FIG. 28 depicts the sinusoidal patterns in the X-axis and Y-axis directions of the convolute material 27-1 of FIG. 27. The overall thickness of the layer 27-1 is of FIG. 27 is $T_{27}$ and the maximum peak-to-valley height is $A_0$ with peak spacing, $P_0$. In one example of a conventional SMT material, $T_{27}$ is 4 inches and $A_0$ is 1 inch. For greater structural modification ("SM"), $T_{27}$ is 4 inches and $A_0$ is 3 inches.

FIG. 29 depicts the sinusoidal patterns in the $X_{45}$-axis direction of the convolute material 27-1 of FIG. 27. The overall thickness of the layer 27-1 is of FIG. 27 is $T_{27}$ and the maximum peak-to-valley height is $A_{45}$. In one example of a conventional SMT material, $T_{27}$ is 4 inches and $A_{45}$ is ¾ inch. For greater structural modification ("SM"), $T_{27}$ is 4 inches and $A_{45}$ is 2.5 inches.

FIG. 30 depicts a stack of layers L0, L1, L2, L3 and L4 formed of foam members 28-0, 28-1, 28-2, 28-3 and 28-4, respectively, which have different compression parameters. In one example, the layers L0, L1, L2, L3 and L4 of FIG. 30 correspond to the cover 3 (L0), member 11-3 (L1), member 11-4 (L2), member 11-5 (L3) and member 11-7$_1$ (L4) in FIG. 11 and FIG. 12. In one example, the L0 cover 3 is formed on the outside of a stretch blend fabric (for example, 65% cotton and 35% polyester) available from Burlington House as Style 50317. The stretch blend fabric surrounds a 1.5 pound foam having an ILD of about 15 and which is ventilated with holes on 1.5 cm spacing.

FIG. 31 depicts compression parameters, CP, as a function of displacement, D, for the stack of layers L0, L1, L2, L3 and L4 of FIG. 29. When depression forces $F_{x1,y}$ and $F_{x2,y}$, such as shown in FIG. 26, are applied to the stack of layers, each of the layers undergoes a different displacement as a function of the compression parameters, P, for the layers in the stack. In one example, the parameters are as shown in the following TABLE 4.

TABLE 4

| Member | L0 | L-1 | L-2 | L-3 | L-4 |
|---|---|---|---|---|---|
| Material Type | 1.5# | $Res_{conv}$ | $Res_{conv}$ | Res | Ref |
| ILD | 5 | 32 | 28 | 15 | 40 |
| Thickness(Z) | 1.5 in | 2 in | 2 in | 4 in | 2 in |

In FIG. 31, if the compression parameter is ILD, then the displacements for layers L0, L1, L2, L3 and L4 are d0, d1, d2, d3 and d4. Note that other than for layer L0 abd L4, each of the layers compresses to about 50% of its original thickness. The layer L0 is the very soft cover layer which is completely compressed and the layer L4 is the very firm bottom support layer which compresses less than about 10%. By having the firmer layers L1 and L2 over the softer layer L3, each of the layers L1, L2 and L3 tends to function in the intended operating range (generally less than about 50% compression) where near linear compression occurs without the high tension associated with membrane-like responses. For the same amount of compression and similar thicknesses, if the softer layers are placed above the firmer layers, then the softer layers tend to be compressed more than 50% and thus tend to function as membranes that impart a hard feeling to the mattress stack. The L0 layer is made from a stretch fabric which yields under compression without imparting a hard tension feeling and hence, layer L0 is generally ignored for most purposes in the mattress design. Also, the L4 layer is at the bottom and functions as a structural support layer for the other layers and is not intended to contribute significantly to the desired soft feeling as a result of reclining body compression. In FIG. 30, the layers L1, L2 and L3 are the principal functioning layers for imparting a soft feeling as a result of reclining body compression of the mattress. The use of firmer foams over softer foams allows the thickness of the layers in a stack to be minimized while maintaining a soft feeling. Of course, other structural combinations can be employed. For example, a softer foam of greater thickness can be used over a firmer foam while still avoiding the high-tension membrane effect of the softer foam provided the thickness of the softer foam is large enough to allow the softer foam to remain in the intended near linear operating range (less than about 50% compression). The use of thicker foams is generally to be avoided where possible since the thicker the foams, generally, the more expensive the mattress and the higher (Z-axis) the mattress height. Whatever the combination of materials selected for a stack, the important condition is that the membrane effect resulting from over compression be avoided. The membrane effect is avoided by selecting the compression parameters such that each layer contributes without exceeding the membrane threshold. For minimizing foam thickness and hence mattress cost, the firm-over-soft principal is particularly useful. Mattress cores that exhibit compression parameters that provide uniform low body pressure on a reclining body while also contributing to good body alignment of the reclining body have special requirements. To achieve uniform low pressure on a reclining body, the accumulated displacement parameters, DP(x), for the mattress members under each small segment x along the X-axis of the interface between the body and the mattress must establish the desired low pressure for the supporting pressure applied to the body. Supporting forces are supplied from the bottom of the mattress to the top of the mattress where each lower member transmits the supporting forces to a higher member in a vertical stack of members as a function of the displacement parameters of the members in the stack. The mattress members collectively have different combined displacement parameters, DP(x), that exist at any X-axis coordinate, dx, (as seen in FIG. 21 for example). The supporting force, $SF_Z(x)$, produced by the mattress at coordinate, dx, is a function of the displacement parameters, DP(x), of the mattress at dx and the vertical displacement of the mattress in the Z-axis direction determined by the body profile $E_Z$ at dx. The supporting force, $SF_Z(x)$, is given by $SF_Z(x)=E_Z(x)\cdot DP(x)$. The objective of the mattress is to have the supporting force $SF_Z(x)$ below a softness threshold which ideally is the ischemic pressure threshold.

While the above description has focused on the X-axis properties, similar considerations apply in the Y-axis direction. The mattress members collectively have different combined displacement parameters, DP(y), that exist at any Y-axis coordinate, dy. The supporting force, $SF_Z(y)$, produced by the mattress at coordinate, dy, is a function of the displacement parameters, DP(y), of the mattress at dy and the vertical displacement of the mattress in the Z-axis direction determined by the body profile $E_Z(y)$ at dy. The supporting force, $SF_Z$, is given by $SF_Z(y)=E_Z(y)\cdot DP(y)$. The objective of the mattress is to have the supporting force $SF_Z(y)$ below a softness threshold which ideally is the ischemic pressure threshold.

The displacement parameters and body profiles are functions of both the X-axis and Y-axis coordinates, so that combined displacement parameters, DP(x,y) and the combined body profile $E_Z(x,y)$ yields the combined supporting force $SF_Z(x,y)$ where $SF_Z(x,y)=E_Z(x,y)\cdot DP(x,y)$.

In order to provide layers of material with suitable compression parameters, various modifications to native foam layers in addition to those described are available and some of those are described in connection with the following figures.

In FIG. 32, a foam layer 32-1 of thickness $T_{32}$ is structurally modified with holes 32-2. The holes 32-2 are arrayed in a regular pattern with a 1 inch diameter and with a 1 inch spacing between hole edges. Of course, the hole diameters may be different and the hole pitch may be different. Similarly, the holes as shown have a circular cross section, but oval, elliptical and other cross sections are included in alternate embodiments. The important criteria to be recognized is that the native displacement parameters of a foam or other material can be structurally modified with wide latitude by removal of material in any combination of the X axis, Y axis and Z axis directions.

In FIG. 33, the holes 32-2 of a row taken along section line 33–33' are arrayed in a regular pattern with 1 inch diameters and with 1 inch spacing between hole edges. The holes 32-2 extend through the entire thickness $T_{32}$ of the layer, but in alternate embodiments, the depth of the holes is less than thickness $T_{32}$ so that some or all of the holes do not pass through the entire layer.

In FIG. 34, a foam layer 34-1 of thickness $T_{34}$ is structurally modified with slits 34-2. The slits 34-2 are arrayed in a regular pattern with a 1.5 inch length and with a 1.5 inch spacing between slits. The slits 34-2 are arrayed in a regular pattern extending in the Y axis direction with a regular spacing between slits in the X axis direction. Of course, the slit direction, the slit length and the slit pitch may be different. Similarly, multiple overlapping slits of any slit direction, slit length and slit pitch are included in alternate embodiments. The important criteria to be recognized is that the native displacement parameters of a foam or other material can be structurally modified with wide latitude by removal of material or inclusion of slots in any combination of the X axis, Y axis and Z axis directions.

In FIG. 35, the slits 34-2 of a row taken along section line 35–35' are arrayed in a regular pattern with 1.5 inch spacing between slits that extent from the top to the bottom of the layer. The slits 34-2 extend through the entire thickness $T_{34}$ of the layer, but in alternate embodiments, the depth of the slits or any portion of them is less than the thickness $T_{34}$ so that some or all of the slits do not pass through the entire layer.

In FIG. 36, foam layers 36-1 and 36'-1 are structurally modified with slots 36-2 and 36'-2. The slots 36-2 and 36'-2 are arrayed in a parallel pattern in the Y-axis direction with variable depth in the X-axis direction. The deeper slots near the center of each of the layers 36-1 and 36'-1 significantly modify the effective ILD of the FIG. 36 two-layer stack in a non-linear manner in the X-axis direction.

In FIG. 37, foam layers 37-1 and 37'-1 are structurally modified with slots 37-2 and 37'-2. The slots 37-2 and 37'-2 are arrayed in a parallel pattern in the Y-axis direction with variable depth in the X-axis direction. The deeper slots near the center of each of the layers 37-1 and 37'-1 significantly modify the effective ILD of the FIG. 37 two-layer stack in a non-linear manner in the X-axis direction. The FIG. 37 stack has the bottom layer 37'-1 inverted relative to the top layer 37-1. The stack of FIG. 37 is similar to the stack of FIG. 36 but the FIG. 37 stack has a greater tensioning effect since the unmodified portion of the bottom layer 37'-1 is closer to the top.

In FIG. 38, foam layer 38-1 is structurally modified with slots 38-2 and 38'-2 on the top and bottom surfaces of a single foam layer. The slots 38-2 and 38'-2 are arrayed in a parallel pattern in the Y-axis direction with variable depth in the X-axis direction. The deeper slots near the center of the layer 38-1 significantly modify the effective ILD of the FIG. 38 stack in a non-linear manner in the X-axis direction. The FIG. 38 stack has the bottom portion inverted relative to the top portion. The stack of FIG. 38 is similar to the stack of FIG. 36 but the FIG. 38 stack has a greater tensioning effect since the unmodified portion of the bottom portion is closer to the top.

In FIG. 39, a foam layer 39-1 is structurally modified with cone-shaped holes 39-2. The holes 39-2 are arrayed in a regular pattern with, for example, with a 1 inch diameter and with a 1 inch spacing between hole edges at the top surface.

In FIG. 40, the holes 39-2 of a row taken along section line 40–40' of FIG. 39 are arrayed in a regular pattern with 1 inch diameters and with 1 inch spacing between hole edges in the X-axis direction. The foam layer 39-1 of FIG. 39 when compared with the convolute foam layer 27-1 of FIG. 7 reduces the ILD by an amount that is less relative to the uniform layer of foam that existed prior to structural modification.

In FIG. 41, a front view is shown of a foam layer 41-1 that is structurally modified from the top surface with cone-shaped holes 41-2, 41-3 and 41-4 in a top portion 41-1$_T$ of the foam layer 41-1 and from the bottom surface with cone-shaped holes 41-5 and 41-6 with a cavity for a lift 12 between the holes 41-5 and 41-6 in a bottom portion 41-1$_B$ of the foam layer 41-1. The holes 41-3 above the lift 12 in the waist region are shorter than the holes 41-2 in the shoulder region and the holes 41-4 in the leg region so that the effective ILD of layer 41-1 for a waist region of a mattress is appropriately designed for a reclining body. In one embodiment, the layer 41-1 is 45 inches long in the X-axis direction and has holes 41 that extend over about 37 inches in the X-axis direction. The 37 inches of holes in the X-axis direction are manufactured using a cutting roller assembly having a 12 inch diameter, which is a common size employed for surface modification of foams. The holes 41-2 and 41-5 extend for 14 inches in the X-axis direction. The lift 12 and the holes 41-3 extend for 6 inches in the X-axis direction. The holes 41-4 and 41-6 extend for 17 inches in the X-axis direction. The embodiment of FIG. 41 represents a single piece construction of a foam member with variable ILD in the X-axis direction where the ILD varies in a manner that follows the variation of a reclining body on a mattress. The lift 12 is located in a cavity 12-1 between the holes 41-5 and 41-6.

In FIG. 42, an isometric view is shown of the top portion 41-1$_T$ of the foam layer 41-1 of FIG. 41.

In FIG. 43, an isometric view is shown of the bottom portion 41-1$_B$ of the foam layer 41-1 of FIG. 41.

In FIG. 44, an isometric view is shown of a foam layer 41-1 of FIG. 41 that is structurally modified from the top surface with cone-shaped holes 41-2, 41-3 and 41-4 in the top portion 41-1$_T$ of the foam layer 41-1 and from the bottom surface with cone-shaped holes 41-5 and 41-6 with a cavity for a lift 12 between the holes 41-5 and 41-6 in a bottom portion 41-1$_B$ of the foam layer 41-1.

In FIG. 45, a front view of a mattress core 1$_{45}$ is shown that includes the foam layer 41-1 of FIG. 41 and is similar to the mattress core of FIG. 5. The mattress core 1$_{45}$ has head member 11-1 formed of an M1 material, a neck-to-leg region using the foam layer 11-10 formed of an MG material and a lower leg and foot member 11-7$_3$ formed of an M7 material. The head member 11-1 is over a head member 11-2 formed of an M2 material. A longitudinal slot 15$_S$ is near the shoulder region. The slot 15$_S$ provides a shoulder-relief feature that facilitates a large displacement difference that occurs between the neck and shoulder regions of the mattress when a reclining body is on the mattress, particularly when the body is in a side-lying position. The lift 12 is adjustable to help establish body alignment of a reclining body. The foam layer 11-10 is manufactured from an MG material that establishes the base ILD and other base compression parameters. The structural modification of the MG material with cone-shaped holes 45 establishes variable compression parameters in the X-axis direction that tend to match the displacement of the mattress core caused by reclining bodies. Specifically, the holes 45-2, 45-3 and 45-4 are present in the top of the core member 11-10 and the holes 45-5 and 45-6 are present in the bottom of the core member 11-10. In the top $\mathbf{45}_T$, the holes 45-2 and 45-4 are deeper than the holes 45-3., the holes 45-2 and 45-4 are deeper than the holes 45-3. In the bottom $\mathbf{45}_B$, the holes 45-5 and 45-6 are deeper than the holes 45-2, 45-3 and 45-4 in the top $\mathbf{45}_T$.

FIG. 46 depicts a top view of the mattress core $\mathbf{1}_{45}$ of FIG. 45 taken along the section line 46–46' of FIG. 45. The mattress core $\mathbf{1}_{45}$ has a head member 11-2 formed of an M2 material, neck-to-foot members 11-10 formed of an MG material including member $\mathbf{11\text{-}10}_L$ on the left and member 11-1 OR on the right, and a lower leg and foot member $\mathbf{11\text{-}7}_3$ formed of an M7 material. The members $\mathbf{11\text{-}10}_L$ and $\mathbf{11\text{-}10}_R$ and the members $\mathbf{11\text{-}10}_L$ and $\mathbf{11\text{-}10}_R$ are separated by longitudinal slots $\mathbf{15}_{M5}$ slots $\mathbf{15}_{M5}$, respectively, which help provide isolation between the left and right sides of the mattress core $\mathbf{1}_{45}$. Also, a longitudinal slot $\mathbf{15}_S$ near the shoulder region extends between the left side member $\mathbf{11\text{-}7}_{4L}$ and the right side member $\mathbf{11\text{-}7}_{4R}$ formed of an M7 material. The slot $\mathbf{15}_S$ provides a shoulder-relief feature that facilitates a large displacement difference that occurs between the neck and shoulder regions of the mattress when a reclining body is on the mattress, particularly in the side-lying position. The left member $\mathbf{11\text{-}10}_L$ includes the tension relieving slots $\mathbf{13\text{-}1}_L$, $\mathbf{13\text{-}2}_L$ and $\mathbf{13\text{-}3}_L$ and the right member $\mathbf{11\text{-}10}_R$ includes the tension relieving slots $\mathbf{13\text{-}1}_R$, $\mathbf{13\text{-}2}_R$ and $\mathbf{13\text{-}3}_R$. The slots $\mathbf{13\text{-}2}_L$ and $\mathbf{13\text{-}3}_L$ are about 10 inches apart and spaced 7.25 inches from the left side member $\mathbf{11\text{-}7}_{4L}$ and the center slot $\mathbf{15}_M$, respectively. The slots $\mathbf{13\text{-}3}_R$ and $\mathbf{13\text{-}2}_R$ are about 10 inches apart and spaced 7.25 inches from the right side member $\mathbf{11\text{-}7}_{4R}$ and the center slot $\mathbf{15}_M$, respectively.

One embodiment of the mattress core $\mathbf{1}_{45}$ of FIG. 45 and FIG. 46 has the measurements and displacement parameters established using the materials and dimensions as shown in the following TABLE 5.

TABLE 5

| Member | 11-1 | 11-10L | 11-10R | $11\text{-}7_1$ | $11\text{-}7_2$ | $11\text{-}7_3$ |
|---|---|---|---|---|---|---|
| Material | M1 | MG | MG | M7 | M7 | M7 |
| Type | Ref | Res | Res | $Ref_{40}$ | $Ref_{40}$ | $Ref_{40}$ |
| ILD | 6 | Variable | Variable | 40 | 40 | 40 |
| Thickness-Z | 4 in | 2 in | 2 in | 2 in | 4 in | 8 in |
| Length-X | 13 in | 45 in | 45 in | 80 in | 13 in | 22 in |
| Width-Y | 50 in | 24.5 in | 24.5 in | 60 in | 50 in | 50 in |

FIG. 47 depicts a side view of the mattress core $\mathbf{1}_{45}$ of FIG. 45 and FIG. 46 with a male body 35 reclining on his side. The depression of the mattress core $\mathbf{1}_{45}$ follows the curvature of the body 35. The body 35 contacts the mattress core $\mathbf{1}_{45}$ through a cover (not shown). The mattress core $\mathbf{1}_{45}$ includes a $1^{ST}$ region, a $2^{ND}$ region and a $3^{RD}$ region where the regions function to support and distribute the weight of the body for body alignment and low body surface pressure. The bottom layer $\mathbf{11\text{-}7}_1$ extends across the $1^{ST}$ region, a $2^{ND}$ region and a $3^{RD}$ region and is typically formed of an M7 material that provides a uniform base for the mattress core. The $1^{ST}$ region includes a first part $1^{ST}$-2 for the head and a second part $1^{ST}$-2 for the shoulder. The $3^{RD}$ region includes a first part $3^{RD}$-1 for the hips and a second part $3^{RD}$-2 for the lower legs and feet.

In the first part $1^{ST}$-1 of the $1^{ST}$ region, the head section includes the foam members 11-1 and 11-2 for supporting the head part of reclining body 35. The foam members 11-1 and 11-2 undergo only a small compression and provide appropriate displacement parameters for the head part of the side-lying male body 35. In the second part $1^{ST}$-2 of the $1^{ST}$ region, the central core section 11-10, like the foam layer 45-1 of FIG. 45, is structurally modified from the top surface with cone-shaped holes 45-2 and from the bottom surface with cone-shaped holes 45-5. The holes 45-5 are deeper than the holes 45-2 whereby the effective ILD of the material around the holes 45-2 is greater than the effective ILD of the material around the holes 45-5. Together the holes 45-5 and holes 45-2 and surrounding material provide a composite displacement parameter in the second part $1^{ST}$-2 suitable for a large compression caused by the shoulder of a reclining body. The layer 11-10 in the second part $1^{ST}$-2 undergoes substantial compression in response to the shoulder of the reclining body 35 and the displacement parameters accommodate the shoulder part of the side-lying male body 35 with low surface body pressure. The bottom layer $\mathbf{11\text{-}7}_1$ of the core $\mathbf{1}_{45}$ is typically formed of an M7 material that provides a uniform base.

Between the first part $1^{ST}$-1 of the $1^{ST}$ region and the second part $1^{ST}$-2 of the $1^{ST}$ region, the shoulder gap $\mathbf{15}_s$ is present to establish tension relief between the first and second parts of the first region. This tension relief (tension release feature) is provided by a break, gap or other separation between the materials of the first part $1^{ST}$-1 and the materials of the second part $1^{ST}$-2 of the $1^{ST}$ region. The materials of the second part $1^{ST}$-2 of the core $\mathbf{1}_{45}$ are able to compress without tension from the materials of the first part $1^{ST}$-1.

In the $2^{ND}$ region, a cavity 12-1 in the foam layer 11-10 is present for a lift 12 located between the material having holes 45-5 and 45-6. The holes 45-3 above the lift 12 in the waist region are shorter than the holes 45-2 in the shoulder region and the holes 45-4 in the hip region. The effective ILD of layer 11-10 for the waist region of a mattress is appropriately designed for a reclining body where less depression occurs in the waist region. Adjustment of the height (Z-axis) of the lift 12 allows the layer 11-10 to be tuned to each different reclining body.

In the first part $3^{RD}$-1 of the $3^{RD}$ region, the central core section 11-10 is structurally modified from the top surface with cone-shaped holes 45-4 and from the bottom surface with cone-shaped holes 45-6. The holes 45-6 are deeper than the holes 45-4 whereby the effective ILD of the material around the holes 45-4 is greater than the effective ILD of the material around the holes 45-6. Together the holes 45-4 and holes 45-6 and surrounding material provide a composite displacement parameter in the first part $3^{RD}$-1 suitable for a compression caused by the hips of a reclining body. The layer 11-10 in the first part $3^{RD}$-1 undergoes substantial compression in response to the hips of the reclining body 35 and the displacement parameters accommodate the hip part of the side-lying male body 35 with low surface body pressure.

In the second part $3^{RD}$-2 of the $3^{RD}$ region, the foot section includes the foam member $\mathbf{11\text{-}7}_3$ for supporting the lower leg and foot part of reclining body 35. The foam member $\mathbf{11\text{-}7}_3$ undergoes only a small compression and provides appropriate displacement parameters for the lower leg and foot part of the side-lying male body 35.

In FIG. 47, the shoulders have an alignment line $\mathbf{17}_{47}$-1, the waist has an alignment line $\mathbf{17}_{47}$-2, the hips have an alignment line $\mathbf{17}_{47}$-3, the legs have an alignment line $\mathbf{17}_{47}$-4 and the spine has a spline alignment line $\mathbf{18}_{47}$. In FIG. 47, the waist of the body is supported to be straight so the spine alignment line $\mathbf{18}_{47}$ is straight. Surface pressures $T_1$, $T_2$, $T_3$ and $T_4$, measured at the shoulder alignment line $\mathbf{17}_{47}$-1, the waist alignment line $\mathbf{17}_{47}$-2, the hip alignment line $\mathbf{17}_{47}$-3 and the leg alignment line $\mathbf{17}_{47}$-4, respectively, are typically low and below a low pressure threshold. For a tuned bed made of properly selected foams and other materials, the low pressure threshold is below the ischemic pressure of about 30 mmHg.

In FIG. 48, a front view is shown of a mattress core $\mathbf{1}_{48}$ that is an alternate embodiment of the core $\mathbf{1}_{45}$ of FIG. 47. The foam layer 11-10$_1$ is structurally modified from the top surface with uniformly sized cone-shaped holes 48-2, 48-3 and 48-4 in a top portion of the foam layer 48-1 and from the bottom surface with non-uniformly sized cone-shaped holes 48-5 and 48-6 including, for example, holes 48-5$_1$, 48-5$_2$ and 48-6$_1$ and 48-6$_2$. A cavity 12-1 for a lift 12 is present between the holes 48-5 and 48-6 in a bottom portion of the foam layer 11-10$_1$. The holes 48-3 above the lift 12 in the waist region are generally shorter than the holes 48-2 in the shoulder region and the holes 48-4 in the leg region so that the effective ILD of layer 48-1 for a waist region of a mattress is appropriately designed for a reclining body. The foam member 11$\hat{}$-1, in cross section, has the shape of a trapezoid to form, in cross section, a triangular shaped gap 15$\hat{}_S$. The gap 15$\hat{}_S$ accentuates the tension relief (tension release feature) between the materials of the first part $1^{ST}$-1 and the materials of the second part $1^{ST}$-2 of the $1^{ST}$ region. In compression from the shoulder of a reclining body, layer 11-10$_1$ in the vicinity of holes 48-2 and 48-5$_1$ easily expands into the gap 15$\hat{}_S$. In FIG. 48, the holes 48-5$_1$, 48-5$_2$ and 48-6$_1$ and 48-6$_2$ are generally of different sizes and depths that correlate to the curvature of the reclining body 35 and thus enable careful matching of the core parameters to the reclining body profile.

FIG. 49 depicts a side view of a mattress core $\mathbf{1}_{49}$ which is an alternate embodiment of mattress core $\mathbf{1}_{45}$ of FIG. 45, FIG. 46 and FIG. 47 with a male body 35 reclining on his side. The mattress core $\mathbf{1}_{49}$ differs from the mattress core $\mathbf{1}_{45}$ in that the first part $1^{ST}$-1 of the $1^{ST}$ region is formed of M1 layers 11'-2 and 11'-22 and an M7 layer 11'-7$_2$. In effect, the M7 layer of FIG. 47 has been split in two parts with the part closest to slot 15$_S$ replace with a softer M1 layer. Additionally, in FIG. 49, the mattress core $\mathbf{1}_{49}$ rests on a 6 inch high (Z axis) inner spring foundation 19. Because the inner spring 19 is compressed under the load of the reclining body 35 and exhibits its own displacement parameters, the displacement parameters of the mattress core $\mathbf{1}_{49}$ are modified relative to core $\mathbf{1}_{45}$ in FIG. 47 so that the combined displacement parameters of the mattress core and spring of FIG. 49 are approximately the same as the core $\mathbf{1}_{45}$ alone in FIG. 47. For instance, for the same straight body alignment in FIG. 49, the lift 12 is inflated more to provide a greater Z-axis lift to compensate for the downward deflection of the spring 19. Further, the depth of the holes in the core 11-10$_2$ are reduced to compensate for the deflection of spring 19.

FIG. 50 depicts a side view of a mattress core $\mathbf{1}_{50}$, which is an alternate embodiment of mattress core $\mathbf{1}_{45}$ of FIG. 47, with a male body 35 reclining on his side. The mattress core $\mathbf{1}_{50}$ differs from the mattress core $\mathbf{1}_{45}$ in that the lift 12 is not present and the core layer 11"-10 and is replaced with cone-shaped holes 50-5$_2$ on the bottom in the waist region. The cone-shaped holes 50-2 on the top are above the cone-shaped holes 50-52 on the bottom and each are relatively short and to leave a relatively thick portion of the core layer 11"-10 that functions in a manner similar to lift 12 in FIG. 47 to provide a greater vertical displacement in the waist region.

FIG. 51 depicts a side view of a mattress core member 51-1 formed of a single layer of foam with top and bottom structural modification. The core member 51-1 is suitable, for example, as an alternative to the core layer 11"-10 of FIG. 50 in the mattress core $\mathbf{1}_{50}$. The core member 51-1 includes cone-shaped peaks 51-2 on the top of uniform height (measured in the Z axis). The core member 51-1 includes cone-shaped peaks 51-5 including peaks 51-5$_1$, 51-5$_2$, and 51-5$_3$ on the bottom of varying height (measured in the Z axis). The core member 51-1 when used as part of a mattress core extends over a $1^{ST}$ region, a $2^{ND}$ region and a $3^{RD}$ region where the regions function to support and distribute the weight of the body for body alignment and low body surface pressure. The $1^{ST}$ region includes a second part $1^{ST}$-2 for the shoulder with the peaks 51-5, the $2^{ND}$ region with the peaks 51-52 is for the waist and the $3^{RD}$ region includes a first part $3^{RD}$-1 with the peaks 51-5$_3$ for the hips. The structural modification of the core member 51-1 achieved by the cone-shaped peaks 51-2 on the top and the by the cone-shaped peaks 51-5 on the bottom provides a integrated single-piece mattress core member having variable displacement parameters that match the displacement profile of a reclining body on a mattress that includes mattress core member.

FIG. 52 depicts an isometric view of the mattress core member 51-1 of FIG. 51. The core member 51-1, for example, measurers 45 inches (X axis) by 25 inches (Y axis) by 8 inches (Z axis). The core member 51-1 is suitable for use for each of the members 11-10R and 11-10L of FIG. 26.

In FIG. 53, a front view of a mattress core is shown that is an alternate embodiment of the mattress core of FIG. 50. In FIG. 53, a front view of a mattress core $\mathbf{1}_{53}$ is shown that includes the foam layer 11-10$_{53}$. The foam layer 11-10$_{53}$ is manufactured from a material that establishes the base ILD and other base compression parameters. The structural modification of the base material with cone-shaped holes 53 establishes variable compression parameters in the X-axis direction that tend to match the displacement of the mattress core caused by reclining bodies. The mattress core $\mathbf{1}_{53}$ includes a $1^{ST}$ region, a $2^{ND}$ region and a $3^{RD}$ region where the regions function to support and distribute the weight of the body for body alignment and low body surface pressure. A layer 11-7$_1$, typically formed of an M7 material, and a spring member 19 extend across the $1^{ST}$ region, a $2^{ND}$ region and a $3^{RD}$ region to provide the mattress core with a uniform base. The $1^{ST}$ region includes a first part $1^{ST}$-1 for the head and a second part $1^{ST}$-2 for the shoulder. The $3^{RD}$ region includes a first part $3^{RD}$-1 for the hips and a second part $3^{RD}$-2 for the lower legs and feet.

In FIG. 53, the cone-shaped holes 53 including the holes 53-2, 53-3 and 53-4 are present in the top of the core member 11-10$_{53}$ and the holes 53-5, 53-6, 53-7, 53-8 and 53-9 are present in the bottom of the core member 11-10$_{53}$. In the top, the holes 53-2 and 53-4 are deeper than the holes 53-3. In the bottom, the holes 53-6 and 53-8 are deeper than the holes 53-5, 53-7 and 53-9. The structural modification of the core material of member 11-10$_{53}$ achieved by the cone-shaped holes 53 on the top and on the bottom provides a single-piece mattress core member 11-10$_{53}$ having variable displacement parameters that match the displacement profile of a reclining body on a mattress that includes the mattress core member. The single-piece mattress core member 11-10$_{53}$ measures 58 inches (X axis), symmetrical about 29 inch segments, by 8 inches (Y axis).

In FIG. 54, a front view of a mattress core is shown that is an alternate embodiment of the mattress core of FIG. 53. The mattress core 1$_{54}$ includes two identical foam layers 11-10$_{54}$, namely the foam layers 11-10$_{54}$-1 and 11-10$_{54}$-2. The foam layers 11-10$_{54}$ are each manufactured from a material that establishes the base ILD and other base compression parameters. The structural modification of the base material with cone-shaped holes 54 establishes variable compression parameters in the X-axis direction that tend to match the displacement of the mattress core caused by reclining bodies. The mattress core 1$_{54}$ includes a $1^{ST}$ region, a $2^{ND}$ region and a $3^{RD}$ region where the regions function to support and distribute the weight of the body for body alignment and low body surface pressure. A layer 11-7$_1$, typically formed of an M7 material, and a spring member 19 extend across the $1^{ST}$ region, a $2^{ND}$ region and a $3^{RD}$ region to provide the mattress core with a uniform base. The $1^{ST}$ region includes a first part $1^{ST}$-1 for the head and a second part $1^{ST}$-2 for the shoulder. The $3^{RD}$ region includes a first part $3^{RD}$-1 for the hips and a second part $3^{RD}$-2 for the lower legs and feet.

In FIG. 54, the cone-shaped holes 54 including the holes 54$_1$-2, 54$_1$-3, 54$_1$-4 and 54$_1$-4 are present in the top of the core member 11-10$_{54}$ and the holes 54$_1$-5, 54$_1$-6, and 54$_1$-7 are present in the bottom of the core member 1'-10$_{54}$. In the top, the holes 54$_1$-2 and 54$_1$-4 are deeper than the holes 54$_1$-3. In the bottom, the holes 54$_1$-5 and 54$_1$-7 are deeper than the holes 54$_1$-6. The holes 54$_1$-5 and 54$_1$-7 have varying heights (Z axis). The structural modification of the core material of member 11-10$_{54}$ achieved by the cone-shaped holes 54 on the top and on the bottom provides a single-piece mattress core member 11-10$_{54}$ having variable displacement parameters that match the displacement profile of a reclining body on a mattress that includes the mattress core member. The mattress core members 11-10$_{54}$ measure 53 inches and foam layer 11-10$_{54}$-2 on the bottom is inverted relative to the foam layer s11-10$_{54}$-1 on the top so that holes on the bottom are aligned with holes on the top. For example, the holes 54$_1$-6 on the top are juxtaposed the holes 54$_2$-6 on the bottom. The mattress core members 11-10$_{54}$ each measures 53 inches (X axis) by 4 inches (Y axis). The mattress core members 11-10$_{54}$ fit between a 1 inch (X axis) head member 11-2 and a 32 inch (X axis) foot member 11-7$_3$ each 8 inches high (Y axis).

FIG. 55 depicts an isometric view of a hexagonal material 55-1 which is used for foam layers in embodiments of mattress cores. The hexagonal material 55-1 is formed, in one manufacturing example, by first selecting a foam layer of uniform thickness and uniform displacement parameters. The uniform foam layer is compressed by passage through opposing rollers or belts that feed to "knives" or other cutting edges for cutting the foam layer. The technology for such cutting is known commercially as "Surface Modification Technology" or "SMT". In general, the commercially available SMT has been limited to uniform surface modifications which do not adequately modify the displacement parameters of foam layers to achieve body alignment and low body surface pressure in mattresses. Commercially available SMT has been primarily directed to ornamental appearance. In order to more effectively modify the displacement parameters of foam layers, Structural Modification ("SM") technology is employed where SM technology typically is characterized by deep penetration of cuts from a foam surface into or through a foam layer, varying cut depths for a foam layer, varying cut types for a foam layer and other variations leading to varying displacement parameters in the foam layer as a function of position. The varying displacement parameters are correlated to the variation in depression caused by a reclining person on a mattress. In FIG. 55, the material 55-1 has rows of hexagonal peaks 55-2 with alternate rows in the X-axis and Y-axis directions offset from each other.

In FIG. 56, a top view of a section of the hexagonal material 55-1 of FIG. 55 is shown where the peaks have a center-to-center spacing $P_C$, a spacing between peaks $P_S$ and a peak size $P_P$ and where alternate rows are offset from each other.

In FIG. 57, a sectional view through a row of peaks in the X-axis or Y-axis direction of the hexagonal material of FIG. 55 is shown. The spacing between hexagonal peaks 55-2 for layer 55-1 is characterized by sinusoidal patterns in the X-axis and Y-axis directions where the peaks have a center-to-center spacing $P_C$, a spacing between peaks $P_S$ and a peak size $P_P$. The overall thickness of the material 55-1 of FIG. 55 and FIG. 57 is $T_{55}$ and the maximum peak-to-valley height, $A_{55}$, in the X axis direction or in the Y axis direction is $A_{55}$. In one example, $T_{55}$ is 4 inches, $A_{55}$ is 3 inches, $P_C$ is 2 inches, $P_S$ is 1 inch and $P_P$ is 1.25 inches. With such dimensions, one example of a base material originally uniformly 4 inch thick with an original ILD of 32 has an effective ILD of about 15 after the structural modification. Of course, the other displacement parameters of the original material are similarly modified as a result of the structural modification. A wide variation of changes to the displacement parameters is a achieved by varying the center-to-center spacing $P_C$, spacing between peaks $P_S$, peak size $P_P$, thickness $T_{55}$ and peak-to-valley height, $A_{55}$.

In FIG. 58, a top view of a section of the hexagonal material 55-1 of FIG. 55 is shown with an alternate layout to the pattern of FIG. 56 where the peaks have a center-to-center spacing $P_C$, a spacing between peaks $P_S$ and a peak size $P_P$ and where all rows are aligned with each other.

FIG. 59 depicts an isometric view of a dual layer hexagonal material similar to that of FIG. 55 but employing the aligned pattern of FIG. 58. In FIG. 59, the top layer 59-2$_T$ and the bottom layer 59-2$_B$ have, in one embodiment, the same center-to-center spacing $P_C$, spacing between peaks $P_S$ and peak size $P_P$ as the material 55-1 of FIG. 55. The thickness $T_{59\text{-}T}$ and peak-to-valley height, $A_{59\text{-}T}$ of the top layer are less than the thickness $T_{59\text{-}B}$ and peak-to-valley height $A_{59\text{-}B}$ of the bottom layer. In one embodiment, the thickness $T_{59\text{-}T}$ is 2 inches, the thickness $T_{59\text{-}B}$ is three inches, the peak-to-valley height $A_{59\text{-}T}$ is 1.25 inches and the peak-to-valley height $A_{59\text{-}B}$ is 2 inches.

FIG. 60 depicts a mattress 60-1 having a mattress cover 3$_{60}$ including a tape edge 16 around the upper edge of the mattress and including a lateral (Y axis) slot 15$_S$ that extends down into the mattress core and through an opening in the top of cover 3$_{60}$.

FIG. 61 depicts details of the slot structure in the region of the highlight circle 61 of FIG. 60. In FIG. 61, mattress cover 3$_{60}$ has tape edge 16 sewed or otherwise fastened around the edge of upper quilted fabric 61-1 of the mattress. The quilted fabric 61-1 is a stretch fabric which yields under compression without creating tension that would impart a hard feeling to the mattress. The fabric 61-1 includes an opening in the top of cover 3$_{60}$ revealing the lateral (Y axis) slot 15$_S$ that extends down into the mattress core. Within the mattress core, a pocket is formed by the fabric 61-2 which extends down on one side, extends backup on the other side and attaches to either side of and thus forms the opening for slot $15_S$. The depth of the pocket is approximately 6 inches. When the top fabric 61-1 is stretched under the force of a reclining body, the fabric 61-2 is free to provide slack for the top fabric 61-1 movement so as to avoid the buildup of tension forces in the top fabric 61-1. The FIG. 61 structure is located near the shoulder of a reclining body and hence is instrumental in providing tension relief (tension release feature) in a mattress.

FIG. 62 depicts details of the quilted fabric 61-1 of the mattress cover $3_{60}$ of FIG. 60 and FIG. 61. The quilted fabric 61-1 includes a quilted top material 62-1, a soft center 62-2 and a bottom material 62-3. Both the top material 62-1 and the bottom material 62-3 are a stretch fabric which yields under compression without creating tension. Similarly, the soft center 62-2 is a soft foam or other soft material which yields under compression without creating tension.

FIG. 63 depicts details of the slot structure in the region of the highlight circle 63 of FIG. 60. In FIG. 63, mattress cover $3_{63}$ has tape edge 16 sewed or otherwise fastened around the edge of upper quilted fabric 63-1 where upper quilted fabric 63-1 has parts $63\text{-}1_1$ and $63\text{-}1_2$ separated by a slot $15_{63}$. The mattress cover $3_{63}$ includes a foam layer 63-2 having parts $63\text{-}2_1$ and $63\text{-}2_2$ separated by the slot $15_{63}$. The mattress cover $3_{63}$ includes a bottom layer 63-3 extending under the quilted fabric 63-1 and across the bottom of the slot $15_{63}$. When the cover $3_{63}$ is stretched under the force of a reclining body, the cover $3_{63}$ is more free in the region of slot $15_{63}$ so as to avoid the buildup of tension forces in the mattress cover $3_{63}$. The FIG. 63 structure is located near the shoulder of a reclining body and hence is instrumental in providing tension relief (tension release feature) in a mattress.

FIG. 64 depicts details of an alternate slot structure in the region of the highlight circle 63 of FIG. 60. In FIG. 64, mattress cover $3_{64}$ has tape edge 16 sewed or otherwise fastened around the edge of upper quilted fabric 64-1. The mattress cover $3_{64}$ includes a foam layer 64-2 having parts $64\text{-}2_1$ and $64\text{-}2_2$ separated by a slot $15_{64}$. The mattress cover $3_{64}$ includes a bottom layer 64-3 extending under the quilted fabric 64-1 and having parts $64\text{-}3_1$ and $64\text{-}3_2$ separated by the slot $15_{64}$. When the cover $3_{64}$ is stretched under the force of a reclining body, the cover $3_{64}$ is more free in the region of slot $15_{64}$ so as to avoid the buildup of tension forces in the mattress cover $3_{64}$. The FIG. 64 structure is located near the shoulder of a reclining body and hence is instrumental in providing tension relief (tension release feature) in a mattress.

FIG. 65 depicts details of an alternate slot structure in the region of the highlight circle 63 of FIG. 60. In FIG. 65, mattress cover $3_{65}$ has tape edge 16 sewed or otherwise fastened around the edge of upper quilted fabric 65-1 having parts $65\text{-}1_1$ and $65\text{-}1_2$ separated by a slot $15_{65}$. The mattress cover $3_{65}$ includes a foam layer 65-2 having parts $65\text{-}2_1$ and $65\text{-}2_2$ separated by the slot $15_{65}$. The mattress cover $3_{65}$ includes a bottom layer 65-3 extending under the quilted fabric 65-1 and having parts $65\text{-}3_1$ and $65\text{-}3_2$ separated by the slot $15_{65}$.The mattress cover $3_{61}$ includes a bottom slot cover layer 65-4 extending under the bottom layer 65-3 and the slot $15_{65}$ to cover the slot $15_{65}$. When the cover $3_{65}$ is stretched under the force of a reclining body, the cover $3_{65}$ is more free in the region of slot $15_{65}$ so as to avoid the buildup of tension forces in the mattress cover $3_{65}$. The FIG. 65 structure is located near the shoulder of a reclining body and hence is instrumental in providing tension relief (tension release feature) in a mattress.

FIG. 66 depicts details of an alternate layer 66-4 for replacing the bottom layer 65-4 in FIG. 65. In FIG. 66, the layer 66-4 has two flat portions $66\text{-}4_1$ and $66\text{-}4_2$ that fit below the layer parts parts $65\text{-}3_1$ and $65\text{-}3_2$ in FIG. 65. The layer 66-4 has additional folded portions $66\text{-}4_3$, $66\text{-}4_4$, $66\text{-}4_5$ and $66\text{-}4_6$ that fold under and hence cover the slot $15_{65}$.When the cover $3_{65}$ is stretched under the force of a reclining body, the cover $3_{65}$ is more free in the region of slot $15_{65}$ with the folded structure of FIG. 66 so as to avoid the buildup of tension forces in the mattress cover $3_{65}$. The FIG. 66 structure is located near the shoulder of a reclining body and hence is instrumental in providing tension relief (tension release feature) in a mattress.

In FIG. 67, a front view of a mattress core $1_{67}$ is shown. The mattress core $1_{67}$ has head member 11-1 formed of a 6REF material, a shoulder-to-hip region member 11-10 has a foam layer of 23REF material and a legs member $11\text{-}7_3$ formed of a 40REF material. The head member 11-1, the shoulder-to-hip member 11-10 and the legs member $11\text{-}7_3$ are supported by the base layer $11\text{-}7_1$. A slot $15_S$ is near the shoulder region. The slot $15_S$ provides a shoulder-relief feature that facilitates a large displacement difference that occurs between the neck and shoulder regions of the mattress when a reclining body is on the mattress, particularly when the body is in a side-lying position. The region 12' within the foam layer 11-10 has no structural modification and thus helps establish body alignment of a reclining body by providing greater vertical displacement at the waist. The foam layer 11-10 is manufactured from a 23REF material that establishes the base ILD and other base compression parameters. The structural modification of the foam layer 11-10 material is accomplished with cone-shaped holes 67 that establish varying compression parameters in the X-axis direction that tend to match the displacement of the mattress core caused by reclining bodies. Specifically, the holes 67-2 and 67-3 are present in the top of the core member 11-10 and the holes 67-5 and 67-6 are present in the bottom of the core member 11-10 other than in the waist region 12'. In the top $67_T$ of layer 11-10, the holes 67-2 and 67-3 are shallower (0.5 inch) than the holes 67-5 and 67-6 (0.75 inch) in the bottom $67_B$ of layer 11-10. The head member 11-1, the shoulder-to-hip member 11-10 and the legs member $11\text{-}7_3$ and the layer $11\text{-}7_1$ are all supported by a spring $19_{67}$ having an 8 inch vertical dimension.

In FIG. 68, a front view of a mattress core $1_{68}$ is shown. The mattress core $1_{68}$ has head member 11-1 formed of a 6REF material, a shoulder-to-hip region member 11-10 formed of a foam layer of 23REF material and a legs member $11\text{-}7_3$ formed of a 40REF material. The head member 11-1, the shoulder-to-hip member 11-10 and the legs member $11\text{-}7_3$ are supported by the base layer $11\text{-}7_1$. A slot $15_S$ is near the shoulder region. The slot $15_S$ provides a shoulder-relief feature that facilitates a large displacement difference that occurs between the neck and shoulder regions of the mattress when a reclining body is on the mattress, particularly when the body is in a side-lying position. The lift 12" is located in the foam layer 11-10 where no structural modification exists. The lift 12" is adjustable to help establish body alignment of a reclining body by providing adjustable vertical displacement at the waist. The foam layer 11-10 is manufactured from a 23REF material that establishes the base ILD and other base compression parameters. The structural modification of the foam layer 11-10 material is accomplished with cone-shaped holes 68 that establish varying compression parameters in the X-axis direction that tend to match the displacement of the mattress core caused by reclining bodies. Specifically, the holes 68-2 and 68-3 are present in the top of the core member 11-10 other than above the lift 12". In the top $\mathbf{68}_T$ of layer 11-10, the holes 68-2 and 68-3 are about 0.5 inch deep. The head member 11-1, the shoulder-to-hip member 11-10 and the legs member $\mathbf{11\text{-}7}_3$ and the layer $\mathbf{11\text{-}7}_1$ are all supported by a spring $\mathbf{19}_{68}$ having an 4 inch vertical dimension.

FIG. 69 depicts the dynamics of a shoulder element 35" supported by a three-layer structure for a mattress, having three equal-height layers 139, 140, 141 with varying ILD's in the arrangement of most firm ($ILD_{139}$), intermediate firm ($ILD_{140}$) and least firm ($ILD_{141}$), respectively, where $(ILD_{139})>(ILD_{140})>(ILD_{141})$. In the particular example of FIG. 69, the compression of each of the layers 139, 140, 141 in order to support the shoulder element 35" causes about a 50% compression in each of the layers 139, 140, 141 as indicated by the compressed layers 139', 140', 141'. In this arrangement of the stacked layers with firmer over softer layers {that is, $(ILD_{139})>(ILD_{140})>(ILD_{141})$}, none of the layers 139, 140, 141 is compressed beyond about 50%. Accordingly, as discussed in connection with FIG. 30 and FIG. 31, none of the layers 139, 140, 141 is compressed to the extent that high tension forces impart a hard feeling to a mattress. In the arrangement of FIG. 69, the extent of the compression deformation of layer 139' in the X-axis direction is $S_{69}$ which expands to $SS_{69}$ for the compression deformation of layer 141' in the X-axis direction.

FIG. 70 depicts the dynamics of a shoulder element 35" supported by a three-layer structure for a mattress, having three equal-height layers 141, 140 and 139 with varying ILD's in the arrangement of least firm ($ILD_{141}$), intermediate firm ($ILD_{140}$) and most firm ($ILD_{139}$), respectively, where $(ILD_{141})<(ILD_{140})<(ILD_{139})$. In the particular example of FIG. 70, the compression of each of the layers 141, 140 and 139 in order to support the shoulder element 35" causes about an 80%, 75% and 5% compression in each of the layers 141, 140 and 139 as indicated by the compressed layers 141", 140" and 139". In this arrangement of the stacked layers with softer over firmer layers {that is, $(ILD_{141})<(ILD_{140})<(ILD_{139})$}, the layers 141" and 140" are compressed well beyond 50%. Accordingly, as discussed in connection with FIG. 30 and FIG. 31, the layers 141" and 140" are compressed to the extent that high tension forces will impart a hard feeling to a mattress. In the arrangement of FIG. 70, the extent of the compression deformation of layer 141" and the layer 140" in the X-axis direction is $SS_{70}$ without significant increase in the X-axis direction from layer to layer.

FIG. 71 depicts the dynamics of a shoulder element 35" supported by a two-layer structure for a mattress, having two different height layers 142 and 143 with varying ILD's in the arrangement of most firm ($ILD_{142}$) over least firm ($ILD_{143}$), respectively, where $(ILD_{142})>(ILD_{143})$. In the particular example of FIG. 71, each of the layers 142 and 143 is compressed about 50% in order to support the shoulder element 35" as indicated by compressed layers 142' and 143'. In this arrangement of the stacked layers with firmer over softer layers {that is, $(ILD_{142})>(ILD_{143})$}, neither of the layers 142 or 143 is compressed beyond about 50%. Accordingly, as discussed in connection with FIG. 30 and FIG. 31, neither of the layers 142 or 143 is compressed to the extent that high tension forces impart a hard feeling to a mattress. In the arrangement of FIG. 71, the extent of the compression deformation of layer 142' in the X-axis direction is $S_{71}$ which expands to $SS_{71}$ for the compression deformation of layer 143' in the X-axis direction. In FIG. 71, the top of layer 142 is structurally modified with cone-shaped holes 144 like the holes 67-2 in FIG. 67. In FIG. 71, the holes 144' beneath the center of the shoulder element 35" are completely compressed. In FIG. 71, the bottom of layer 143 is structurally modified with cone-shaped holes 145 like the holes 67-5 in FIG. 67. The holes 145' beneath the center of the shoulder element 35" are completely compressed. The structural modification of the layer 142 with holes 144 and the structural modification of the layer 143 with holes 145 tends to locally reduce the ILD compression parameters of those layers.

While the invention has been described in connection with different embodiments, still further and other embodiments are contemplated. The embodiments described in connection with FIGS. 2, 3 and 19 (and related figures) include dynamically controllable lifts that adjust for the vertical displacement pattern, $E_Z$, of different bodies where $E_Z=f(x)$ where f(x) tracks the curve of any particular body. The lifts are used in combination with discrete foam members having different displacement parameters, DP, so that supporting force, $SF_Z$, is represented at any segment x in the X-axis direction by the local force, F(x), and the combined local displacement parameters, DP(x) where $SF_Z=F(x)\cdot DP(x)$.

The embodiments described in connection with FIGS. 20 and 21 employ discrete foam members that adjust for the vertical displacement pattern, $E_Z$, of different bodies where $E_Z=f(x)$ where f(x) tracks the curve of any particular body. The discrete members used have different displacement parameters, DP, so that supporting force, $SF_Z$, is represented at any segment x in the X-axis direction by the local force, F(x), and the combined local displacement parameters, DP(x) where $SF_Z=F(x)\cdot DP(x)$. The members 49-1 and 49-2 in FIGS. 20 and 21 are reversed to change DP(x) to adjust for the difference between a male body and a female body.

The embodiments described in connection with FIGS. 24 through 30 employ continuous foam members such as 50-1, 50-2 and 50-3 that adjust for the vertical displacement pattern, $E_Z$, of different bodies where $E_Z=f(x)$ where f(x) tracks the curve of any particular body. The continuous foam members used have different displacement parameters, DP, as a function of X-axis position (achieved by varying thickness) so that supporting force, $SF_Z$, is represented at any segment x in the X-axis direction by the local force, F(x), and the combined local displacement parameters, DP(x) where $SF_Z=F(x)\cdot DP(x)$.

The above embodiments have been described with displacement parameters, DP(x), that vary as a function of the X-axis position and which track the X-axis vertical elevation profile of a body as described in connection with FIGS. 7 and 8. Using displacement parameters, DP(x), that vary as a function of the X-axis position enable a mattress to be economically manufactured while at the same time providing an improved mattress that supports a reclining body in a comfortable alignment and with low surface pressure.

The present invention also applies to displacement parameters that vary as a function of the Y-axis position. As described in connection with FIG. 23, foam members have Y-axis displacement parameters that are essentially the same as X-axis parameters. Accordingly, any of the members providing different X-axis variations in displacement parameters can also me modified to provide Y-axis variations in displacement parameters. For example, the member $\mathbf{23\text{-}2}_1$ in FIG. $1, in an alternate embodiment, is segmented in the Y-axis direction as shown by the multiple segments $\mathbf{23'\text{-}2}_1$. A body, such as body 36 in FIG. 11, has a Y-axis profile at any X-axis location that is analogous to the X-axis profile of FIG. 21. The segments $\mathbf{23'\text{-}2}_1$ for mattress $\mathbf{1}_{01}$ have displacement parameters varying in the Y-axis direction. In one preferred embodiment, the Y-axis variation track the Y-axis vertical elevation profile of a reclining body. In such an embodiment, the displacement parameters, DP(x,y), vary as a function of the X-axis position (and preferably track the X-axis vertical elevation profile of a reclining body) and vary as a function of the Y-axis position (and preferably track the Y-axis vertical elevation profile of a reclining body).

Although the mattress embodiments described are capable of providing straight body alignment, the control of lifts, other mechanisms members permit a person to select any alignment whether straight or not. In general, a person by actuating a control device or by other means will select a comfortable alignment, that is, an alignment which is comfortable to that person irrespective of whether or not the comfortable alignment is actually straight postural alignment.

While the invention has been particularly shown and described with reference to preferred embodiments thereof it will be understood by those skilled in the art that various changes in form and details may be made therein without departing from the scope of the invention.

The invention claimed is:

1. A mattress, extending in a lateral direction from side to side and extending in a longitudinal direction from a mattress head to a mattress foot, for supporting a reclining body, said mattress including a head part, a shoulder part, a waist part, a hip part and a leg part, said reclining body having a displacement profile, said mattress comprising, a core extending in said longitudinal direction and in said lateral direction, said core for undergoing differing vertical displacements when supporting the reclining body, said core having displacement parameters varying to match the displacement profile of the reclining body whereby the reclining body is supported by low body pressure, said core having a plurality of regions where the vertical displacement in one or more of the regions varies to match the displacement profile of the reclining body to maintain the reclining body in alignment, said core including one or more foam members having structural modification where the one or more foam members at different longitudinal positions exhibit different displacement parameters including different ILDs to support the reclining body with low body pressure and exhibits different vertical displacements to maintain the reclining body in alignment.

2. A mattress, extending in a lateral direction from side to side and extending in a longitudinal direction from a mattress head to a mattress foot, for supporting a reclining body, said mattress including a head part, a shoulder part, a waist part, a hip part and a leg part, said reclining body having a displacement profile, said mattress comprising, a core extending in said longitudinal direction and in said lateral direction, said core for undergoing differing vertical displacements when supporting the reclining body, said core having displacement parameters varying to match the displacement profile of the reclining body whereby the reclining body is supported by low body pressure, said core having a plurality of regions where the vertical displacement in one or more of the regions varies to match the displacement profile of the reclining body to maintain the reclining body in alignment, said core including one or more foam members having structural modification where the one or more foam members at different longitudinal positions exhibit different displacement parameters including different ILDs to support the reclining body with low body pressure and exhibit different vertical displacements to maintain the reclining body in alignment and said core including a spring supporting said foam members.

3. The mattress as in claim 1, or 7 wherein said core includes head, center and leg regions wherein said center region has different ILD's then said head and leg regions and wherein said head region is for establishing head vertical elevations for supporting said head part, said center region is for establishing center vertical elevations for supporting said shoulder part, waist part and hip part, and said leg region is for establishing leg vertical elevations for supporting said leg part and wherein said center vertical elevations vary relative to said head vertical elevations and said leg vertical elevations to establish body alignment.

4. The mattress as in claim 3 wherein said core has a flat top in the absence of a reclining body.

5. The mattress as in claim 3 wherein a high gradient exists in a body profile between said head part and said shoulder part and wherein said core has a change in displacement parameters between said head region and said shoulder region that accommodates said high gradient to maintain low body pressure and body alignment.

6. The mattress as in claim 5 wherein said leg region has a high ILD that provides firm support at said mattress foot for a sitting body.

7. The mattress as in claim 6 wherein said first core and second core are separated by a slot for isolation of said first core and said second core.

8. The mattress as in claim 3 wherein said core includes a first core beside a second core for supporting side-by-side reclining bodies.

9. The mattress as in claim 3 including a firm foam member having a high ILD surrounding at least three sides of said mattress to provide firm support around said three sides of the mattress.

10. The mattress as in claim 3 wherein said body alignment is substantially straight.

11. The mattress as in claim 3 wherein said low body pressure is below a low pressure threshold.

12. The mattress as in claim 11 wherein said threshold is below an ischemic pressure threshold.

13. The mattress as in claim 2 wherein said core includes head, center and leg regions wherein said head region is for establishing head vertical elevations, said center region is for establishing center vertical elevations, and said leg region is for establishing leg vertical elevations, said center region including a shoulder region, a waist region and a hip region.

14. The mattress as in claim 13 wherein said head region includes a first foam member having a first ILD displacement parameter and includes a second foam member having a second ILD displacement parameter, said first foam member above said second foam member with the first ILD displacement parameter greater than said second ILD displacement parameter.

15. The mattress as in claim 13 wherein said center region includes a first foam member having a first ILD displacement parameter and includes a second foam member having a second ILD displacement parameter, said first foam member above said second foam member with the first ILD displacement parameter greater than said second ILD displacement parameter.

16. The mattress as in claim 13 wherein said center region includes a first foam member above a second foam member and wherein said leg region includes a foam member that has an ILD displacement parameter greater than ILD displacement parameters for said first foam member and said second foam member.

17. The mattress as in claim 13 wherein said center region includes one or more foam members structurally modified to modify the displacement parameters.

18. The mattress as in claim 13 wherein said center region includes a first structurally modified foam member above a second structurally modified foam member where the first structurally modified foam member has a greater ILD displacement parameter then said second structurally modified foam member.

19. The mattress as in claim 13 wherein said core includes a foam member having structural modification where the foam member at different longitudinal positions exhibits different displacement parameters to support the reclining body with low body pressure and exhibits different vertical displacements to maintain the reclining body in alignment.

20. The mattress as in claim 13 wherein said core includes a tension relief slot for avoiding tension forces in said foam members as a result of displacement caused by said reclining body, and a cover for covering said core, said cover including an opening on a top side of said mattress revealing said tension relief slot.

21. The mattress as in claim 13 wherein said core includes a tension relief slot for avoiding tension forces in said foam members as a result of displacement caused by said reclining body.

22. The mattress as in claim 13 wherein said core includes a spring supporting said foam members.

23. The mattress as in claim 13 wherein said core includes a lift for adjusting the vertical elevation of the mattress.

24. The mattress as in claim 23 wherein said lift is located in the waist region.

25. The mattress as in claim 23 wherein said lift is located in the head region.

26. The mattress as in claim 23 wherein said lift is inflatable with a fluid.

27. The mattress as in as in claim 26 wherein said lift is inflatable with air and wherein said mattress includes pressure means for adjusting air pressure in said lift and includes a control device for controlling said pressure means to adjust said air pressure in said lift and thereby adjust the vertical elevation of said lift.

28. The mattress as in claim 1 wherein said core includes head, center and leg regions wherein said head region is for establishing head vertical elevations, said center region is for establishing center vertical elevations, and said leg region is for establishing leg vertical elevations, said center region including a shoulder region, a waist region and a hip region wherein the waist region has a higher ILD than the shoulder region and the hip region.

29. The mattress as in claim 28 wherein said head region includes a first foam member having a first ILD displacement parameter and includes a second foam member having a second ILD displacement parameter, said first foam member above said second foam member with the first ILD displacement parameter greater than said second ILD displacement parameter.

30. The mattress as in claim 28 wherein said center region includes a first foam member having a first ILD displacement parameter and includes a second foam member having a second ILD displacement parameter, said first foam member above said second foam member with the first ILD displacement parameter greater than said second ILD displacement parameter.

31. The mattress as in claim 28 wherein said core includes one or more foam members structurally modified by removing holes extending through the foam members.

32. The mattress as in claim 28 wherein said core includes a spring supporting said foam members.

33. The mattress as in claim 28 wherein said core includes a lift for adjusting the vertical elevation of the mattress.

34. The mattress as in claim 33 wherein said lift is located in the waist region.

35. The mattress as in claim 33 wherein said lift is located in the head region.

36. The mattress as in claim 33 wherein said lift is inflatable with a fluid.

37. The mattress as in as in claim 36 wherein said lift is inflatable with air and wherein said mattress includes pressure means for adjusting air pressure in said lift and includes a control device for controlling said pressure means to adjust said air pressure in said lift and thereby adjust the vertical elevation of said lift.

* * * * *